US006474792B2

(12) United States Patent
Sugiyama et al.

(10) Patent No.: US 6,474,792 B2
(45) Date of Patent: Nov. 5, 2002

(54) LIQUID DISCHARGE HEAD, METHOD FOR MANUFACTURING LIQUID DISCHARGE HEAD, HEAD CARTRIDGE ON WHICH LIQUID DISCHARGE HEAD IS MOUNTED, AND LIQUID DISCHARGE APPARATUS

(75) Inventors: Hiroyuki Sugiyama; Masami Kasamoto, both of Kanagawa; Hiroyuki Ishinaga, Tokyo; Teruo Ozaki, Kanagawa; Yoshinori Misumi, Tokyo; Yoichi Taneya, Kanagawa; Junichiro Iri, Kanagawa; Hiroaki Mihara, Kanagawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/916,464

(22) Filed: Jul. 30, 2001

(65) Prior Publication Data

US 2002/0027577 A1 Mar. 7, 2002

(30) Foreign Application Priority Data

Jul. 31, 2000 (JP) ..... 2000-232413
Sep. 4, 2000 (JP) ..... 2000-267817

(51) Int. Cl.[7] ..... B41J 2/05
(52) U.S. Cl. ..... 347/65
(58) Field of Search ..... 347/63, 65, 20, 347/56, 61, 94

(56) References Cited

U.S. PATENT DOCUMENTS

| | | | | |
|---|---|---|---|---|
| 4,330,787 A | | 5/1982 | Sato et al. | 347/63 |
| 5,278,585 A | | 1/1994 | Karz et al. | 347/65 |
| 5,821,962 A | * | 10/1998 | Kudo et al. | 347/65 |
| 6,007,187 A | | 12/1999 | Kashino et al. | 347/65 |
| 6,168,264 B1 | | 1/2001 | Yoshihira et al. | 347/65 |
| 6,270,200 B1 | | 8/2001 | Ishinaga et al. | 347/65 |

FOREIGN PATENT DOCUMENTS

| | | | | |
|---|---|---|---|---|
| EP | 0436047 | | 7/1991 | B41J/2/055 |
| EP | 721841 | A2 * | 7/1996 | B41J/2/14 |
| EP | 0721841 | | 7/1996 | B41J/2/05 |
| EP | 9-48127 | | 2/1997 | B41J/2/05 |
| EP | 0819528 | | 1/1998 | B41J/2/05 |
| EP | 0895861 | | 2/1999 | B41J/2/05 |
| EP | 0921002 | | 6/1999 | B41J/2/14 |
| EP | 976562 | A2 * | 2/2000 | B41J/2/14 |
| EP | 0987112 | | 3/2000 | B41J/2/14 |
| EP | 1083049 | | 3/2001 | B41J/2/14 |
| JP | 61-59911 | | 12/1986 | B41J/3/04 |
| JP | 61-59914 | | 12/1986 | B41J/3/04 |
| JP | 6-31918 | | 2/1994 | B41J/2/05 |
| JP | 9-201966 | | 8/1997 | B41J/2/05 |
| JP | 9-323420 | | 12/1997 | B41J/2/05 |
| JP | 10-24588 | | 1/1998 | B41J/2/05 |
| JP | 11-170531 | | 6/1999 | B41J/2/05 |
| JP | 11-235829 | | 8/1999 | B41J/2/05 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

In a liquid discharge head having a movable member displaced by generation of a bubble, endurance of stepped portions of the movable member and of root portions of movable parts of the movable member is enhanced and flexure deformation of the movable member is prevented to enhance endurance of the member. A pressing member for covering stepped portions of a movable member and root portions of branched movable parts is provided within a flow path. A part of the pressing member is tapered and extends to a downstream side (toward a discharge port) to be spaced apart from the movable member, thereby forming a flexure regulating portion opposed to and spaced apart from an intermediate portion of the movable member. The pressing member and the flexure regulating portion suppress excessive deformation of the movable member.

22 Claims, 31 Drawing Sheets

LIQUID DISCHARGE HEAD, METHOD FOR MANUFACTURING LIQUID DISCHARGE HEAD, HEAD CARTRIDGE ON WHICH LIQUID DISCHARGE HEAD IS MOUNTED, AND LIQUID DISCHARGE APPARATUS

BACKGROUND OF THE INVENTION

1. Field of the Invention

The present invention relates to a liquid discharge head in which desired liquid is discharged by generation of a bubble created by acting thermal energy on liquid, a method for manufacturing such a liquid discharge head, a head cartridge on which such a liquid discharge head is mounted, and a liquid discharge apparatus. More particularly, the present invention relates to a liquid discharge head having a movable member displaced by utilizing generation of a bubble, a method for manufacturing such a liquid discharge head, a head cartridge on which such a liquid discharge head is mounted, and a liquid discharge apparatus.

Incidentally, a term ("recording" in the specification means that not only an image such as a character or a figure having a special meaning but also a meaningless image such as a pattern are formed on a recording medium.

2. Related Background Art

In the past, it is known to propose an ink jet recording method, i.e., so-called bubble jet recording method in which change in state of ink including abrupt volume change (generation of a bubble) is caused by applying energy such as heat to ink, and the ink is discharged from a discharge port by an acting force based on such change of state, thereby effecting recording by adhering the ink onto a recording medium. As disclosed in Japanese Patent Publication No. 61-59911, Japanese Patent Publication No. 61-59914 and U.S. Pat. No. 4,723,129, a recording apparatus using such a bubble jet recording method generally includes discharge ports from which the ink is discharged, ink flow paths communicated with the discharge ports, and heat generating bodies (electrical/thermal converters) as energy generating means disposed within the ink flow paths and adapted to generate energy for discharging the ink.

According to such a recording method, a high quality image can be recorded with low noise and at a high speed. Further, in a head for effecting the recording by using such a recording method, since the discharge ports for discharging the ink can be arranged with high density relatively easily, it is relatively easy to permit formation of an image having high resolving power and a color image by using a compact recording apparatus. As such, the bubble jet recording method has various excellent advantages. Thus, recently, the bubble jet recording method has been applied to various office equipments such as printers, copying machines and facsimiles and also has been applied to industrial equipments such as print apparatuses.

As the bubble jet technique has been utilized in various fields in this way, the following various requests have been increased.

In order to obtain a high quality image, there has been proposed a driving condition for providing a liquid discharging method capable of discharging the ink effectively on the basis of stable bubble generation and high speed ink discharging, or, in the viewpoint of high speed recording, there has been proposed an improved flow path arrangement for providing a liquid discharge head in which a speed of filling (re-fill) of liquid into the flow path to compensate for the discharged liquid is increased.

Other than such a head, in consideration of a back wave (pressure directing toward a direction opposite to a direction toward the discharge port) caused by generation of the bubble, Japanese Patent Application Laid-Open No. 6-31918 discloses a structure in which the back wave giving energy loss in the discharging is prevented. In this structure, a triangular portion of a triangular plate member is disposed in a confronting relationship to a heater for generating the bubble. In this structure, the back wave can slightly be suppressed temporarily by the plate member. However, since there is no teaching and no consideration regarding a relationship between growth of the bubble and the triangular portion, the above-mentioned structure arises the following problem.

That is to say, in the above-mentioned structure, since the heater is disposed on a bottom of a recessed portion not to be linearly communicated with the discharge port, a shape of a liquid droplet cannot be stabilized, and, since the growth of the bubble is permitted from periphery of an apex of the triangle, the bubble is grown throughout from one side of the triangular plate member to the other side thereof, with the result that the growth of the normal bubble is completed as if there is no plate member. Accordingly, the grown bubble does not relates to the presence of the plate member. Rather, since the entire plate member is surrounded by the bubble, during contraction of the bubble, the re-fill to the heater disposed in the recessed portion causes a turbulent flow, which may accumulates small bubbles in the recessed portion, thereby deteriorating the principle itself for discharging the ink based on the growth of the bubble.

Further, European Patent Publication No. 0 436 047 A1 proposes the invention in which a first valve disposed between an area near a discharge port and a bubble generating area and adapted to block these areas and a second valve disposed between the bubble generating area and an ink supplying area and adapted to completely block these areas are alternately opened and closed (refer to FIGS. 4 to 9 of this document). However, in this invention, since three chambers are divided into groups (two chambers), in the discharging, the ink following to a liquid droplet has a long tail, with the result that many satellite dots are created in comparison with the normal discharging system including growth, contraction and disappearance of the bubble (It is guessed that effect of retraction of meniscus due to disappearance of the bubble cannot be utilized). Further, in the re-fill, although the liquid is supplied to the bubble generating area as the disappearance of the bubble, since the liquid cannot be supplied to the area near the discharge port until the next bubble is generated, not only there is great dispersion in discharged liquid droplets, but also discharge response frequency becomes very small, and, thus, this invention cannot be put to a practical use.

In consideration of the fundamental liquid discharging principle, the inventors investigated to provide a new liquid discharging method utilizing a bubble and a head used therewith, which were not obtained in the past, and proposed the invention using a movable member (plate member having a free end positioned near a discharge port with respect to a fulcrum) effectively contributing to the discharging of liquid, which is different from the conventional techniques (for example, refer to Japanese Patent Application Laid-Open No. 9-201966).

Now, the liquid discharging method and the head used therewith, as disclosed in the Japanese Patent Application Laid-Open No. 9-201966 will be described with reference to FIGS. 29A to 29D and FIG. 30. FIGS. 29A to 29D are sectional views of a liquid discharge head, taken along a liquid flow path, explaining the discharging principle. FIG. 30 is a partial sectional perspective view of the liquid discharge head shown in FIGS. 29A to 29D. The liquid discharge head shown in FIGS. 29A to 29D and FIG. 30 has a most fundamental arrangement for realizing the liquid discharging method disclosed in the Japanese Patent Application Laid-Open No. 9-201966 to improve a discharging force and discharging efficiency by controlling a growing direction of a bubble and a propagating direction of pressure created by generation of the bubble in the liquid discharging.

Incidentally, in this specification, terms "upstream" and "downstream" are used with respect to a direction of the liquid flowing from a liquid supplying source through above a bubble generating area (or movable member) toward a discharge port.

The term "downstream side" regarding the bubble itself means a discharge port side portion of the bubble mainly relating to the discharging of a liquid droplet directly. More specifically, "downstream side" means a downstream side of the center of the bubble or a downstream side of the center of an area of a heat generating member, with respect to the flowing direction.

Further, "comb tooth" is a term used with respect to the movable member and means a configuration in which a connecting part to a base is a common portion from which a plurality of movable portion are branched toward a free end which is opened outwardly.

In the example shown in FIGS. 29A to 29D, the liquid discharge head includes a heat generating member 1102 (heat generating resistor having a dimension of 20 $\mu$m×105 $\mu$m in this example) for acting thermal energy on liquid, as a discharge energy generating element adapted to generate discharge energy for discharging the liquid and disposed on an element substrate 1101, and a liquid flow path 1103 is formed above the element substrate 1101 in correspondence to the heat generating member 1102. The liquid flow path 1103 is communicated with a discharge port 1104. The plurality of liquid flow paths 1103 are communicated with a common liquid chamber 1105 for supplying the liquid to the plurality of liquid flow paths. After the liquid is discharged from the discharge port 1104, an amount of liquid corresponding to the discharge liquid is supplied from the common liquid chamber 1105 to the liquid flow path 1103.

Within the liquid flow path 1103, above the element substrate 1101, a plate-shaped movable member 1106 made of elastic material such as metal and having a flat surface portion opposed to the heat generating member 1102 is supported in a cantilever fashion. One end of the movable member 1106 is secured to a base (support member) 1107 formed by patterning photosensitive resin on a wall of the liquid flow path 1103 or the element substrate 1101, thereby providing a fulcrum (fixed end) 1108.

Further, the movable member 1106 has a comb shape. In this way, the movable member 1106 can easily be manufactured with a low cost, and alignment of the movable member with respect to the base can be facilitated.

The movable member 1106 is arranged in a confronting relation to and spaced apart from the heat generating member 1102 by about 15 $\mu$m to cover the heat generating member in such a manner that the fulcrum 1108 is disposed at an upstream side of great liquid flow flowing from the common liquid chamber 1105 through above the movable member 1106 toward the discharge port 1104 during the liquid discharging operation and a free end 1109 is disposed at a downstream side of the fulcrum 1108. A bubble generating area 1110 is defined between the heat generating member 1102 and the movable member 1106.

By heating the heat generating member 1102, heat is applied to the liquid in the bubble generating area 1110 between the movable member 1106 and the heat generating member 1102, with the result that a bubble 1111 is generated in the liquid in accordance with a film-boiling phenomenon as disclosed in U.S. Pat. No. 4,723,129 (refer to FIG. 29B). Pressure caused by generation of the bubble 1111 preferentially acts on the movable member 1106, with the result that, as shown in FIGS. 29B and 29C, the movable member 1106 is displaced to be opened greatly toward the discharge port 1104 around the fulcrum 1108. When the movable member 1106 is displaced, propagation of the pressure created by the generation of the bubble and growth of the bubble are directed toward the discharge port 1104. Further, in this case, since a width of the free end 1109 is relatively wide, a bubbling power of the bubble 1111 can easily be directed toward the discharge port 1104, thereby fundamentally enhancing liquid discharging efficiency and discharging speed. In FIGS. 29B and 29D, C indicates a center of an area of the heat generating member and L indicates the liquid.

As mentioned above, in the technique disclosed in the Japanese Patent Application Laid-Open No. 9-201966, by arranging the free end 1109 of the movable member 1106 at the downstream side, i.e., toward the discharge port 1104 and by opposing the movable member 1106 to the heat generating member 1102 and the bubble generating are 1110, the bubble 1111 is controlled positively.

Further, as mentioned above, by securing the movable member 1106 to the base 1107, a gap of about 1 to 20 $\mu$m is created between the movable member 1106 and the heat generating member 1102, thereby enhancing the liquid discharging efficiency of the movable member 1106 considerably. Accordingly, according to the liquid discharge head based on the new discharging principle as mentioned above, since a combined effect of the generated bubble 1111 and the displaced movable member 1106 can be obtained and since the liquid in the vicinity of the discharge port 1104 can be discharged efficiently, the liquid discharging efficiency can be enhanced in comparison with the conventional bubble jet liquid discharge heads.

Incidentally, although various materials can be used to manufacture the movable member 1106 used in the above-mentioned liquid discharge head, nickel having excellent elasticity is generally used for efficiently utilizing the pressure created by the generation of the bubble 1111. Further, as disclosed in Japanese Patent Application Laid-Open Nos. 11-170531 and 11-235829, materials of silicon group are generally used.

Further, Japanese Patent Application Laid-Open No. 9-48127 discloses the invention in which an upper limit of the displacement of the movable member is regulated in order to prevent distortion of performance of the movable member. Further, Japanese Patent Application Laid-Open No. 9-323420 discloses the invention in which the position of the upstream common liquid chamber is shifted toward the free end of the movable member, i.e., toward a downstream side with respect to the movable member to utilize the advantage of the movable member thereby to enhance the re-filling ability. In these inventions, since it is assumed that the growth of the bubble is released at once toward the discharge port from the condition that the bubble is temporarily entrapped by the movable member, individual elements relating to the formation of liquid droplet by means of the bubble and relationships therebetween were not noticed.

As a next step, Japanese Patent Application Laid-Open No. 10-24588 discloses the invention in which a part of the bubble generating area is released from the movable member, as an invention in which the growth of the bubble due to propagation of pressure wave (acoustic wave) is noticed as a factor relating to the liquid discharging. However, also in this invention, since only the growth of the bubble during the liquid discharging is noticed, individual elements relating to the formation of liquid droplet by means of the bubble and relationships therebetween were not noticed.

Although the fact that a forward portion of the bubble generated by the film-boiling affects a great influence upon the discharging (edge-shooter type) is well-known, in the past, a technique in which such a forward portion is contributed to formation of the discharge liquid droplet more efficiently has not been noticed. The inventors have investigated technical analysis regarding such a technique.

Further, the inventors obtained the following effective knowledge by checking the displacement of the movable member and the generated bubble.

Such knowledge is to regulate displacement of the free end of the movable member with respect to the growth of the bubble by means of a regulating portion (stopper). By regulating the displacement of the movable member by means of the regulating portion, the bubble is regulated to be grown toward the upstream side of the flow path, with the result that energy for discharging the liquid can be transferred to the downstream side where the discharge port is formed.

As high density arrangement of the head has been progressed, in the viewpoint of accuracy, it becomes considerably difficult to manufacture the movable member and the base independently and to realize alignment therebetween, and, thus, it has been requested that the movable member and the base be integrally formed.

If the movable member including the base (fixing portion) is formed in this way, the movable member has a stepped structure between the base and a movable part. If the movable member has a portion a configuration of which is greatly changed in this way, during the displacement of the movable member caused by the generation of the bubble, stress may be concentrated into such a portion. Further, the movable member is branched to form the comb configuration as mentioned above and root portions of the comb configuration are also greatly deformed to concentrate stress therein. Particularly, if the comb-branched plural movable parts are displaced simultaneously, excessive stress may act on the boundary portion between the movable parts and the base.

Although the above-mentioned material of silicon group preferably used for manufacturing the movable member is flexible material having excellent elasticity, if excessive stress acts on such material, crack may generated in the material to worsen endurance of the movable member. If the crack is generated, the stress is further concentrated into the cracked area thereby to break the movable member ultimately. Further, when the metallic material is used, if the excessive stress acts on the material, undesirable influence may occur. Normally, the movable member has adequate endurance by increasing a thickness of the material not to arise any problem if some stress acts thereon.

However, if the movable member of the liquid discharge head is formed as a film from metal such as nickel by spattering, it is difficult to control the stress, and it is difficult to increase the film thickness. Further, when the movable member is formed from material of silicon group by a CVD method, although the stress can be controlled and the film thickness of the movable member integral with the base can be increased, also in this case, if the excessive stress acts, the endurance of the movable member will be worsened.

Further, in the liquid discharge head having the movable member, whenever the liquid is discharged, the displacement and restoring of the movable member are repeated as the liquid is heated and generation and disappearance of the bubble occur. However, if a bubble greater than the bubble normally used for discharging the liquid is generated, the movable member may be deformed excessively. Normally, although the flow path is filled with the liquid except for a meniscus portion at the discharge port, after suction recovery processing of the liquid discharge head is performed, if the excessive liquid is removed, a space which is not filled with the liquid may be generated within the flow path. In such a condition, when the heat generating member is heated to discharge the liquid, the movable member is displaced due to the bubbling of the liquid, with the result that the free end (distal end) of the movable member is regulated by the regulating portion to be stopped at a desired position. However, an intermediate portion of the movable member (portion between the free end and the fulcrum) is not regulated and is strongly pulled upwardly. Particularly, in a condition that the space which is not filled with the liquid exists above the movable member, since there is no pressure of the liquid, the movable member is subjected to great stress for pulling the movable member toward the upstream side, with the result that convex flexure directed upwardly (toward a top plate) is created. Due to such flexure deformation, crack or defect may be generated in the movable member. Further, if the flexure deformation is increased or is repeated frequently, the movable member may be broken.

SUMMARY OF THE INVENTION

The present invention is made in consideration of the above-mentioned conventional drawbacks, and an object of the present invention is to provide a liquid discharge head in which endurance of stepped portions of a movable member and of root portions of movable parts of the movable member can be enhanced and reliability of liquid discharging can be enhanced, a method for manufacturing such a liquid discharge head, a head cartridge on which such a liquid discharge head is mounted, and a liquid discharge apparatus.

Another object of the present invention is to provide a liquid discharge head and a liquid discharge apparatus, in which endurance of a movable member is enhanced and a discharging property is stabilized by not only regulating displacement of a free end of the movable member but also preventing flexure deformation and which have high reliability.

To achieve the above objects, the present invention provides a liquid discharge head which comprises a discharge port for discharging liquid, a liquid flow path communicated with the discharge port and adapted to supply the liquid to the discharge port, an element substrate including a heat generating member for generating a bubble in the liquid filled in the liquid flow path, a movable member having a fixed portion supported by and secured to the element substrate, and a free end positioned toward the discharge port and movable parts disposed at a position opposed to the heat generating member on the element substrate and spaced apart from the element substrate by a gap therebetween, and a regulating portion for regulating a displacement amount of the movable member, and in which the liquid is discharged from the discharge port by pressure created by generation of a bubble meanwhile the movable part of the movable member is displaced, wherein the regulating portion comprises a distal end regulating part abutting against the free end of the movable member and at least one displacement regulating part spaced apart from the distal end regulating part.

The movable member is constituted by integrally forming the fixed portion, plurality of movable parts and a common support portion spaced apart from the element substrate and adapted to branch and support the movable parts so that, when the liquid is discharged, the movable part is displaced around a connection portion between the movable part and the common support portion as a fulcrum, and the displacement regulating part may be an auxiliary member which is provided in an opposed relationship to at least common support portion of the movable member to suppress excessive displacement of the common support portion.

With the above-mentioned arrangement, the stress (which acts on the connection portion between the common support portion and the fixed portion and on the root portions of the branched movable parts and which can be concentrated during the displacement of the movable member if there is no auxiliary member) can be dispersed into the auxiliary member and be relaxed.

When the auxiliary member is opposed to the common support portion to suppress the excessive displacement of the common support member, although an effect for relaxing the stress acting on the movable member can be obtained, by providing the auxiliary member to abut against at least an upper surface of the movable member, a function for relaxing the stress can be obtained more effectively. Further, by providing the auxiliary member to extend onto and abut against the element substrate between the plural branched movable parts, a portion of the movable member into which the stress is apt to be concentrated can be firmly supported, thereby relaxing the stress more effectively. In order to obtain the function for relaxing the stress concentration more effectively, it is desirable that the auxiliary member be formed to extend into the space between the movable parts of the movable member and the element substrate, i.e., to cover the entire root portions of the movable parts.

Further, when the auxiliary member is formed along a direction along which the branched movable parts are arranged side by side, the stress acting on the movable parts can be dispersed in such a direction and be relaxed uniformly between the movable parts, thereby enhancing endurance of the branched movable parts.

Further, the auxiliary member may be formed integrally with flow path walls forming side walls of the liquid flow path. In this case, the auxiliary member can be formed without increasing the number of manufacturing steps.

Material for the auxiliary member may be photosensitive resin, particularly, resin of epoxy group.

In the above-mentioned method for manufacturing the liquid discharge head of the present invention, when the flow path walls and the auxiliary member are formed simultaneously from the same material, the auxiliary member can easily be formed without increasing the number of manufacturing steps. In this case, a manufacturing method including a step for forming the movable member on the element substrate, a step for pouring liquid-state photo-curable resin into the gap between the movable member and the element substrate and coating such resin on the element substrate until the movable member is covered, a step for curing the photo-curable resin by exposure at least in areas where the flow path walls and the auxiliary member are to be formed, and a step for removing uncured photo-curable resin can preferably be used.

Further, the flow path walls and the auxiliary member may be formed independently in consideration of respective functions. In this case, a manufacturing method including a step for forming the movable member and the flow path walls defining the side walls of the flow path on the element substrate, a step for pouring liquid-state photo-curable resin into the gap between the movable member and the element substrate and coating such resin on the element substrate until the movable member is covered, a step for curing the photo-curable resin by exposure at least in areas where the auxiliary member is to be formed, and a step for removing uncured photo-curable resin can preferably be used.

As mentioned above, when the auxiliary member is formed from negative type photo-curable resin which can be cured by exposure, by forming the movable member from transparent material, since the gap between the movable member and the element substrate can also be exposed, the auxiliary member can be formed in the gap.

Further, according to another liquid discharge head of the present invention, the displacement regulating portion is constituted by at least one flexure regulating portion spaced apart from the distal end regulating portion and disposed at an upstream side of the heat generating member and capable of abutting against the intermediate portion of the movable member. The flexure regulating portion may abut against the intermediate portion of the movable member only when the movable member is displaced excessively.

With this arrangement, since the displacement of the free end of the movable member is regulated by the distal end regulating portion and the flexure displacement of the intermediate portion of the movable member is regulated by the flexure regulating portion, the movable member is not displaced excessively. Accordingly, crack and/or defect is not created in the movable member, thereby preventing the movable member from being broken.

It is preferable that the distal end regulating portion and the flexure regulating portion are formed independently on the top plate joined to the element substrate.

Preferably, a sectional area of the distal end regulating portion in a direction perpendicular to a liquid flowing direction in the liquid flow path is greater than a sectional area of the flexure regulating portion in the direction perpendicular to the liquid flowing direction in the liquid flow path. In this case, the distal end regulating portion may have a width wider than that of the flexure regulating portion. With this arrangement, the excessive displacement of the movable member is prevented and a re-fill property is not worsened. Further, a plurality of distal end regulating portions may be provided.

A head cartridge according to the present invention is characterized in that it comprises the above-mentioned liquid discharge head, and a liquid container for storing the liquid to be supplied to the liquid discharge head.

A liquid discharge apparatus according to the present invention is characterized in that it comprises the above-mentioned liquid discharge head, and drive signal supplying means for supplying a drive signal for discharging the liquid from the discharge port. Further, conveying means for conveying a recording medium for receiving the liquid discharged from the liquid discharge head may be provided.

Incidentally, in the explanation of this invention, terms "upstream" and "downstream" are used with respect to a direction of the liquid flowing from a liquid supplying source through above the bubble generating area (or movable member) toward the discharge port and with respect to the constructural direction.

Further, the term "downstream side" regarding the bubble itself means a bubble generated in an area at a downstream side as for the flowing direction or the constructural direction with respect to the center of the bubble or at a downstream side of the center of the area of the heat generating body. Similarly, the term "upstream side" regarding the bubble itself means a bubble generated in an area at an upstream side as for the flowing direction or the constructural direction with respect to the center of the bubble or at an upstream side of the center of the area of the heat generating body.

BRIEF DESCRIPTION OF THE DRAWINGS

FIG. 1A is a side view looked at from a discharge port side, FIG. 1B is a sectional plan view, FIG. 1C is a sectional view taken along a liquid flow path and FIG. 1D is a sectional view of the head taken along a direction perpendicular to the liquid flow path;

FIG. 3A is a plan view, FIG. 3B is an enlarged plan view, FIG. 3C is a perspective view and FIG. 3D is an enlarged perspective view;

FIG. 4A is a side view looked at from a discharge port side, FIG. 4B is a sectional plan view, FIG. 4C is a sectional view taken along the liquid flow path and FIG. 4D is a sectional view of the head taken along a direction perpendicular to the liquid flow path;

DETAILED DESCRIPTION OF THE PREFERRED EMBODIMENTS

The present invention will now be explained in connection with embodiments thereof with reference to the accompanying drawings.

<First Embodiment>

(Construction of liquid discharge head)

Figure 7:
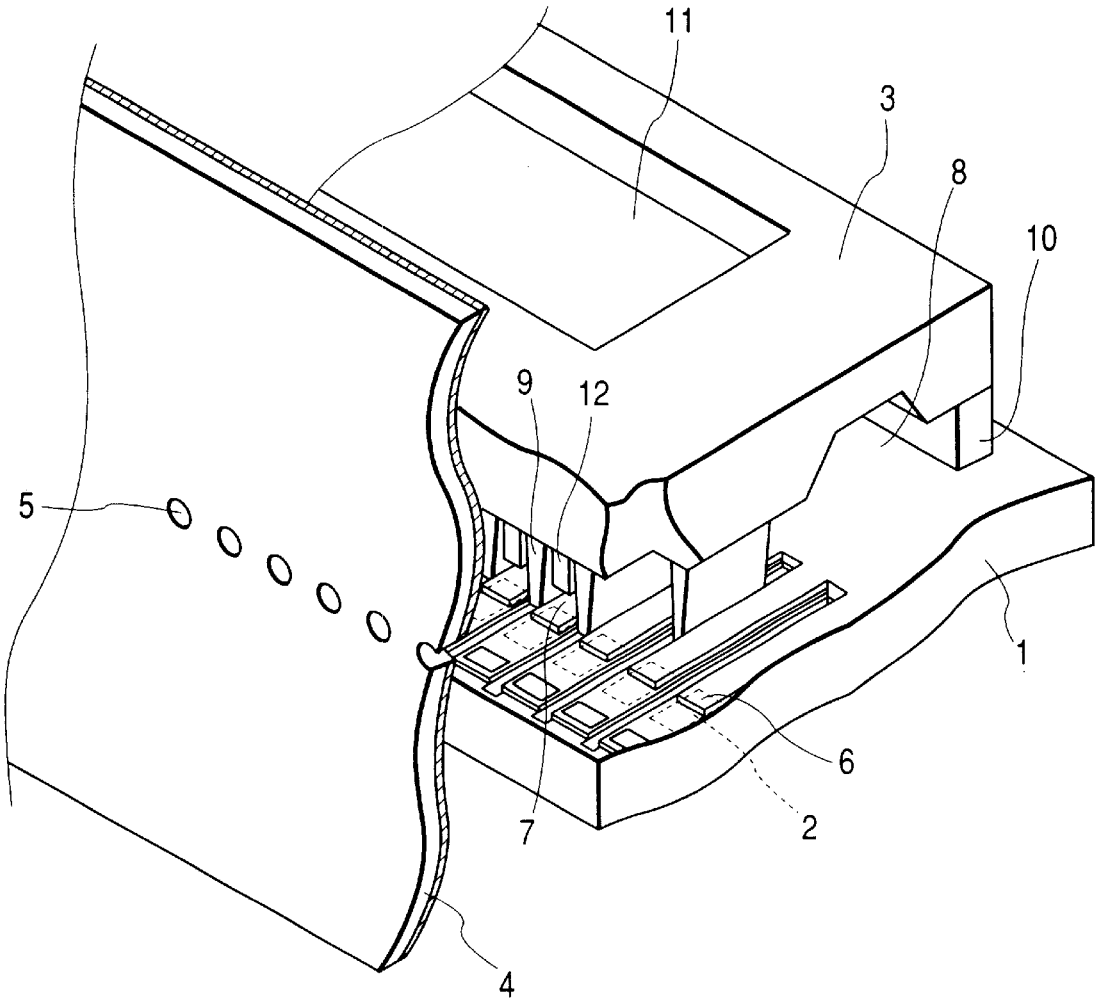
FIG. 7 is a perspective view, in partial section, of a general liquid discharge head to which the present invention can be applied.

FIG. 7 is a schematic perspective view, in partial section, showing a fundamental construction of a general liquid discharge head to which the present invention can be applied. The liquid discharge head includes an element substrate 1 on which heat generating members 2 for generating discharge energy are formed. A plurality of heat generating members 2 are formed on the element substrate 1 side by side, and aluminum wirings (not shown) for transmitting an electrical signal for selectively discharging liquid to the desired heat generating member 2 are provided on the element substrate. Further, on the element substrate 1, there are provided flow path walls 9 as side walls defining liquid flow paths 7 for directing the liquid above the respective heat generating members 2, and a liquid chamber wall 10 as a side wall defining a common liquid chamber 8 communicated with the liquid flow paths 7. Further, a movable member 6 for enhancing liquid discharging efficiency by directing pressure created by generation of a bubble at the heat generating member 2 is provided. The heat generating members 2, electrical wirings, flow path walls 9, liquid chamber wall 10 and movable member 6 are formed on the element substrate 1 made of silicon by means of a film forming technique.

Further, the liquid discharge head includes a top plate 3 having a recessed portion defining a ceiling of the common liquid chamber 8, an ink supply port 11 communicated with the common liquid chamber 8, and an upward displacement regulating portions (distal end regulating portions) 12 for regulating upward displacement of the movable member 6. The top plate 3 is joined to the flow path walls 9 and the liquid chamber wall 10 formed on the element substrate 1, with the result that the common liquid chamber 8 and plural liquid flow paths 7 communicated therewith are formed, and the upward displacement regulating portions 12 are disposed above and spaced apart from movable parts of the movable member 6 with a predetermined gap therebetween. Further, the liquid discharge head has an orifice plate 4 disposed at ends of the plural liquid flow paths 7 defined by the element substrate 1 and the top plate 3 opposite to the common liquid chamber 8 and having openings as discharge ports 5 for the liquid flow paths 7. The orifice plate 4 is adhered to the opening forming surface (for the liquid flow paths 7) of a laminated structure of the element substrate 1 and the top plate 3.

At the joining area between the element substrate 1 and the top plate 3, adhesive of epoxy group which is cured and contracted with B stage by UV illumination while maintaining a tacky property and is cured by heating is used. Such adhesive can be adhered only by heat and pressure. Further, as material of the orifice plate 4, desirably, a metallic film such as stainless steel or nickel, or a plastic film having excellent ink anti-corrosion ability, for example, a resin film such as polyimide, polysulfone, polyeter sulfone, polyphenylene oxide, polyphenylene sulfide or polypropylenen is used.

(First embodiment of construction of liquid discharge head)

Figure 1A:
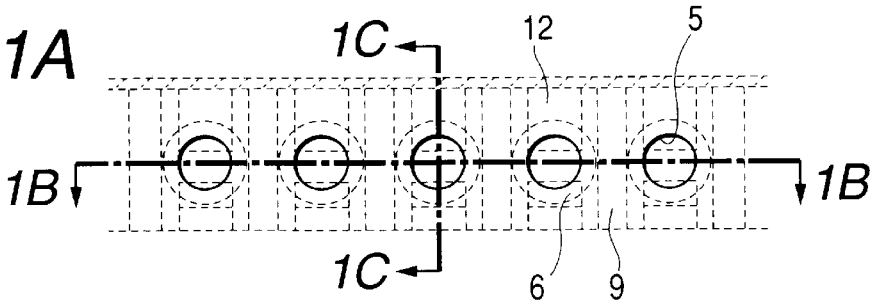
FIGS. 1A, 1B, 1C and 1D are schematic views showing a liquid discharge head according to a first embodiment of the present invention, where
Figure 1B:
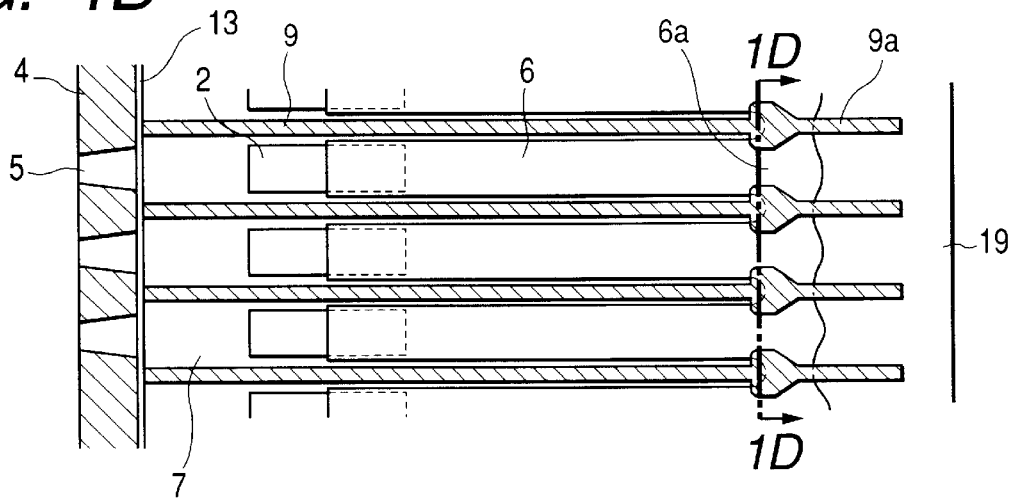
Figure 1C:
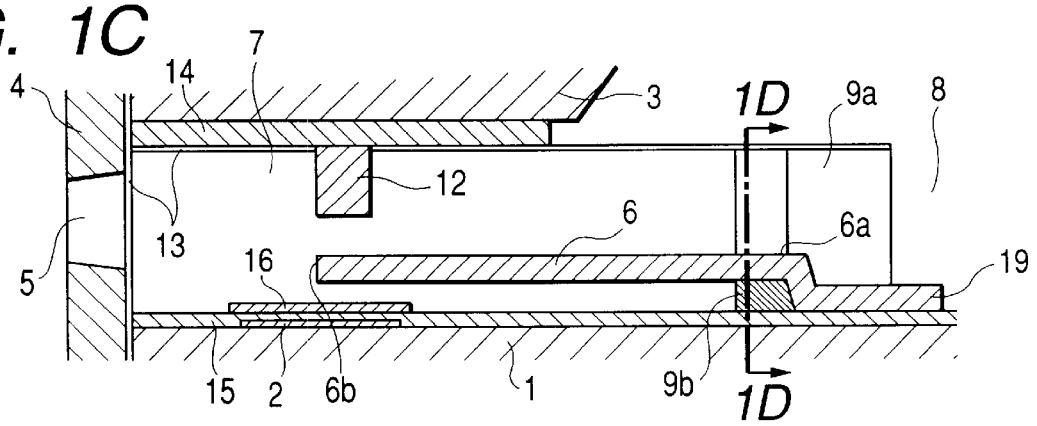
Figure 1D:
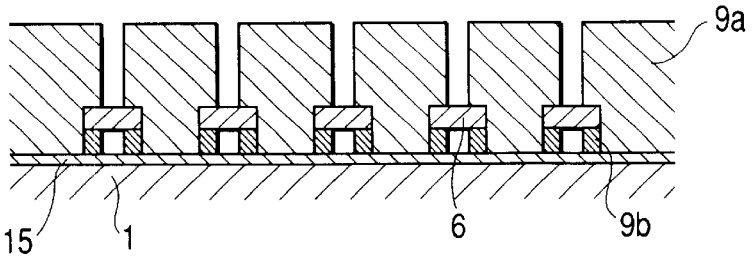
Figure 2A:
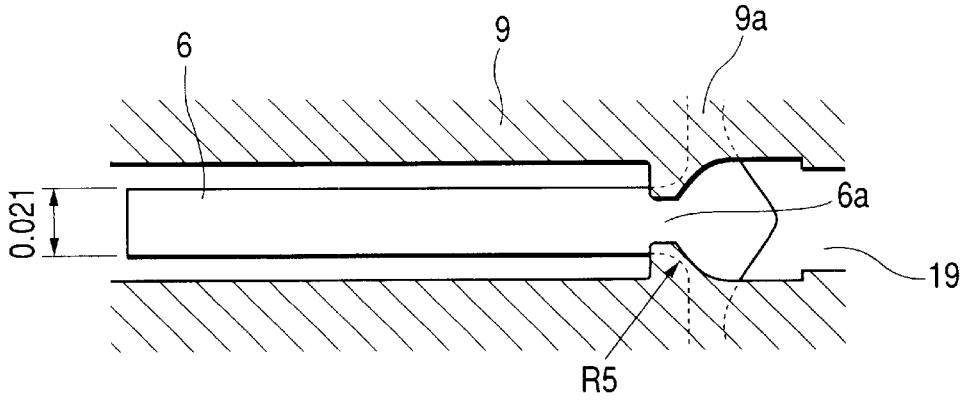
FIGS. 2A and 2B are views showing dimensions of main parts of the liquid discharge head shown in FIGS. 1A, 1B, 1C and 1D.
Figure 2B:
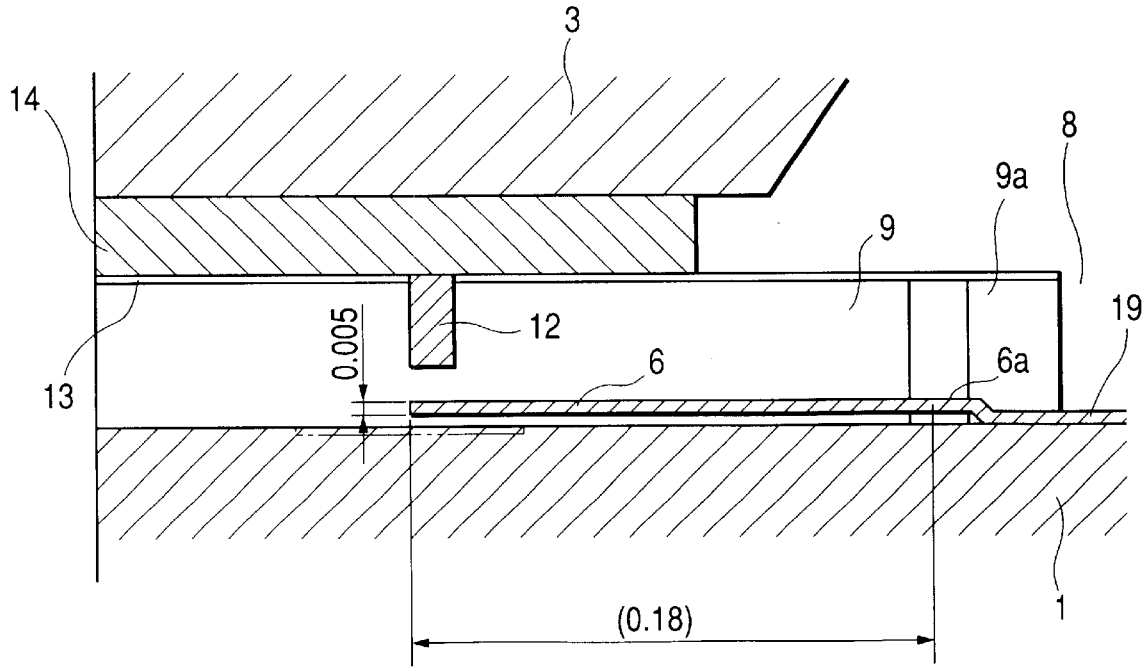
Figure 3A:
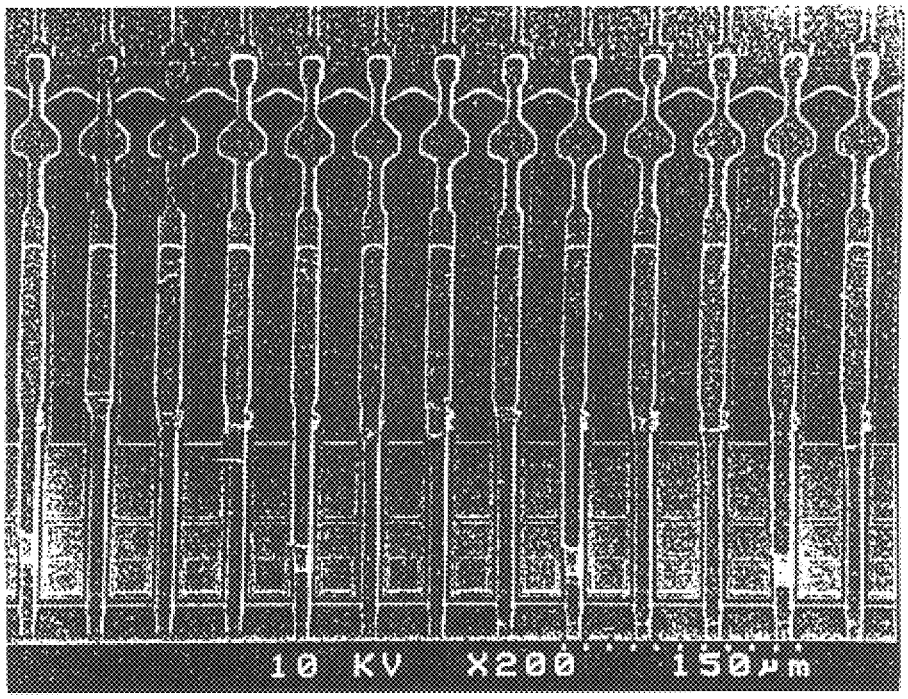
FIGS. 3A, 3B, 3C and 3D are views showing configuration of flow path walls of the liquid discharge head shown in FIGS. 1A, 1B, 1C and 1D in a condition that a top plate and an orifice plate are omitted, where
Figure 3B:
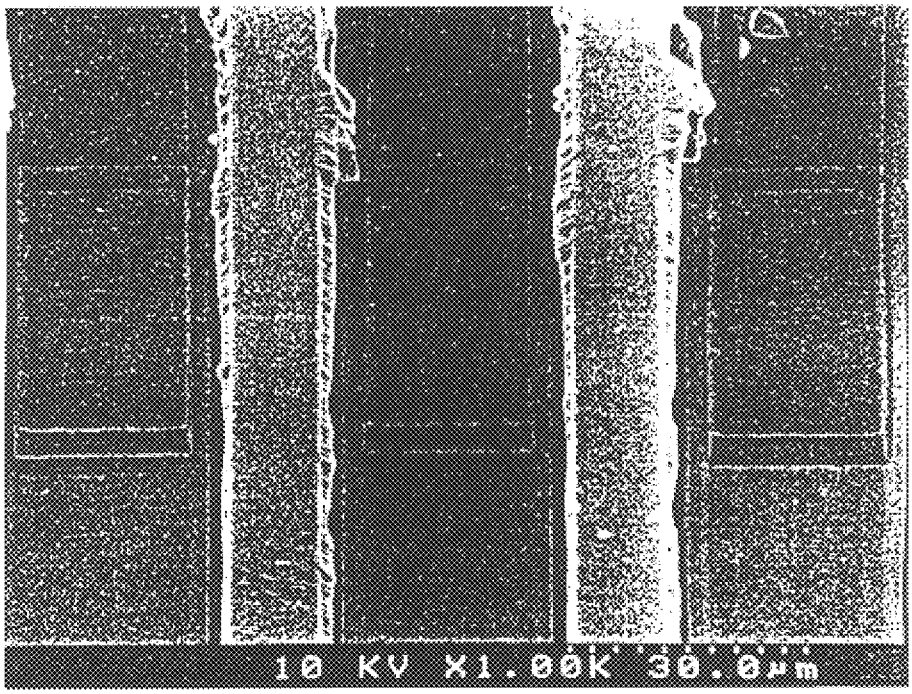
Figure 3C:
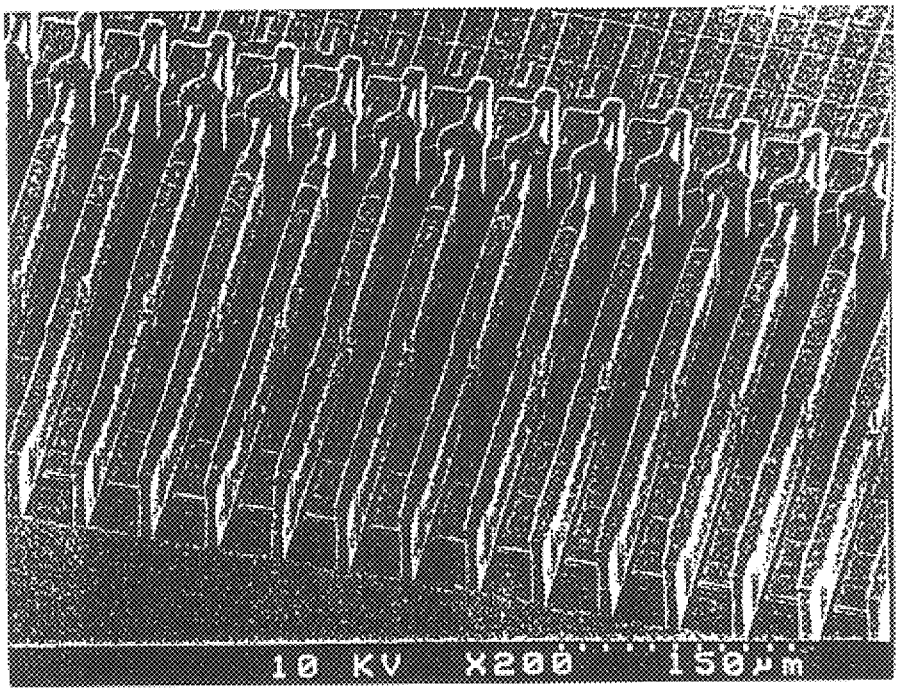
Figure 3D:
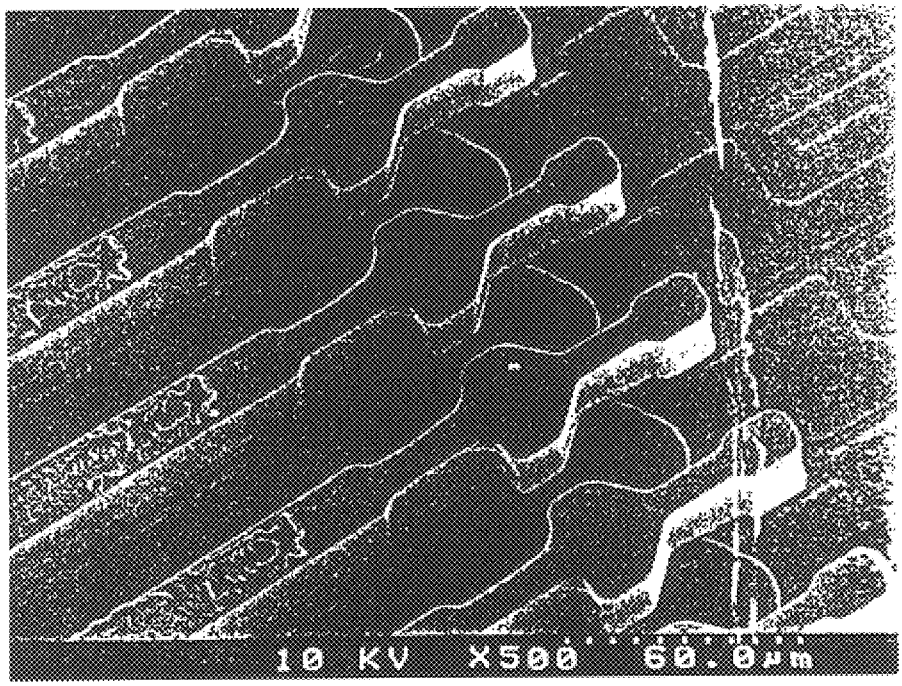

The liquid discharge head according to the embodiment is schematically shown in FIGS. 1A to 1D, 2A, 2B and 3A to 3D. FIG. 1A is a side view of the liquid discharge head looked at from a side of the discharge port 5, FIG. 1B is a sectional plan view taken along the line 1B—1B in FIG. 1A, FIG. 1C is a sectional view taken along the line 1C—1C in FIG. 1A, and FIG. 1D is a sectional view taken along the line 1D—1D in FIGS. 1B and 1C. FIGS. 2A and 2B show dimension of main parts of the liquid discharge head. FIGS. 3A to 3D are views showing configuration of flow path walls in a condition that the top plate 3 and the orifice plate 4 are omitted, where FIG. 3A is a plan view, FIG. 3B is an enlarged plan view, FIG. 3C is a perspective view and FIG. 3D is an enlarged perspective view. Incidentally, since the entire construction of the liquid discharge head according to the first embodiment is substantially the same as that of the general liquid discharge head shown in FIG. 7, the same elements are designated by the same reference numerals, and detailed explanation thereof will be omitted.

In the illustrated embodiment, a silicon oxide film or a silicon nitride film formed on the element substrate for the purpose of insulation and heat accumulation, and an electrical resistance layer and wiring electrodes are formed on the film to form heat generating members 2 (in FIGS. 1A to 1D, these are not fully illustrated, but only the heat generating members 2 are schematically shown). Further, a protection layer 15 for protecting the electrical resistance layer and wiring electrodes from the liquid and an anti-cavitation layer 16 for protecting them from cavitation due to disappearance of a bubble are formed thereon. These layers and electrical wirings are formed by a spattering method and a CVD method and are formed by patterning using a photolithography technique, if necessary. In the following explanation, the element substrate 1 may be referred to include such layers.

Further, the upward displacement regulating members (distal end regulating portions of the regulating portions) 12 are connected to the top plate 3 via an underground layer 14 formed on the lower surface of the top plate 3. The element substrate 1, top plate 3 and orifice plate 4 are joined together by an adhesive 13.

The movable member 6 is constituted by integrally forming a plurality of movable parts with an upstream base (fixed portion) 19 secured to the element substrate 1. The base 19 is connected to a common support portion at a downstream side and risen therefrom and branched as the movable parts, so that the movable parts are supported in a cantilever fashion to be spaced apart from the element substrate 1 and can be moved around a connection portion (fulcrum) 6*a* to the common support portion. The movable member 6 has a comb configuration including the plurality of movable parts extending from the base 19 through the connection portion 6 and branched to extend into the respective liquid flow paths. The root portions of the branched movable parts are diverged toward the base to gradually increase their widths. A downstream distal end of each branched movable part constitutes a free end 6*b*. The connection portion between the base 19 and the movable parts has a wave configuration looked at as a plan view, and apexes of waves looked at toward the upstream side coincide with center lines of the respective movable parts.

Each flow path wall 9 has a pressing portion (auxiliary member as a displacement regulating portion) 9*a* including a portion extending from a side of the movable part toward the upstream side to the base 19 of the movable member 6 and a portion enlarged in the vicinity of the root portion of the branched movable part to cover the side of the root portion. The pressing portion 9*a* not only extends above the movable member 6, but also extends, between the plural movable parts of the movable member 6, up to the element substrate 1 downwardly. And, in a gap 9*b* between the movable member 6 and the element substrate 1, the pressing portion is formed similar to that above the movable member 6.

The liquid discharge head according to the illustrated embodiment is characterized that the flow path wall 9 has the pressing portion 9*a*. That is to say, in the liquid discharge head according to the illustrated embodiment, by providing such pressing portions 9*a*, stress acting on stepped portions of the movable member 6 and the root portions of the branched movable parts (which are portions apt to be subjected to stress concentration during the displacement of the movable member 6 if such pressing portions 9*a* do not exist) can be dispersed into the pressing portions 9*a* abutting against these portions, thereby relaxing the stress. As a result, endurance of the movable member 6 can be enhanced and reliability of liquid discharging can be enhanced. Further, even if the adjacent movable parts of the movable member 6 are displaced simultaneously, stress affecting a great influence upon the endurance of the movable member 6 does not occur.

Incidentally, in the liquid discharge head according to the illustrated embodiment, the pressing portion 9*a* is also formed in the gap 9*b* between the movable member 6 and the element substrate 1. As such, it is preferable to provide the pressing portion 9*a* in the gap 9*b*, for the purpose of obtaining the action for relaxing the stress. However, from the viewpoint of manufacture, it may be difficult to form the pressing portion 9*a* in the gap 9*b*. In such a case, the pressing portion 9*a* may not be provided in the gap 9*b*. Even in such a case, since the pressing portions 9*a* abut against the upper surface of the movable member 6 and extend up to and abut against the element substrate 1 between the branched movable parts, the movable member 6 can be firmly supported thereby to relax the stress desirably.

Further, in the illustrated embodiment, while an example that the pressing portions 9*a* abut against the movable member 6 was explained, by arranging the pressing portions 9*a* in an opposed relationship to at least the common support portion, excessive displacement can be suppressed, and, thus, even if the pressing portions do not abut against the movable member, the stress on the movable member 6 can be relaxed.

(Second embodiment of construction of liquid discharge head)

Figure 4A:
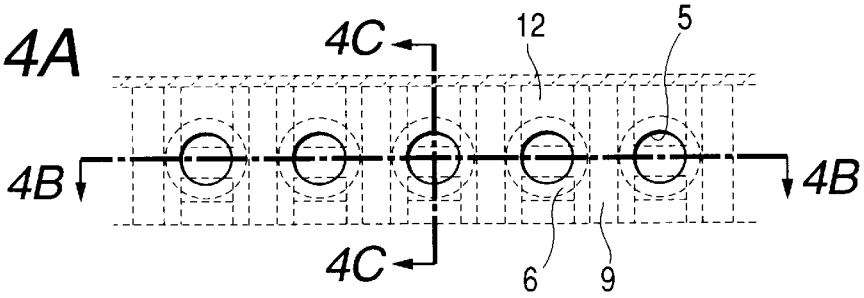
FIGS. 4A, 4B, 4C and 4D are schematic views showing an alteration of the liquid discharge head according to the first embodiment of the present invention, where
Figure 4B:
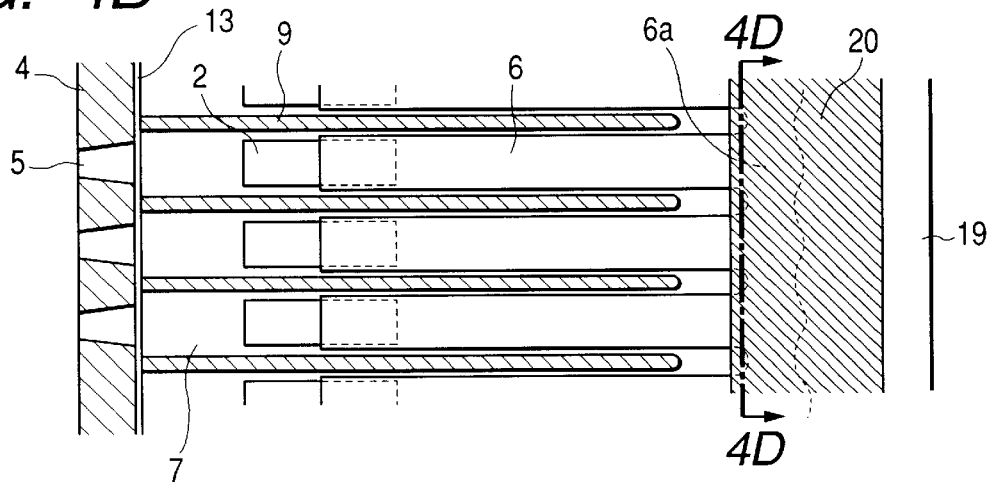
Figure 4C:
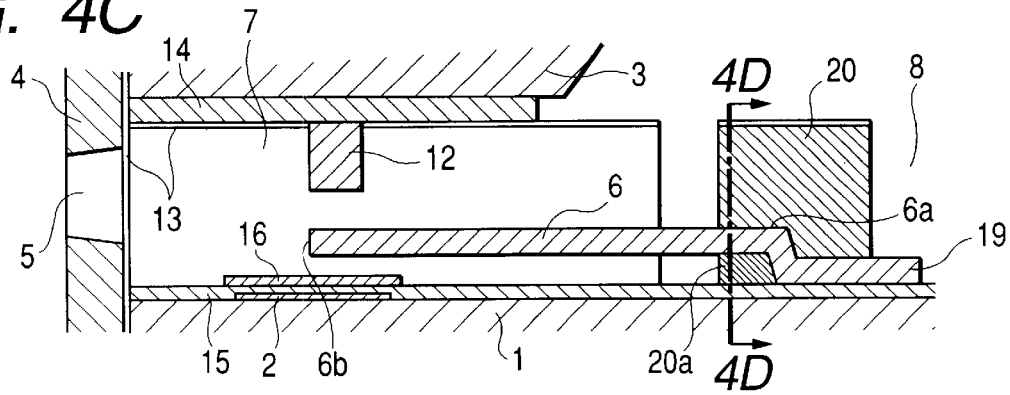
Figure 4D:
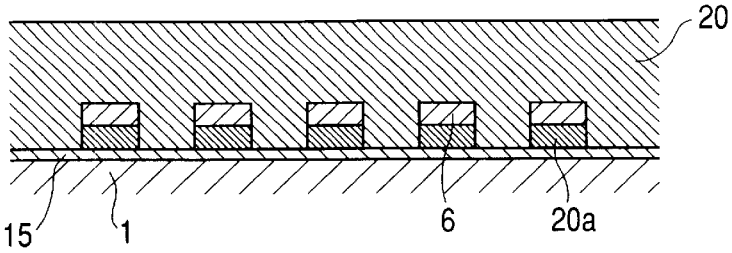
Figure 5A:
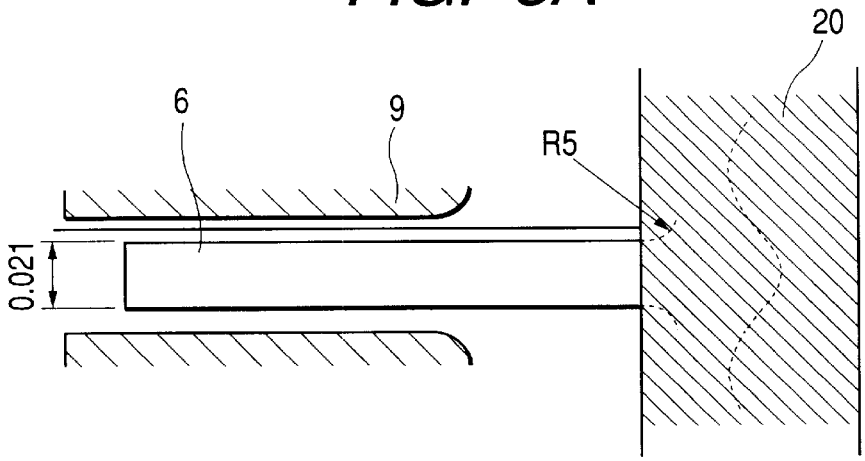
FIGS. 5A and 5B are views showing dimensions of main parts of the liquid discharge head shown in FIGS. 4A, 4B, 4C and 4D.
Figure 5B:
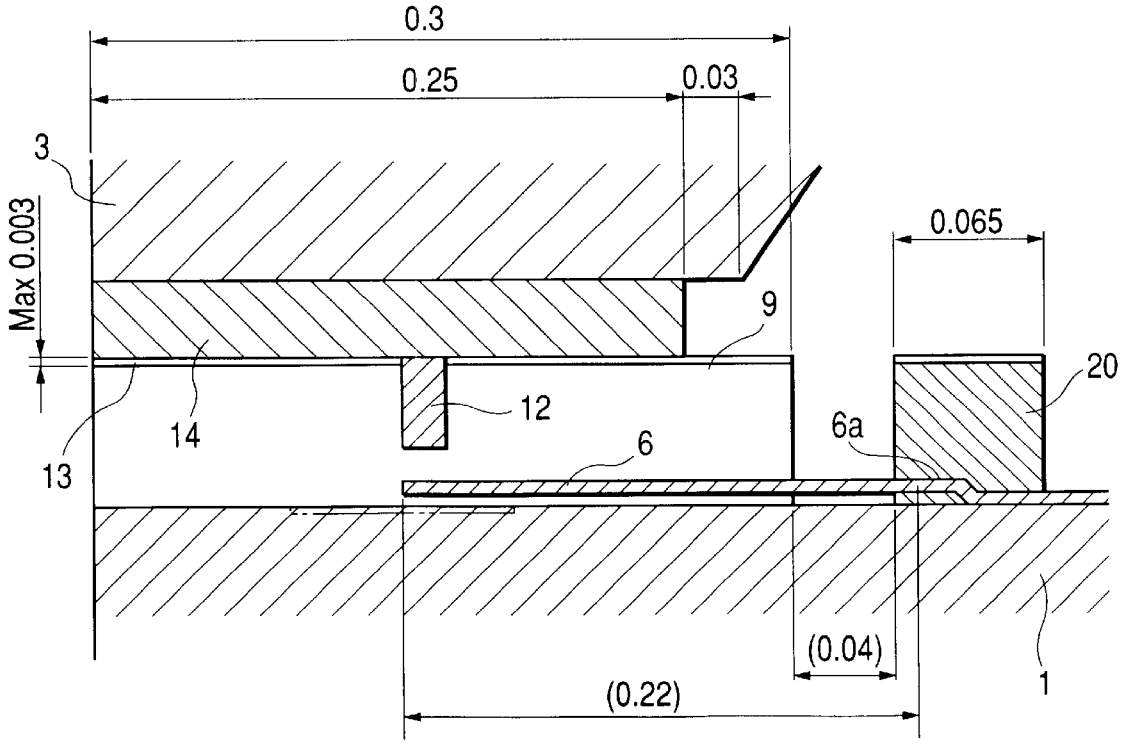
Figure 6A:
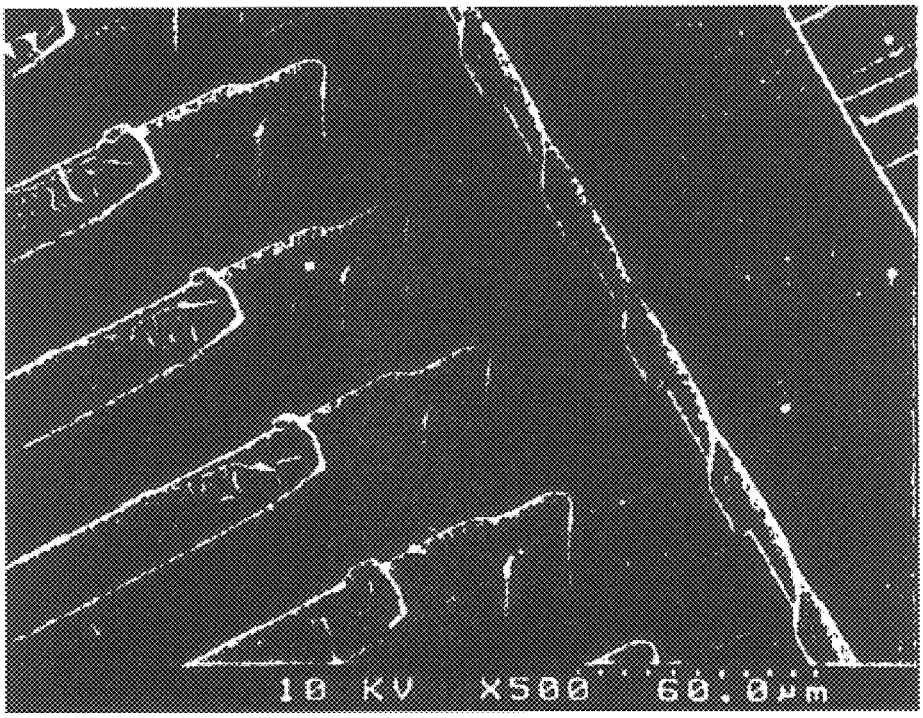
FIGS. 6A and 6B are views showing configuration of flow path walls of the liquid discharge head shown in FIGS. 4A, 4B, 4C and 4D in a condition that a top plate and an orifice plate are omitted.
Figure 6B:
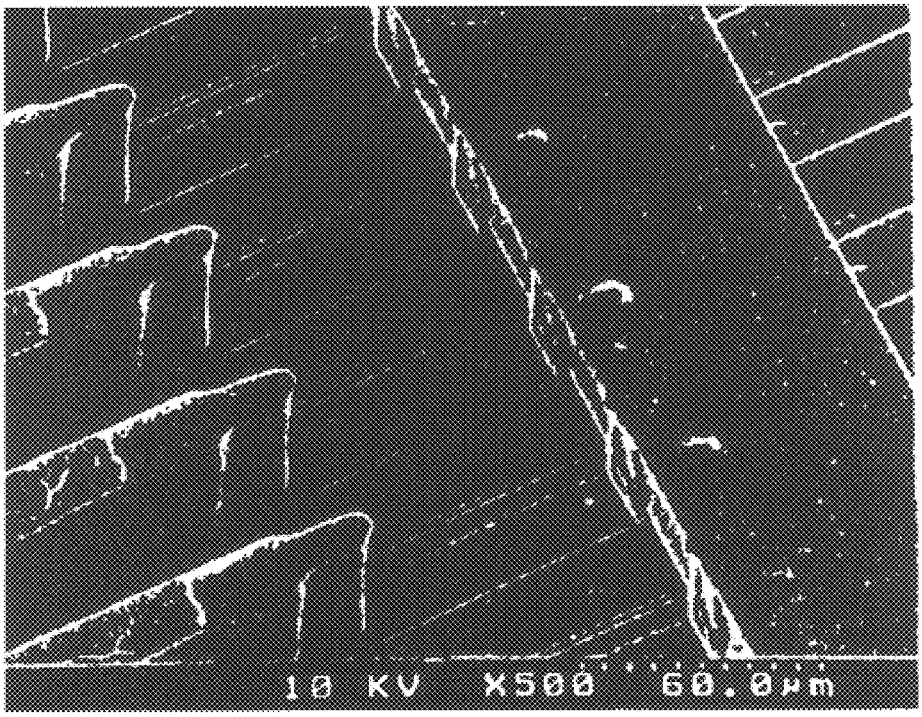

A second embodiment of a liquid discharge head is schematically shown in FIGS. 4A to 4D, 5A, 5B, 6A and 6B. FIG. 4A is a side view of the liquid discharge head, looked at from a side of the discharge port 5, FIG. 4B is a sectional plan view taken along the line 4B—4B in FIG. 4A, FIG. 4C is a sectional view taken along the line 4C—4C in FIG. 4A and FIG. 4D is a sectional view taken along the line 4D—4D in FIGS. 4B and 4C. FIGS. 5A and 5B are views showing dimensions of main parts of the liquid discharge head. FIGS. 6A and 6B are views showing configuration of flow path walls in a condition that the top plate 3 and the orifice plate 4 are omitted, where FIG. 6A shows a head in which a length of the movable member 6 (valve length) is 220 $\mu$m, and FIG. 6B shows a head in which the valve length is 250 $\mu$m. Incidentally, elements same as those in the first embodiment of the construction of the liquid discharge head are designated by the same reference numerals, and explanation will be omitted.

In this second embodiment, a pressing member (auxiliary member) 20 for covering the stepped portions of the movable member 6 and the root portions of the branched movable parts is provided as a discrete member separated from the flow path walls 9. The pressing member 20 extends in a direction along which the movable parts are arranged side by side, by a width covering the stepped portions of the movable member 6 and the root portions of the branched movable parts. The pressing member 20 extends downwardly up to the element substrate 1 between the plural movable parts of the movable member 6. And, in a gap 20*b* between the movable member 6 and the element substrate 1, the pressing member is formed similar (plane configuration) to that above the movable member 6.

In the liquid discharge head according to the illustrated embodiment, by providing such a pressing member 20, similar to the first embodiment of the construction of the liquid discharge head, the stress acting on the stepped portions of the movable member 6 and the root portions of the branched movable parts can be dispersed into the pressing member 20 abutting against these portions, thereby relaxing the stress. As a result, endurance of the movable member 6 can be enhanced and reliability of liquid discharging can be enhanced. Further, in the liquid discharge head according to the illustrated embodiment, since the pressing member 20 extends in the direction along which the plural branched movable parts are arranged side by side, the stress acting on the movable parts can be dispersed in such side-by-side direction to relax the stress uniformly between the movable parts, thereby increasing margin regarding the endurance of each branched part.

Incidentally, in the liquid discharge head according to the illustrated embodiment, the pressing portion 20 is also formed in the gap 20*a* between the movable member 6 and the element substrate 1. As such, it is preferable to provide the pressing portion 20 in the gap 20*a*, for the purpose of obtaining the action for relaxing the stress. However, similar to the first embodiment of the construction of the liquid discharge head, the pressing portion 20 may not be provided in the gap 20*a*. Even in such a case, since the pressing portion 20 abut against the upper surface of the movable member 6 and extends up to and abuts against the element substrate 1 between the branched movable parts to provide a bridge structure straddling the root portions of the movable parts, the movable member 6 can be firmly supported thereby to relax the stress desirably.

Further, in the illustrated embodiment, while an example that the pressing portion 20 abuts against the movable member 6 was explained, by arranging the pressing portion 20 in an opposed relationship to at least the common support portion, excessive displacement of the common support portion can be suppressed, and, thus, even if the pressing portion does not abut against the movable member, the stress on the movable member 6 can be relaxed.

(Method for manufacturing liquid discharge head)

Next, a method for manufacturing the liquid discharge head according to the present invention will be explained. Incidentally, in an embodiment of the liquid discharge head manufacturing method described hereinbelow, while a method for manufacturing the liquid discharge head having the second embodiment of construction will be explained, the manufacturing method according to the present invention can similarly manufacture the liquid discharge head having the first embodiment of construction.

(First embodiment of liquid discharge head manufacturing method)

FIGS. 8A to 8J and FIGS. 9F to 9M are views for explaining a first embodiment of a liquid discharge head manufacturing method of the present invention. FIGS. 8A to 8E and FIGS. 9F to 9I are sectional views taken along a direction perpendicular to a direction along which the liquid flow path 7 extends, and FIGS. 8F to 8J and FIGS. 9J to 9M are sectional views taken along the direction of the liquid flow path 7. Through steps shown in from FIGS. 8A and 8F to FIGS. 9I and 9M, the movable member 6, flow path walls 9 and pressing member 20 are formed on the element substrate 1.

Figure 8A:
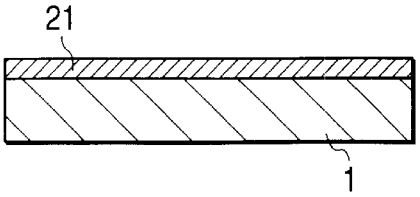
FIGS. 8A, 8B, 8C, 8D, 8E, 8F, 8G, 8H, 8I and 8J are sectional views for explaining steps of a manufacturing method according to a first embodiment for manufacturing the liquid discharge head according to the first embodiment of the present invention.
Figure 8B:
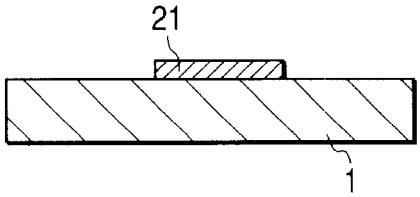
Figure 8C:
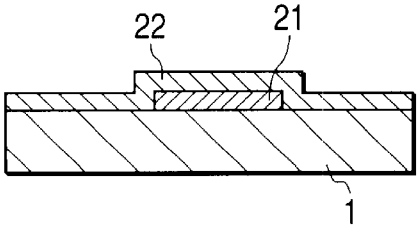
Figure 8D:
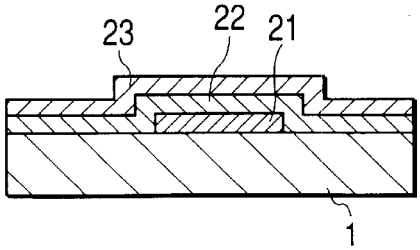
Figure 8E:
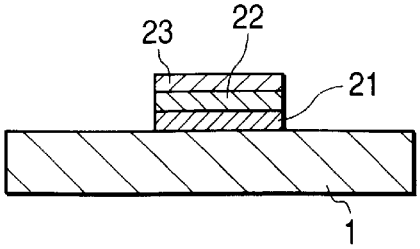
Figure 8F:
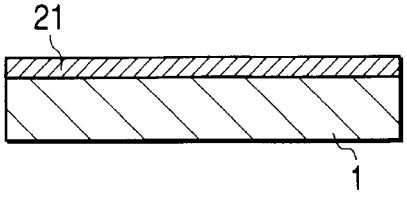

First of all, as shown in FIGS. 8A and 8F, a PSG (phospho silicate glass) film as a sacrifice layer 21 is formed on the whole surface of the element substrate 1 on which the heat generating member 2 to be positioned by a CVD method under a condition of temperature of 350° C. A film thickness of the sacrifice layer 21 corresponds to the dimension of the gap between the movable member 6 and the heat generating member 2 in FIGS. 4A to 4D and is preferably 1 to 20 $\mu$m and more preferably 1 to 10 $\mu$m. By doing this, due to good balance of the entire liquid flow paths 7 in the liquid discharge head, the effect of the movable member 6 becomes noticeable. Then, in order to effect patterning of the sacrifice layer 21, after resist is coated on the surface of the sacrifice layer 21 by spin coating, exposing and developing are effected on the basis of a photolithography technique to remove the resist from an area corresponding a portion where the movable member 6 is secured.

Figure 8G:
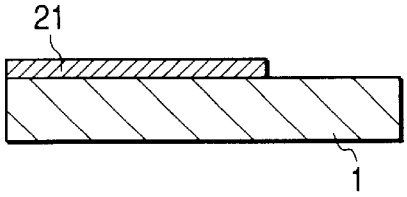

Then, as shown in FIG. 8B and FIG. 8G, a portion of the sacrifice layer 21 which is not covered by the resist is removed by wet etching using buffered fluoroacid. Thereafter, the resist remaining on the surface of the sacrifice layer 21 is removed by plasma etching using oxygen plasma or by immersing the element substrate 1 into resist removing agent. As a result, parts of the PSG film 21 are remained on the surface of the element substrate 1, and such remaining parts constitute mold members corresponding to the bubble generating areas 10. Through such steps, the mold members corresponding to the spaces of the bubble generating areas 10 are formed on the surface of the element substrate 1.

Figure 8H:
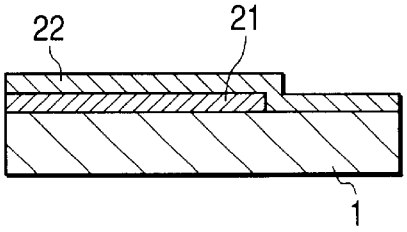

Then, as shown in FIG. 8C and FIG. 8H, a SiN film 22 having a thickness of 1 to 10 $\mu$m is formed on the surfaces of the element substrate 1 and the sacrifice layer 21 by a plasma CVD method using material of ammonia and silane gas under a condition of temperature of 400° C. A part of the SiN film 22 will constitute the movable member 6. As composition of the SiN film 22, although it is considered that $Si_3N_4$ is best, in order to obtain the effective function of the movable member 6, a ratio between Si and N may be 1:1 to 1.5. Such SiN film is generally used in a semiconductor process and has alkali resistance, chemical stability and ink resistance. Since the part of the SiN film 22 constitutes the movable member 6, so long as material of the film has structure and composition suitable for obtaining optimum physical property of the movable member 6, a method for manufacturing the film is not limited. For example, as a method for manufacturing the SiN film 22, in pace of the above-mentioned plasma CVD method, an atmospheric CVD method, an LPCVD method, a bias ECRCVD method, a microwave CVD method, a spattering method or a painting method may be used. Further, regarding the SiN film, in order to enhance its physical property such as stress, rigidity and/or Young's modulus or chemical property such as alkali resistance and/or acid resistance in accordance with its application, the SiN film may be constituted as a multi-layer structure by changing composition ratio steppingly. Alternatively, the SiN film may be constituted as a multi-layer structure by adding impurity steppingly or may be formed by adding impurity in a single layer.

Figure 8I:
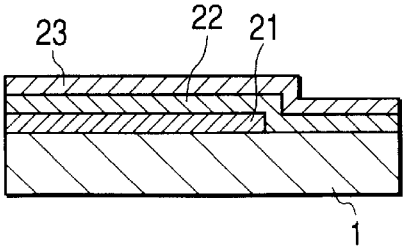

Then, as shown in FIG. 8D and FIG. 8I, an Al (aluminum) film having a thickness of 2 $\mu$m as an anti-etching protection layer 23 is formed on the surface of the SiN film 22. In order to give a predetermined configuration to the anti-etching protection layer 23, resist is coated on the surface of the anti-etching protection layer 23 by spin coating, and patterning is effected by means of photolithography.

Figure 8J:
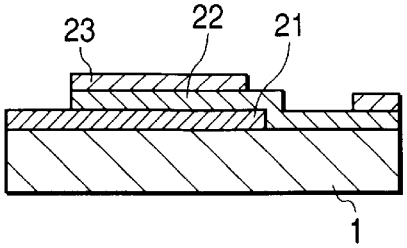

Thereafter, in FIGS. 8E and FIG. 8J, the SiN film 22 and the anti-etching protection layer 23 are subjected to etching by dry etching using $CF_4$ gas or reactive ion etching to give the configuration of the movable member 6 to the SiN film 22 and the anti-etching protection layer 23. In this way, the movable member 6 is formed on the element substrate 1. In this example, while the anti-etching protection layer 23 and the SiN film 22 were subjected to the patterning simultaneously, only the anti-etching protection layer 23 may be patterned to the configuration of the movable member 6, and, in the later process, the SiN film 22 may be patterned. Further, regarding the portion where the pressing member 20 is formed, only the anti-etching protection layer 23 is subjected to etching.

Figure 9F:
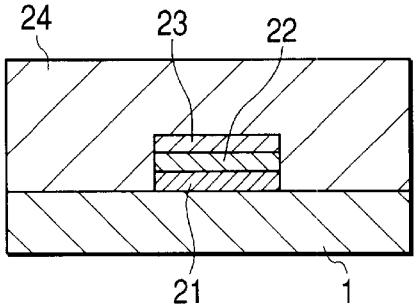
FIGS. 9F, 9G, 9H, 9I, 9J, 9K, 9L and 9M are sectional views for explaining steps following to the steps shown in FIGS. 8A, 8B, 8C, 8D, 8E, 8F, 8G, 8H, 8I and 8J.
Figure 9J:
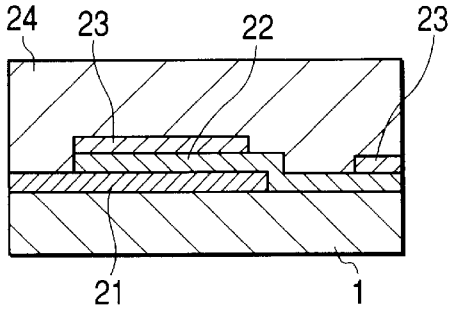

Then, in FIG. 9F and FIG. 9J, an SiN film 24 having a thickness of 20 to 40 $\mu$m is formed on the surfaces of the anti-etching protection layer 23 and the element substrate 1. When it is desired that the SiN film 24 be formed at a high speed, a microwave CVD method is used. The SiN film 24 ultimately constitutes the flow path walls 9 and the pressing member 20. The SiN film 24 is not depended upon film properties normally requested in the semiconductor manufacturing process (for example, pinhole density and minuteness of film). So long as the SiN film 24 satisfies ink resistance property and mechanical strength for the flow path walls 9 and the pressing member 20, even if the pinhole density of the SiN film 24 is increased more or less, there is no problem.

Further, here, while the SiN film was used, the material for the flow path walls 9 and the pressing member 20 is not limited to the SiN film, so long as the required ink resistance property and mechanical strength are satisfied, SiN film including impurity or SiN film having different composition may be used, and, further, an inorganic film such as a diamond film, a hydrogenation amorphous carbon film (diamond-like carbon film), a film of alumina group or a film of zirconia group may be used.

Figure 9G:
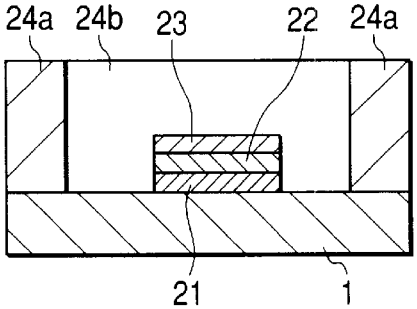
Figure 9K:
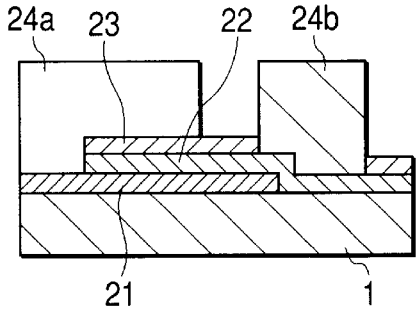

Then, in order to give a predetermined configuration to the SiN film 24, resist is coated on the surface of the SiN film 24 by spin coating, and patterning is effected by photolithography. Thereafter, dry etching using $CF_4$ gas or reactive ion etching is effected to change the SiN film 24 into portions 24*a* constituting the flow path walls 9 and a portion 24*b* constituting the pressing member 20, as shown in FIG. 9G and FIG. 9K. Alternatively, attaching importance to higher speed etching, an ICP (induction coupled plasma) etching method is most suitable for the etching of the thick SiN film 24. Through such steps, the flow path walls 9 and the pressing member 20 are formed on the element substrate 1.

In this case, in the illustrated embodiment, the anti-etching protection layer 23 formed on the SiN film 22 in the previous step serves to prevent damage of the SiN film 22 constituting the movable member 6 when the etching is effected to form the flow path walls 9 and the pressing member 20. That is to say, in the illustrated embodiment, since the movable member 6, the flow path walls 9 and the pressing member 20 are formed from substantially the same material, although the etching for forming the flow path walls 9 and the pressing member 20 may also etch the movable member 20, since the anti-etching protection layer 23 is formed on the SiN film 22 on the element substrate 1, the damage of the movable member 6 due to the etching can be prevented.

After the SIN film 24 is etched, the resist remaining on the SiN film 24 is removed by plasma ashing using oxygen plasma or by immersing the element substrate 1 into resist removing agent.

Figure 9H:
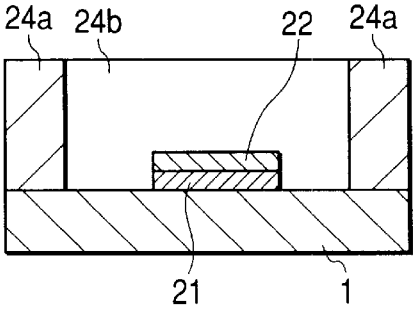
Figure 9L:
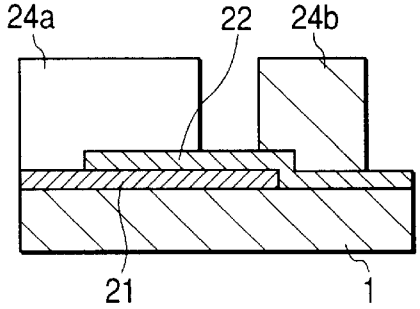

Then, as shown in FIG. 9H and FIG. 9L, the anti-etching protection layer 23 formed on the SiN film 22 is removed by wet etching or dry etching. Here, the removing method is not limited to the etching, but, so long as only the anti-etching protection layer 23 can be removed, any method may be used. Alternatively, if the anti-etching protection layer 23 does not affect a bad influence upon the property of the movable member 6 and is formed from a Ta film having high ink resistance, the protection film may not be removed.

Figure 9I:
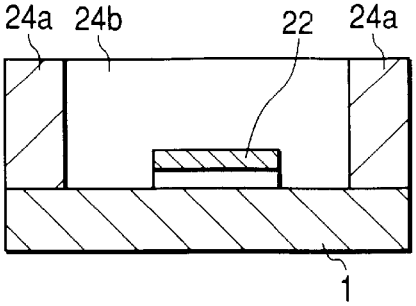
Figure 9M:
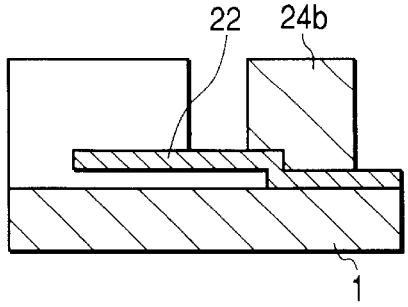

Then, as shown in FIGS. 9I and 9M, the sacrifice layer 21 underlying the SiN film 22 is removed by buffered fluoro-acid. By performing the above-mentioned steps, the flow path walls 9, the movable member 6, and the pressing member 20 constituting a characteristic part of the present invention can be formed on the element substrate 1.

Then, the top plate 3 is manufactured in the following manner by using an Si substrate (110) in which crystal orientation is directed toward an adhering plane.

First of all, a heat oxidation film is formed on the Si substrate (110). Then, the heat oxidation film is subjected to patterning by using a photolithography technique. By utilizing the patterned heat oxidation film as a mask, anisotropy etching is performed by using TMAH-22 (manufactured by Kanto Chemistry Co., Ltd.; trade name) under a condition of temperature of 80° C. In this way, the ink supply port 11 and the recessed portion defining the common liquid chamber 8 are formed simultaneously by the anisotropy etching.

Then, the underground layer 14 for the upward displacement regulating members 12 is patterned on a surface of the top plate 3 which is to be adhered to the element substrate 1, by utilizing SY327 (trade name) manufactured by Tokyo Ohka Co., Ltd. Thereafter, the upper displacement regulating members 12 are similarly formed with negative resist.

Then, B stage is obtained by UV illumination while maintaining the tacky property, and the adhesive 13 of epoxy group which can be adhered by heat and pressure is transferred to the flow path walls 9, and the top plate is adhered thereon. Thereafter, the adhesive 13 is transferred onto the opening (for the liquid flow paths 7) forming surface of the laminate structure comprised of the element substrate 1 and the top plate 3, and the orifice plate 4 in which the discharge ports 5 are formed with a pitch corresponding to the pitch of the flow paths 7 is joined to the opening forming surface of the laminate structure.

In this way, the liquid discharge head can be manufactured.

(Second embodiment of liquid discharge head manufacturing method)

FIGS. 10A to 10J and FIGS. 11F to 11M are views for explaining a second embodiment of a liquid discharge head manufacturing method of the present invention. FIGS. 10A to 10E and FIGS. 11F to 11I are sectional views taken along a direction perpendicular to a direction along which the liquid flow path 7 extends, and FIGS. 10F to 10J and FIGS. 11J to 11M are sectional views taken along the direction of the liquid flow path 7. Through steps shown in from FIGS. 10A and 10F to FIGS. 11I and 11M, the movable member 6, flow path walls 9 and pressing member 20 are formed on the element substrate 1.

Figure 10A:
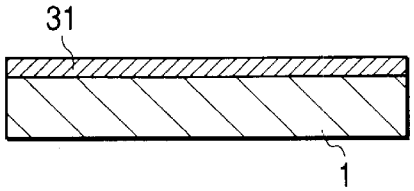
FIGS. 10A, 10B, 10C, 10D, 10E, 10F, 10G, 10H, 10I and 10J are sectional views for explaining steps of a manufacturing method according to a second embodiment for manufacturing the liquid discharge head according to the first embodiment of the present invention.
Figure 10B:
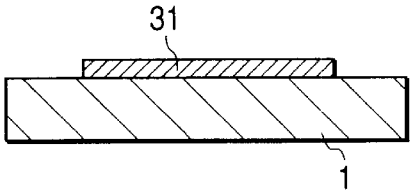
Figure 10C:
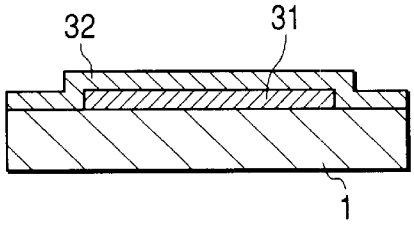
Figure 10D:
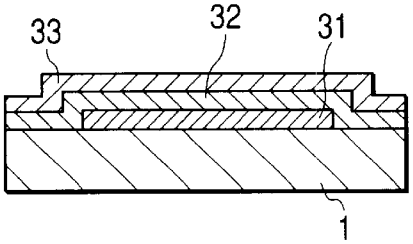
Figure 10E:
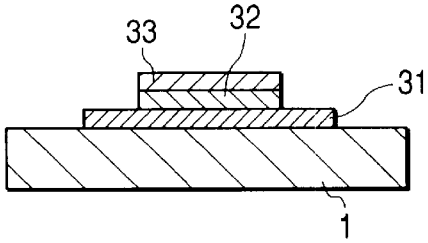
Figure 10F:
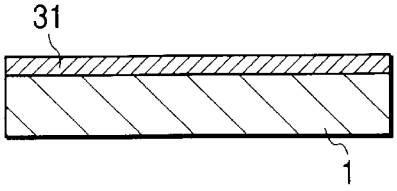

First of all, as shown in FIGS. 10A and 10F, an aluminum film as a sacrifice layer 31 is formed on the whole surface of the element substrate 1 on which the heat generating member 2 to be positioned by a spattering method. Similar to the first embodiment of the liquid discharge head manufacturing method, a film thickness of the aluminum film is preferably 1 to 20 μm and more preferably 1 to 10 μm.

Figure 10G:
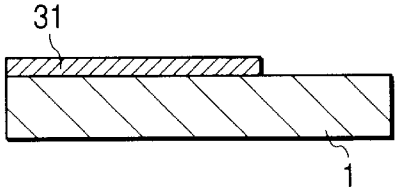

Then, as shown in FIG. 10B and FIG. 10G, a portion of the sacrifice layer 31 which corresponds to the base of the movable member 6 is removed by patterning by utilizing a well-known photolithography process.

Figure 10H:
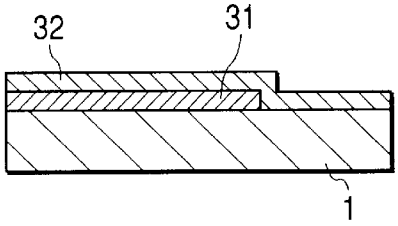

Then, as shown in FIG. 10C and FIG. 10H, a SiN film 32 having a thickness of 1 to 10 μm is formed on the surfaces of the element substrate 1 and the sacrifice layer 31.

Figure 10I:
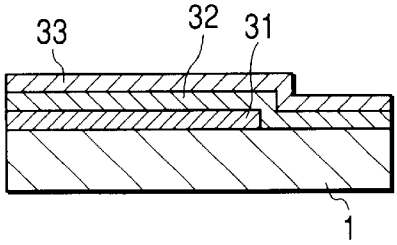

Then, as shown in FIG. 10D and FIG. 10I, an Al (aluminum) film having a thickness of 6100 Å as an anti-etching protection layer 33 is formed on the surface of the SiN film 22.

Figure 10J:
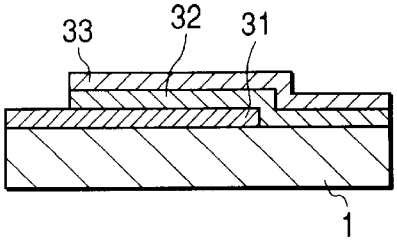

Then, the anti-etching protection layer 33 is patterned by using a well-known photolithography process to remain or leave only a portion of the SiN film 32 corresponding to the movable member 6. Thereafter, as shown in FIG. 10E and FIG. 10J, the SiN film 32 is patterned by using an etching device utilizing induction coupled plasma with using the anti-etching protection layer 33 as a mask, so that the movable member 6 is formed by the remained portion of the SiN film 32.

Figure 11F:
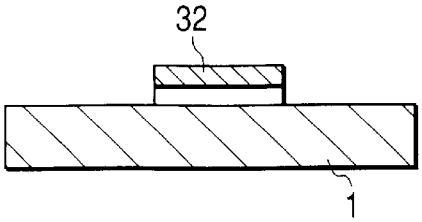
FIGS. 11F, 11G, 11H, 11I, 11J, 11K, 11L and 11M are sectional views for explaining steps following to the steps shown in FIGS. 10A, 10B, 10C, 10D, 10E, 10F, 10G, 10H, 10I and 10J.
Figure 11J:
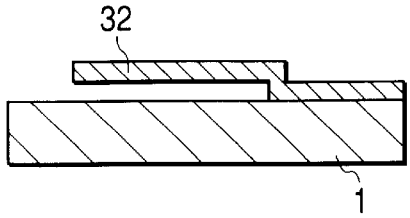

Then, as shown in FIG. 11F and FIG. 11J, the anti-etching protection layer 33 and the sacrifice layer 31 remaining on the movable member 6 are solved and removed by using mixed acid comprised of acetic acid, phosphoric acid and nitric acid, thereby forming the movable member 6 on the element substrate 1.

Figure 11G:
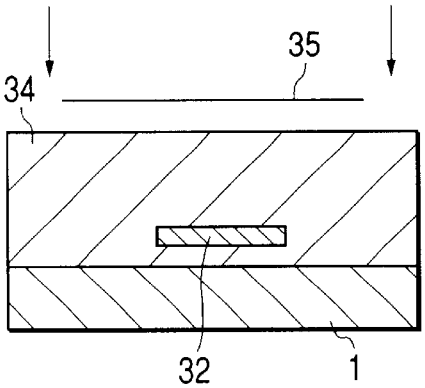
Figure 11K:
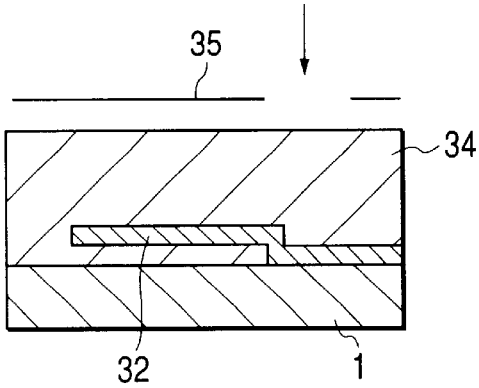

Then, as shown in FIG. 11G and FIG. 11K, NANO XP SU-8 (trade name) which is negative type photosensitive epoxy resin 34 and which is manufactured by Micro Chemical Compo Inc. is coated on the element substrate 1 on which the movable member 6 was formed as mentioned above, by spin coating with a thickness of 50 μm.

Now, the photosensitive epoxy resin 34 will be described. As material for the flow path walls 9, photosensitive resin is preferable because it can easily from the liquid flow paths 7 with high accuracy by utilizing photolithography. Regarding such photosensitive resin, high mechanical strength as structural material, good adhesion to the element substrate 1 and ink resistance are requested, and, at the same time, high resolving power for patterning the minute pattern for the liquid flow paths 7 with high aspect is also requested. After elaborate investigation, the inventors found that cationic polymerization cured substance of epoxy resin has excellent strength, adhesion and ink resistance as the structural material, and, also has excellent patterning property when the epoxy resin is a solid form in a room temperature. When the epoxy resin which is a solid form in the room temperature is used, in coating, the resin is solved in a solvent to provide a liquid form.

First of all, since the cationic polymerization cured substance of epoxy resin has high bridge density (high Tg) in comparison with normal acid anhydride or amine cured substances, it has excellent properties as the structural material.

Further, by using the epoxy resin which is a solid form in the room temperature, dispersion of polymerization starter generated from cation polymerization starting agent by light illumination into the epoxy resin can be suppressed, thereby obtaining excellent patterning accuracy and patterning configuration.

When a cantilever valve member such as the movable member 6 is provided on the surface, if resin having high viscosity tries to be coated by spin coating, as the resin is diffused, the valve member may be flexed or bent. However, since the above-mentioned material used as the negative type photosensitive epoxy resin 34 in the illustrated embodiment has relatively low viscosity, when it is coated by spin coating, the valve member is not flexed or bent, and, the resin can effectively flow in the gap between the element substrate 1 and the movable member 6.

Further, the inventors found that, in order to prevent deformation of the movable member 6 and to make the coating surface of the photo-curable resin smooth, material having sufficient solid component and capable of being easily flattened (levelling) in the coating process, and more specifically, material including solid component of 50% or more is preferable as the n\material for the above-mentioned photo-curable resin. Further, it was found that, in order to permit the coating by means of the spin coating, it is preferable that molecular weight of resin is small, and more specifically, average molecular weight of resin is smaller than 10000.

Incidentally, in the spin coating process, since the excessive resin coating material (photo-curable resin) cannot be well spread due to air resistance therearound, there is the tendency that periphery of a wafer is risen. As the film thickness of the coating is increased, a problem regarding accuracy becomes severe. To avoid this, in the illustrated embodiment, by dropping out mixed liquid comprised of acetone and IPA (isopropyl alcohol) and capable of solving the resin coating material onto the periphery of the wafer (side rinsing process), uniformity of the thickness of the resin coating film on the wafer can be enhanced.

Then, after pre-bake of the photosensitive epoxy resin 34 is effected by using a hot plate under a condition of temperature of 90° C. for five minutes, the photosensitive epoxy resin 34 is exposed to a predetermined pattern with an exposure light amount of 2 ($J/cm^2$) by using an exposing device (MPA600; trade name).

Figure 11H:
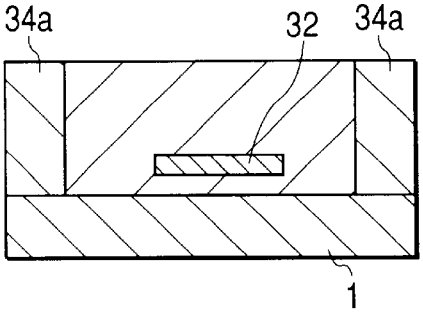
Figure 11L:
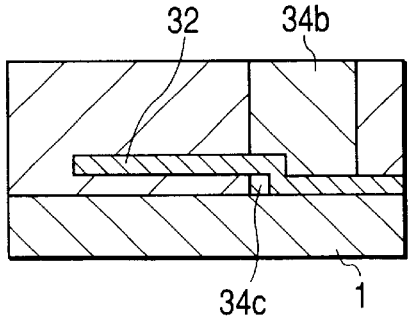

In the photo-curable resin as the negative type photosensitive resin, the exposed portion is cured and the non-exposed portion is not cured. Thus, in the exposing process, by using a mask 35, only areas where the flow path walls 9 are to be formed and only an area where the pressing member 20 is formed are exposed, and the other areas are not exposed. As a result, as shown in FIG. 11H and FIG. 11L, only the portions 34*a* corresponding to the flow path walls 9 and the portion 34*b* corresponding to the pressing member 20 are cured. In this case, since the SiN film 32 is used in the portion corresponding to the movable member 6 and since the SiN is transparent material having a property capable of permeating light, portions 34*c* positioned between the SiN film 32 and the element substrate 1 and forming the pressing member 20 in the gaps 20*a* are exposed and cured. The fact that the portions 34*c* are also cured is preferable in the point that the stress acting on the root portions of the movable member 6 can be relaxed more effectively by providing the pressing member 20 in the gaps 20*a*. However, material other than SiN can be used for the layer constituting the movable member 6, and, if opaque material is used, the portions 34*a* are not exposed and not cured, but, also in this case, as mentioned above, the stress can be relaxed by the other portions of the pressing member 20.

Figure 11I:
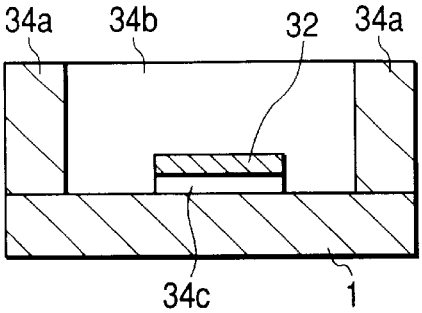
Figure 11M:
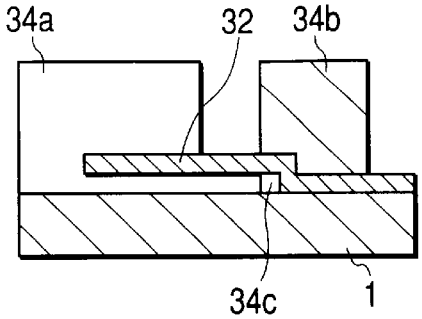

Then, PEB of the photosensitive epoxy resin 100 is effected by using the hot plate under a condition of temperature of 90° C. for five minutes again, and etching is effected by using propylene glycol 1—monomethyl ether acetate (manufactured by Kishida Chemical Co., Ltd.) as developing liquid. As a result, as shown in FIG. 11I and FIG. 11M, the uncured portions can be removed easily and effectively. Then, main baking is effected under a condition of temperature of 200° C. for one hour. In the process (main baking process) for effecting the levelling of the resin after the photo-curing, by effecting the baking under a temperature greater than a melting point (90° C. in the above resin) of the resin to achieve levelling flow, accuracy of the levelling can be enhanced effectively.

Through the above-mentioned steps or processes, the flow path walls 9, the movable member 6, and the pressing member 20 which is a characteristic part of the present invention can be formed on the element substrate 1. In the illustrated embodiment, the pressing member 20 can be formed also in the gaps 20*a*.

Then, similar to the first embodiment of the liquid discharge head manufacturing method, the top plate 3 and the orifice plate 4 can be joined to manufacture the liquid discharge head.

In the first and second embodiments of the liquid discharge head manufacturing method as mentioned above, an example that the pressing member 20 is formed simultaneously with the flow path walls 9 by using the same material was explained. By doing so, the liquid discharge head in which the pressing member 20 is simply formed without increasing the number of manufacturing steps can be manufactured. However, for example, after the movable member 6 and the flow path walls 9 are formed in the manner as shown in the first embodiment of the liquid discharge head manufacturing method, the pressing member 20 may be formed in the manner as shown in the second embodiment of the liquid discharge head manufacturing method, thereby forming the flow path walls 9 independently from the pressing member 20. By doing so, materials for giving optimum functions to the flow path walls 9 and the pressing member 20 can be used.

<Second Embodiment>

Figure 12:
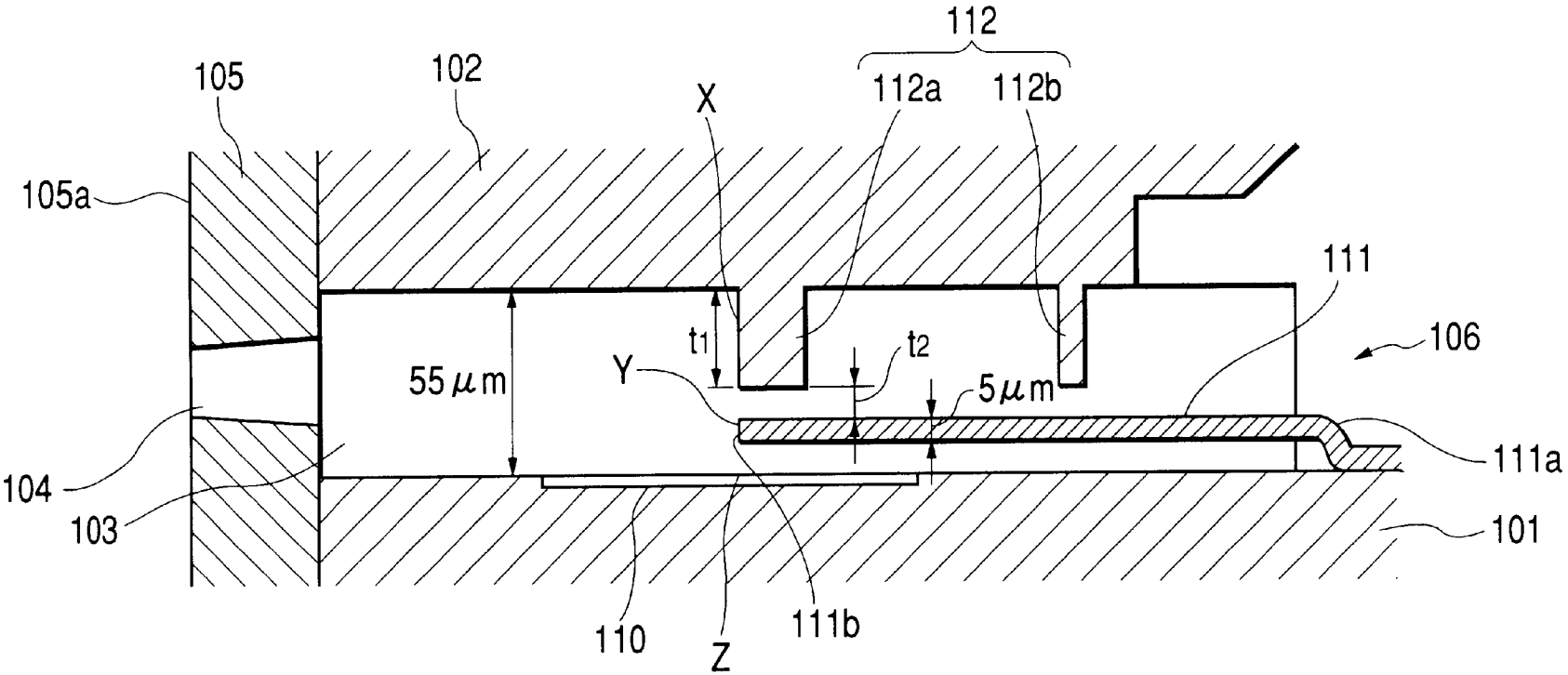
FIG. 12 is a schematic sectional side view of a liquid discharge head according to a second embodiment of the present invention.

FIG. 12 is a schematic side sectional view showing main parts of a liquid discharge head according to a second embodiment of the present invention. Further, FIGS. 13A to 13F are views for explaining liquid discharging steps or processes from the liquid discharge head shown in FIG. 12.

First of all, a construction of the liquid discharge head will be explained with reference to FIG. 12.

The liquid discharge head comprises an element substrate 101 including heat generating members 110 as bubble generating means and a movable member 111, a top plate 102 on which regulating portions 112 are formed, and an orifice plate 105 in which discharge ports 104 are formed. In this embodiment, each regulating portion (stopper) 112 comprises discrete distal end regulating portion 112*a* and flexure regulating portion (displacement regulating portion) 112*b*.

Flow paths (liquid flow paths) 103 are formed by laminating the element substrate 1 and the top plate 102 and each has an elongated shape defined by the element substrate 101 and side walls (flow path walls) 107 and top plate 102. Further, a plurality of flow paths 103 are formed side by side in the single liquid discharge head and are communicated with downstream side (left in FIG. 12) discharge ports 104 for discharging liquid. A bubble generating area exists in the vicinity of an area where the heat generating member 110 contacts with the liquid. Further, a large volume common liquid chamber 106 are communicated with the flow paths 103 simultaneously at an upstream side thereof (right in FIG. 12). Namely, the flow paths 103 are branched from the single common liquid chamber 106. A height of the common liquid chamber 106 is higher than a height of each flow path 103.

The movable member 111 is supported at its one end in a cantilever fashion and is secured to the element substrate 101 at an upstream side of the ink flowing direction, and portions of the movable member at a downstream side of a fulcrum 111*a* can be displaced in an up-and-down direction with respect to the element substrate 101. In an initial condition, the movable member 111 is positioned substantially in parallel with the element substrate 101 with a gap therebetween.

In the illustrated embodiment, the movable member 111 is positioned so that free ends 111*b* thereof are located in central areas of the heat generating members 110, and first regulating portions (distal end regulating portions) 112*a* are provided on the top plate 102 to be positioned above the respective free ends 111*b* of the movable member 111, and second regulating portions (flexure regulating portions) 112*b* are provided to be positioned at an upstream side of the respective heat generating members. Each distal end regulating portion 112*a* regulates an upward movement of the free end 111*b* of the movable member 111 by abutting against the free end. Each flexure regulating portion 112*b* serves to regulate flexure deformation of the movable member (upper convex deformation of an intermediate portion between the free end and the fulcrum). In this way, during the regulation of displacement of the movable member 111, due to the presence of the movable member 111 and the distal end regulating portion 112*a*, the flow path 103 is substantially blocked at the upstream side by the presence of the movable member 111 and the distal end regulating portion 112*a* and at the downstream side by the presence of the movable member 111 and the distal end regulating portion 112*a*.

A position Y of the free end and an end X of the distal end regulating portion 112*a* are preferably positioned in a plane perpendicular to the element substrate 101. More preferably, these positions X, Y are positioned together with the center Z of the heat generating member 110 on the plane perpendicular to the element substrate 101.

Further, a height of the flow path 103 at the downstreams side of the distal end regulating portion 112*a* is abruptly increased. With this arrangement, even when the movable member 111 is regulated by the distal end regulating portion 112*a* and the flexure regulating portion 112*b*, since the adequate flow path height is maintained, growth of a bubble 140 at a downstream side of the bubble generating area is not obstructed, with the result that the liquid can be smoothly directed toward the discharge port 104. Further, unevenness in pressure balance between a lower end and an upper end of the discharge port 104 in a height direction is reduced. Accordingly, good liquid discharge can be achieved.

The ceiling configuration at the upstream side of the distal end regulating portion 112*a* toward the common liquid chamber 106 is abruptly risen. With this arrangement, if there is no movable member 111, since liquid resistance at the downstream side of the bubble generating area is greater than that at the upstream side, the pressure is hard to be directed toward the discharge port 104. However, in the illustrated embodiment, during the formation of the bubble, since the shifting of the bubble 140 to the upstream side of the bubble generating area is substantially blocked by the movable member 111, the pressure used for the discharging is positively directed toward the discharge port 104, and, during the supplying of ink, since the liquid resistance at the upstream side of the bubble generating area is small, the ink can immediately be supplied to the bubble generating area.

According to the above-mentioned arrangement, a growing component of the bubble 140 directing toward the downstream side is not even with respect to a growing component of the bubble directing toward the upstream side, and the growing component toward the upstream side becomes small and the shifting of the liquid toward the upstream side is suppressed. Since the flow of the liquid toward the upstream side is suppressed, a retraction amount of meniscus after discharging is decreased, and an amount of meniscus protruding from the orifice surface 105*a* in the re-fill is also decreased accordingly. Therefore, since vibration of meniscus is suppressed, stable discharging can be realized in all driving frequencies from low frequency to high frequency.

Incidentally, in the illustrated embodiment, a path structure between the downstream side portion of the bubble 140 and the discharge port 104 is maintained to "straight communication condition" with respect to the liquid flow. Regarding this, more preferably, it is desirable to create an ideal condition that discharging conditions such as discharging direction and discharging speed of a discharge droplet 166 (described later) are stabilized with very high level by linearly aligning a propagating direction of the pressure wave generated during the generating of the bubble 140, a flowing direction of the liquid caused thereby and a discharging direction with each other. In the illustrated embodiment, as one definition for achieving or approximating such an ideal condition, it may be designed so that the discharge port 104 is directly connected to the heat generating member 110, particularly to the discharge port 104 side (downstream side) portion of the heat generating member 110 affecting an influence upon the discharge port 104 side portion of the bubble 140. In this arrangement, if there is no liquid in the flow path 103, the heat generating member 110, particularly, the downstream side portion of the heat generating member 110 can be observes from the outside of the discharge port 104.

Next, dimensions of various constructural elements will be explained.

In the present invention, by checking or examining the going-around of the bubble 140 onto the upper surface of the movable member 111 (going-around of the bubble 140 to the upstream side of the bubble generating area), it was found that, in dependence upon a relationship between the shifting speed of the movable member 111 and the bubble growing speed (in other words, shifting speed of liquid), the going-around of the bubble 140 onto the upper surface of the movable member 111 can be prevented, thereby obtaining a good discharging property.

That is to say, in the present invention, by regulating the displacement of the movable member 111 by means of the regulating portions 112 at a time when a volume changing ratio of the bubble 140 and a displacement volume changing ratio of the movable member 111 tend to be increased, the going-around of the bubble 140 onto the upper surface of the movable member 111 can be prevented, thereby obtaining a good discharging property.

This will be fully explained with reference to FIGS. 14A to 14C.

Figure 14A:
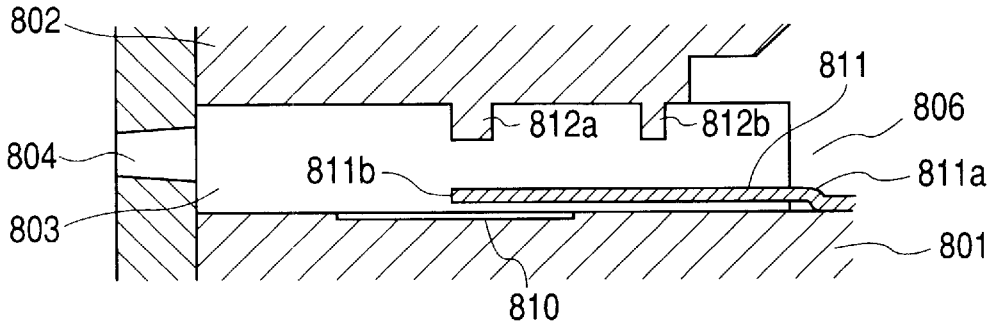
FIGS. 14A, 14B and 14C are views for explaining a state that the liquid is flowing into a gap between a movable member and a regulating portion.
Figure 14B:
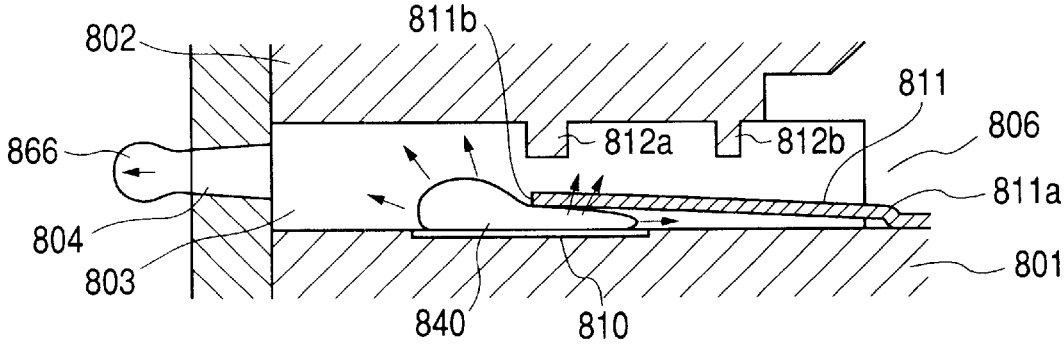
Figure 14C:
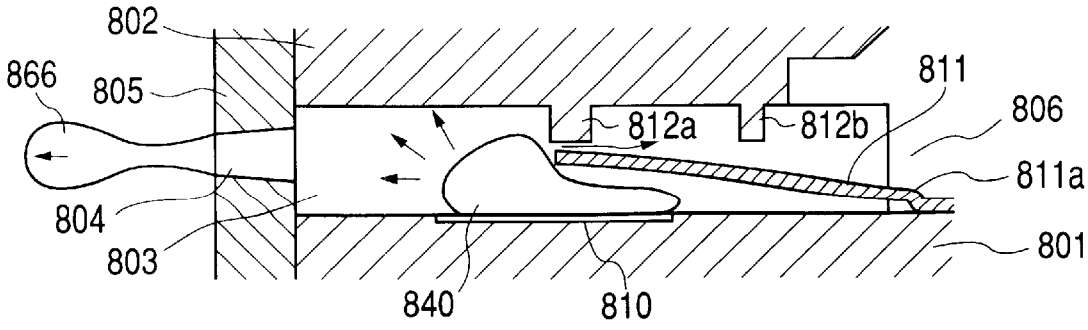

First of all, from a condition shown in FIG. 14A, when a bubble 840 is generated on a heat generating member 810, a pressure wave is generated instantaneously. When liquid around the heat generating member 810 is shifted by the pressure wave, the bubble 840 is being grown. Initially, a movable member 811 is displaced upwardly to substantially follow the shifting of the liquid (FIG. 14B). As time goes on, since an inertia force of the liquid becomes small, by an elastic force of the movable member 811, the displacing speed of the movable member 811 is abruptly reduced. In this case, since the shifting speed of the liquid is not so reduced, a difference between the shifting speed of the liquid and the shifting speed of the movable member 811 becomes great. At this point, if a gap between the movable member 811 (free end 811*b*) and a distal end regulating portion 812 is still wide as shown in FIG. 14C, the liquid flows (shown by the arrow) into an upstream side of a bubble generating area, with the result that the movable member 811 is hard to be contacted with the distal end regulating portion 812 and a discharging force is partially lost. Accordingly, in such a case, adequate regulating (blocking) effect of the movable member 811 by means of the regulating portion (distal end regulating portion 812*a* and flexure regulating portion 812*b*) cannot be achieved.

To the contrary, in the present invention, the regulation of the movable member 111 by means of the distal end regulating portion 112*a* is performed at a stage that the displacement of the movable member 111 substantially follows the shifting of the liquid. Here, in the present invention, for convenience, the displacement speed of the movable member 111 and the growing speed of the bubble 140 (shifting speed of the liquid) are represented by "movable member displacement volume changing ratio" and "bubble volume changing ratio", respectively. Incidentally, "movable member displacement volume changing ratio" and "bubble volume changing ratio" are obtained by differentiating the movable member displacement volume and the bubble volume.

With the arrangement as mentioned above, since the flow of the liquid causing the going-around of the bubble 140 onto the upper surface of the movable member 111 is generally eliminated and a sealed condition of the bubble generating area can be attained more positively, the good discharging property can be obtained.

According to the illustrated arrangement, even after the movable member 111 is regulated by the distal end regulating portion 112*a*, the bubble 140 continues to be grown. In this case, it is desirable that the adequate flow path height of the flow path 103 at the downstream side of the distal end regulating portion 112*a* is maintained to promote free growth of the downstream component of the bubble 140.

Since the width of the movable member 111 is small in comparison with the width of the flow path 103, clearance is maintained between the movable member 111 and the side walls 107 of the flow path. For the bubble 140 generated by heating the heat generating member 110, there are provided the distal end regulating portion 112*a* positioned in an opposed relation to the upstream half of the bubble 140 and adapted to regulate the displacement of the movable member 111, and the flexure regulating portion 112*b* disposed at the upstream side of the upstream end of the heat generating member. The upward displacement of the movable member 111 is regulated by the distal end regulating portion 112*a*, and, if excessive stress acts on the movable member 111, flexure deformation (excessive deformation) of the movable member 111 of the movable member 111 is regulated by the flexure regulating portion 112*b*.

The flexure regulating portion 112*b* is arranged and dimensioned as follows. That is to say, in a normal liquid discharging condition and in a condition that the bubble 140 is bubbling normally, the flexure regulating portion 112*b* does not abut against the movable member 111; however, if the bubble 140 becomes too great to deform the movable member 111 excessively, the flexure regulating portion abuts against the movable member 111 to suppress further deformation.

Incidentally, in the present invention, regulation of the movable member by means of the regulating portion represents a condition that the displacement volume changing ratio of the movable member becomes zero or minus (negative).

Incidentally, the height of the flow path 103 in the illustrated embodiment is 55 $\mu$m, and a thickness of the movable member 111 is 5 $\mu$m. In a case where it is assumed that a height of the stopper is $t_1$ and a distance between the upper surface of the movable member 111 and the stopper 112 in the height direction is $t_2$, when $t_1$ is greater than 30 $\mu$m, the stable liquid discharging property can be obtained, by selecting $t_2$ to 15 $\mu$m or less.

Next, a discharging operation of the liquid discharge head according to the illustrated embodiment will be explained with reference to FIGS. 13A to 13F and FIG. 15 showing time-lapse change in displacement speed and volume of the bubble and time-lapse change in displacement speed and displacement volume of the movable member.

Figure 15:
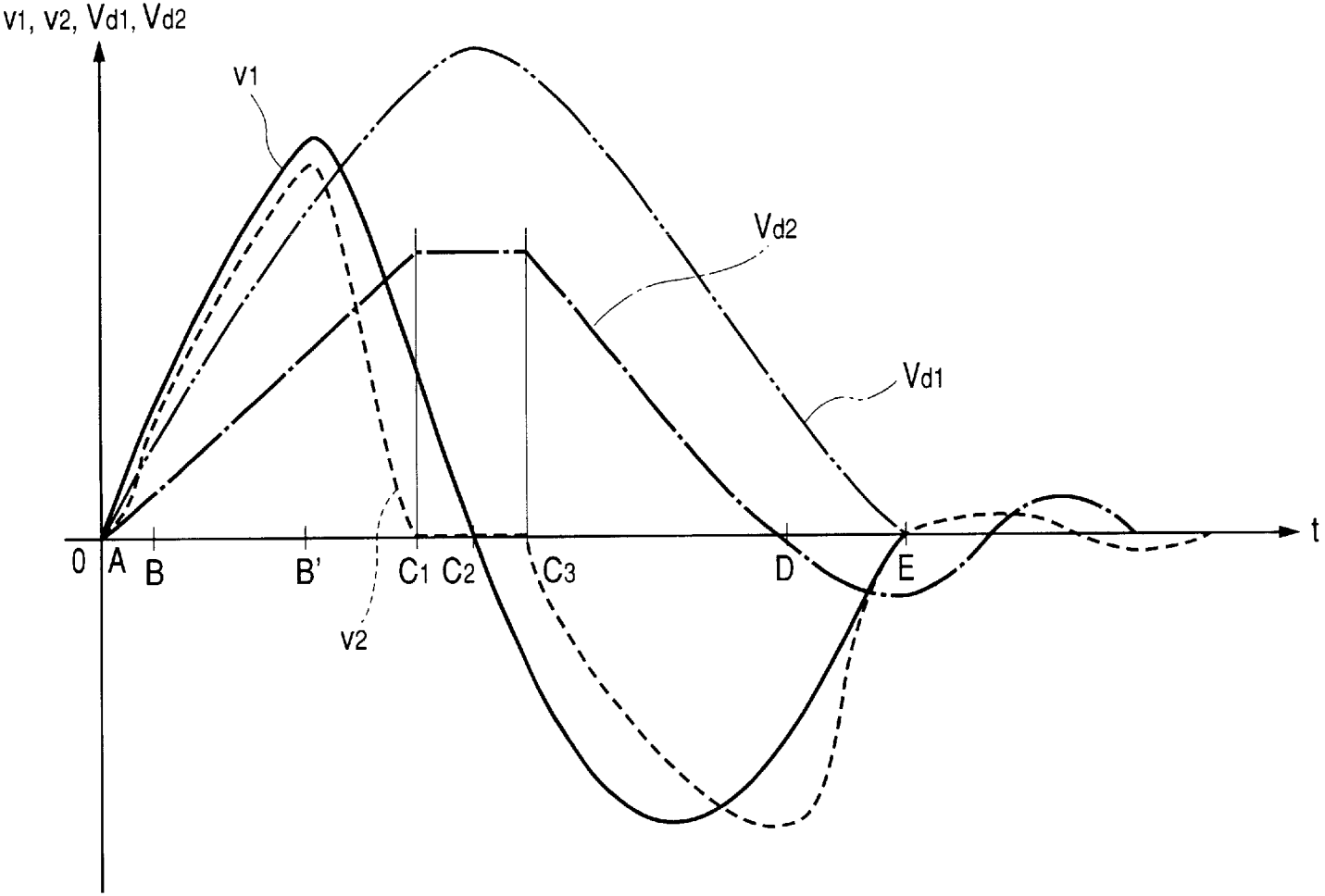
FIG. 15 is a graph showing a time lapse change in displacement speed and volume of a bubble and a time lapse change in displacement speed and volume of the movable member.

In FIG. 15, the bubble volume changing ratio $v_1$ is shown by the solid line, bubble volume $V_{d1}$ is shown by the two dot and chin line, movable member displacement volume changing ratio $v_2$ is shown by the broken line, and movable member displacement volume $V_{d2}$ is shown by the dot and chain line. Further, the bubble volume changing ratio $v_1$ is positive when the bubble volume $V_{d1}$ is increased, the bubble volume $V_{d1}$ is positive when the volume is increased, the movable member displacement volume changing ratio $v_2$ is positive when the movable member displacement volume $V_{d2}$ is increased, and the movable member displacement volume $V_{d2}$ is positive when the volume is increased. Since the movable member displacement volume $V_{d2}$ is positive on the basis of the volume obtained when the movable member 111 is shifted from an initial condition shown in FIG. 13A toward the top plate 102, when the movable member 111 is shifted from the initial condition toward the element substrate 101, the movable member displacement volume $V_{d2}$ indicates a negative value.

Figure 13A:
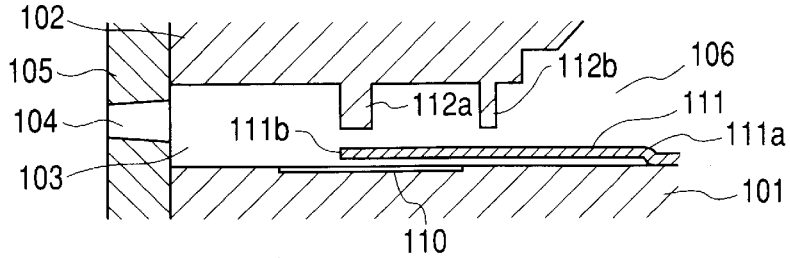
FIGS. 13A, 13B, 13C, 13D, 13E and 13F are views for explaining discharging processes of liquid from the liquid discharge head shown in FIG. 12.

FIG. 13A shows a condition before energy such as electrical energy is applied to the heat generating member 110, i.e., a condition before the heat generating member 110 generates the heat. As will be described later, the movable member 111 is positioned at an area opposed to the upstream half of the bubble 140 generated by the heat of the heat generating member 110.

In FIG. 15, this condition corresponds to A point where time t=0.

Figure 13B:
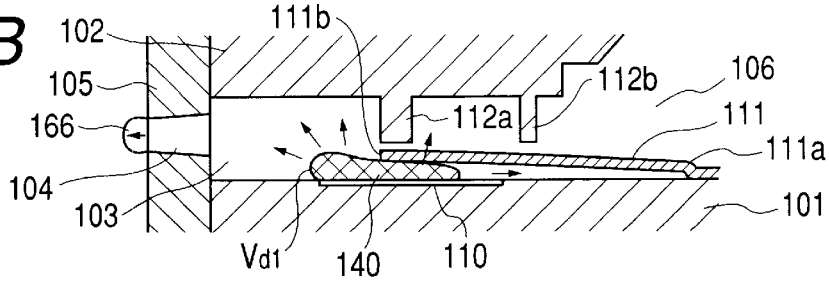

FIG. 13B shows a condition that a part of the liquid filling the bubble generating area is heated by the heat generating member 110 and the bubble 140 starts to be generated by film-boiling. In FIG. 15, this condition corresponds to an area from B point to immediately before $C_1$ point, and, in this case, the bubble volume $V_{d1}$ is increased as the time goes on. Incidentally, in this case, starting of the displacement of the movable member 111 is delayed from the volume change of the bubble 140. That is to say, the pressure wave generated by generation of the bubble 140 due to film-boiling is propagated in the flow path 103, and the liquid is shifted from the central zone of the bubble generating area toward the downstream and upstream sides accordingly, and, in the upstream side, the movable member 111 starts to be displaced by the flow of the liquid caused by the growth of the bubble 140. Further, the liquid shifting toward the upstream side passes between the side walls 107 of the flow path 103 and the movable member 111 and is directed toward the common liquid chamber 106. At this point, the clearance between the distal end regulating portion 112*a* and the movable member 111 is decreased as the movable member 111 is displaced. In this condition, the discharge droplet 166 starts to be discharged from the discharge port 104.

Figure 13C:
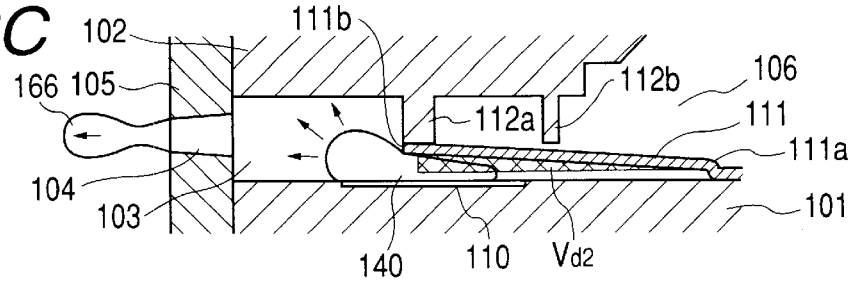
Figure 13D:
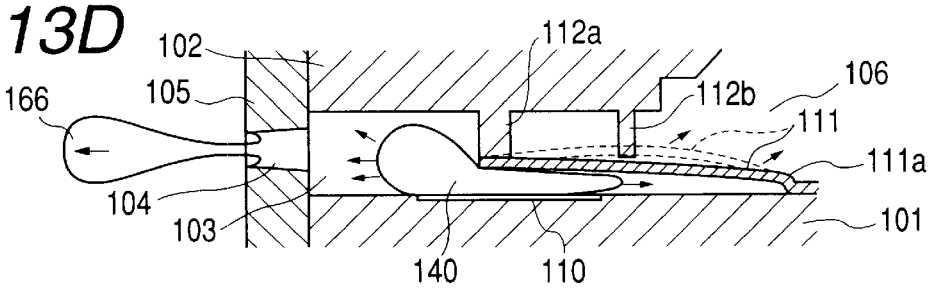

FIG. 13C shows a condition that the free end 111*b* of the movable member 111 is contacted with the distal end regulating portion 112*a* by the further growth of the bubble 140. In FIG. 15, this condition corresponds to an area between $C_1$ point and $C_3$ point.

From the condition shown in FIG. 13B, the movable member displacement volume changing ratio $v_2$ is abruptly decreased before a condition, shown in FIG. 13C, that the movable member 111 contacts with the distal end regulating portion 112*a*, i.e., at B point when B point is shifted to $C_1$ point in FIG. 15. The reason is that, immediately before the movable member 111 contacts with the distal end regulating portion 112*a*, flow resistance of the liquid between the movable member 111 and the distal end regulating portion 112*a* becomes great abruptly. Further, the bubble volume changing ratio $v_1$ is also decreased abruptly.

Thereafter, the movable member 111 further approaches the distal end regulating portion 112*a* and ultimately contacts with the latter. The contact between the movable member 111 and the distal end regulating portion 112*a* is positively realized since the height $t_1$ of the distal end regulating portion 112*a* and the clearance between the upper surface of the movable member 111 and the tip end of the distal end regulating portion 112*a* are dimensioned as mentioned above. When the movable member 111 contacts with the distal end regulating portion 112*a*, since the further upward displacement of the movable member is regulated ($C_1$ to $C_3$ points in FIG. 15), the shifting of the liquid toward the upstream direction is greatly regulated. In accordance with this, the growth of the bubble 140 toward the upstream direction is also limited by the movable member 111.

Although the upward displacement of the movable member 111 is regulated at this time in the normal bubbling condition, if the heating and bubbling occur in a condition that there is a zone (particularly, above the movable member 111) which is not filled with ink due to lack of ink amount in the flow path, an excessive or greater bubble is generated to act an excessive force on the ink. In such a case, the movable member 111 is subjected to greater stress to be further pulled toward the upstream direction, with the result that, as shown by the broken line in FIG. 13D, the movable member tries to be flexure-deformed in a convex form upwardly (toward the top plate). If such flexure deformation occurs, excessive stress acts on the movable member 111 thereby to cause crack or defect, and, if the deformation becomes greater, the movable member may be broken. To the contrary, in the illustrated embodiment, since the flexure regulating member 112*b* is provided at the upstream side of the upstream end of the heat generating member 110, as shown by the solid line in FIG. 13D, the convex flexure deformation of the movable member 111 toward the top plate is prevented. Since the flexure regulating portion 112*b* has the purpose for regulating the upward flexure deformation of the movable member 111 and does not require to block the flow path unlike to the distal end regulating portion 112*a*, it is desirable that the flexure regulating portion provides low flow resistance as less as possible (not to obstruct the re-fill).

After the movable member 111 abuts against the distal end regulating portion 112*a* and the flexure regulating portion 112*b* in this way, the bubble 140 continues to be grown. Since the upstream growth of the bubble is regulated by the distal end regulating portion 112*a* and the movable member 111, the bubble 140 is further grown in the downstream side, with the result that the growing height of the bubble 140 at the downstream side of the heat generating member 110 is increased in comparison with a case where the movable member 111 is not provided. That is to say, as shown in FIG. 15, although the movable member displacement volume changing ratio $v_2$ is zero between $C_1$ and $C_3$ points because the movable member 111 is contacted with the distal end regulating portion 112*a* and the flexure regulating portion 112*b*, the bubble 140 is grown toward the downstream side and continues to be grown till point $C_2$ slightly delayed timingly from $C_1$ point, and the bubble volume $V_{d1}$ becomes maximum at the $C_2$ point.

On the other hand, as mentioned above, since the displacement of the movable member 111 is regulated by the distal end regulating portion 112*a* and the flexure regulating portion 112*b*, the upstream side portion of the bubble 140 has the small size. The upstream side portion of the bubble 140 is regulated by the distal end regulating portion 112*a*, flow path side walls, movable member 111 and fulcrum 111*a* so that an advancing amount toward the upstream area becomes almost zero.

In this way, the flow of the liquid toward the upstream side is greatly reduced, thereby preventing cross-talk of liquid to the adjacent flow paths, back flow (obstructing high speed re-fill) of liquid in the liquid supplying system and pressure vibration.

Figure 13E:
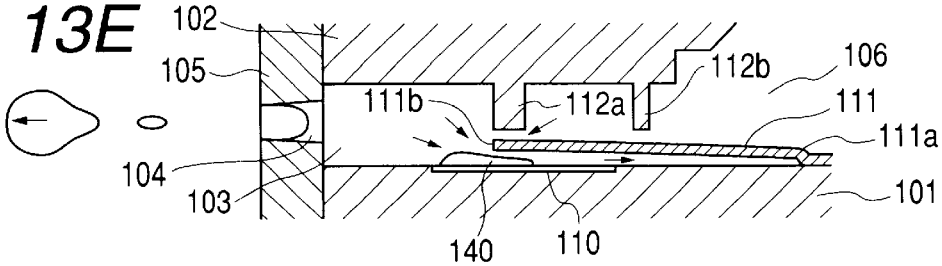

FIG. 13E shows a condition that negative pressure within the bubble 140 after the film-boiling overcomes the downstream shifting of the liquid in the flow path 103 to start contraction of the bubble 140.

As the bubble 140 is contracted ($C_2$ to E points in FIG. 15), although the movable member 111 is displaced downwardly ($C_3$ to D points in FIG. 15), since the movable member 111 itself has cantilever spring stress and stress due to upward convex deformation, a speed for downward displacement is increased. Further, since the flow path resistance is small, the downstream flow of the liquid at the upstream side area of the movable member 111 which is a low flow path resistance area formed between the common liquid chamber 106 and the flow path 103 becomes great flow quickly and flows into the flow path 103. In this operation, the liquid in the common liquid chamber 106 is directed into the flow path 103. The liquid directed into the flow path 103 passes between the distal end regulating portion 112*a* and the downwardly displaced movable member 111 as it is, and then, flows into the downstream side of the heat generating member 110 and acts on the bubble 140 to accelerate the disappearance of the bubble. After such flow of liquid aids the disappearance of the bubble, it creates liquid flow toward the discharge port 104 to aid restoring of the meniscus and to enhance the re-fill speed.

At this stage, liquid pole comprised of the discharge droplet 166 discharged from the discharge port 104 is changed to a liquid droplet which is in turn flying outwardly.

Further, since the flowing of liquid into the flow path 103 through the area between the movable member 111 and the distal end regulating portion 112*a* increases a flow speed at the top plate 102 side, accumulation of minute bubbles at that portion is substantially prevented, thereby contributing the stable discharging.

Further, since the generating point of cavitation due to disappearance of the bubble is shifted to the downstream side of the bubble generating area, the damage to the heat generating member 110 is reduced. At the same time, since adhesion of scorched ink to the heat generating member 110 due to the developing is reduced, the discharging stability is enhanced.

Figure 13F:
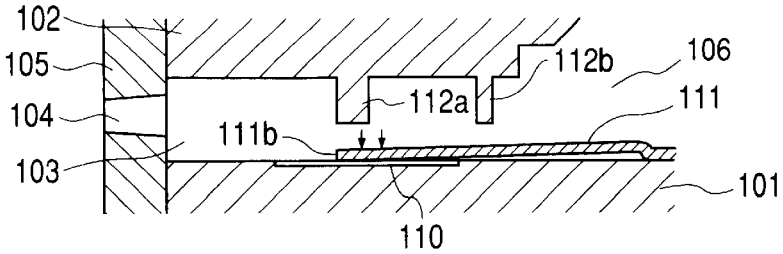

FIG. 13F shows a condition that, after the bubble 140 is completely disappeared, the movable member 111 is overshot from the initial condition (E point and so on in FIG. 15).

Although depending upon the rigidity of the movable member 111 and viscosity of the liquid used, the overshoot of the movable member 111 is attenuated for a short time and the initial condition is restored.

Figure 16:
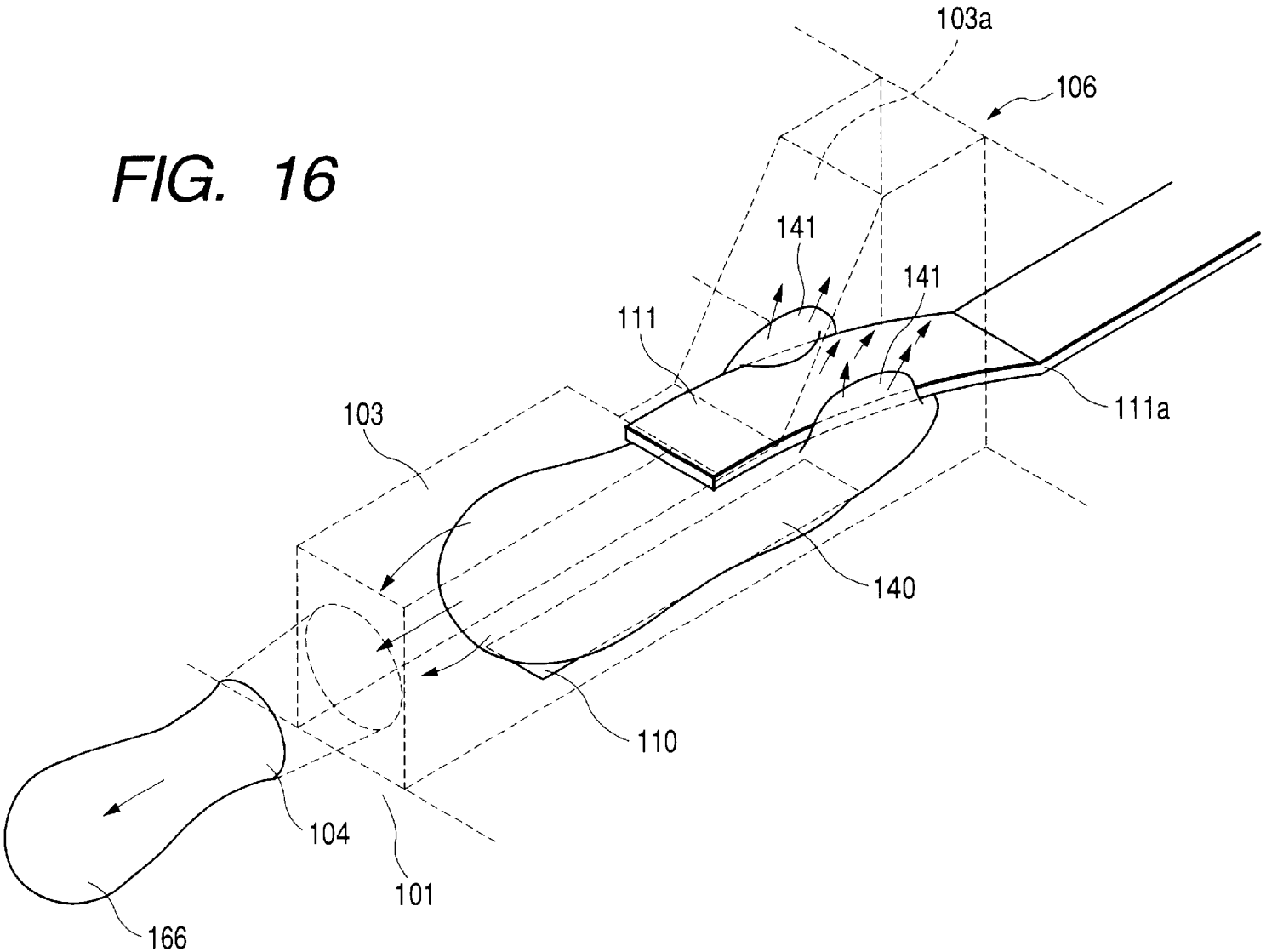
FIG. 16 is a perspective view showing main parts of the liquid discharge head shown in FIG. 12.

Next, particularly, rising bubbles 141 rising from both sides of the movable member 111 and the liquid meniscus at the discharge port 104 will be fully explained with reference to FIG. 16 which is a perspective view of a part of the liquid discharge head of FIG. 12. Incidentally, although the configuration of the distal end regulating portion 112*a* and the configuration of the low flow path resistance area 103*a* at the upstream side of the distal end regulating portion 112*a* shown in FIG. 16 are different from these shown in FIG. 12, they have the same fundamental properties.

In the illustrated embodiment, small clearance exist between the wall surfaces of the side walls 107 constituting the flow path 103 and both lateral edges of the movable member 111, so that the movable member 111 can be displaced smoothly. Further, in the growing process of the bubble by means of the heat generating member 110, the bubble 140 displaces the movable member 111 and is risen toward the upper surface of the movable member 111 through the clearances to slightly penetrate into the low flow path resistance area 103*a*. The penetrated rising bubbles 141 go around the back surface (opposed to the bubble generating area), thereby suppressing the vibration of the movable member 111 and stabilizing the discharging property.

Further, in the disappearing step of the bubble 140, the rising bubbles 141 promote the liquid flow from the low flow path resistance area 103*a* to the bubble generating area, with the result that, in combination with the above-mentioned high speed retraction of the meniscus from the discharge port 104, the disappearance of the bubble is completed quickly. Particularly, due to the liquid flow created by the rising bubbles 141, bubbles are not almost trapped at corners of the movable member 111 and the flow path 103.

In the liquid discharge head having the above-mentioned arrangement, at the time when the liquid is discharged from the discharge port 104 by the generation of the bubble 140, the discharge droplet 166 is discharged substantially in a condition of a liquid pole having a sphere at its leading end. Although this is also true in the conventional head structures, in the illustrated embodiment, when the movable member 111 is displaced by the growth of the bubble and the displaced movable member 111 is contacted with the distal end regulating portion 112*a*, a substantially closed space (except for the discharge port) is created in the flow path 103 including the bubble generating area. Accordingly, when the bubble is completely disappeared in this condition, since the closed space is maintained until the movable member 111 is separated from the distal end regulating portion 112*a* due to the disappearance of the bubble, almost disappearing energy of the bubble 140 acts as a force for shifting the liquid in the vicinity of the discharge port 104 toward the upstream direction. As a result, immediately after the disappearance of the bubble 140 starts, the meniscus is quickly sucked from the discharge port 104 into the flow path 103, with the result that a tail portion constituting the liquid pole connected to the discharge droplet 166 outside of the discharge port 104 is quickly separated by a strong force of the meniscus. Thus, satellites formed from the tail portion is reduced, thereby enhancing the print quality.

Further, since the tail portion is not pulled by the meniscus for a long term, the discharging speed is not decreased, and, since a distance between the discharge droplet 166 and the satellite becomes shorter, the satellite dots are pulled by a so-called slipstream phenomenon rearwardly of the discharge droplet 166. As a result, the satellite dots may be combined with the discharge droplet 166, and, thus, a liquid discharge head in which satellite dots are almost not created can be provided.

Further, in the illustrated embodiment, in the above-mentioned liquid discharge head, the movable member 111 is provided to suppress only the bubble 140 growing toward the upstream direction with respect to the flow of liquid directing toward the discharge port 104. More preferably, the free end 111*b* of the movable member 111 is positioned substantially at a central portion of the bubble generating area. With this arrangement, the back wave to the upstream side due to the growth of the bubble and the inertia force of the liquid which do not directly relate to the liquid discharging can be suppressed, and the downward growing component of the bubble 140 can be directed toward the discharge port 104.

Figure 17A:
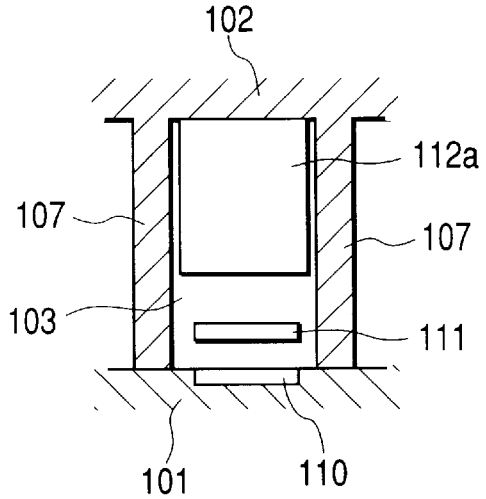
FIG. 17A is a sectional view of a distal end regulating portion forming portion of the liquid discharge head shown in FIG. 12, taken along a direction perpendicular to a flow path.
Figure 17B:
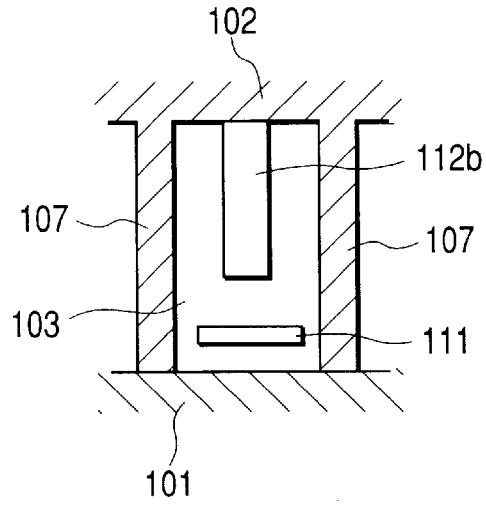
FIG. 17B is a sectional view of a flexure regulating portion forming portion, taken along the direction perpendicular to the flow path.

FIG. 17A is a sectional view of the distal end regulating portion forming portion taken along a direction perpendicular to the flow path, and FIG. 17B is a sectional view of the flexure regulating portion forming portion taken along a direction perpendicular to the flow path. Regarding the distal end regulating portion 112*a*, in order to block the flow of liquid when the movable member 111 displaced by the bubble contacts with or approaches to the distal end regulating portion, clearances between the distal end regulating portion and left and right side walls 107 are very small. On the other hand, the flexure regulating portion 112*b* shown in FIG. 17B does not require to have a width similar to that of the distal end regulating portion 112*a* so long as the flexure deformation (excessive displacement) of the movable member 111 can be regulated. Rather, the flexure regulating portion has a relatively small width not to reduce the re-fill property. Further, regarding the up-and-down direction, the height of the flexure regulating portion 112*b* must be equal to or greater than the height of the distal end regulating portion 112*a* so that the intermediate portion (between the free end 111*b* and the fulcrum 111*a*) of the movable member 111 is not displaced more than the free end 111*b*.

Figure 17C:
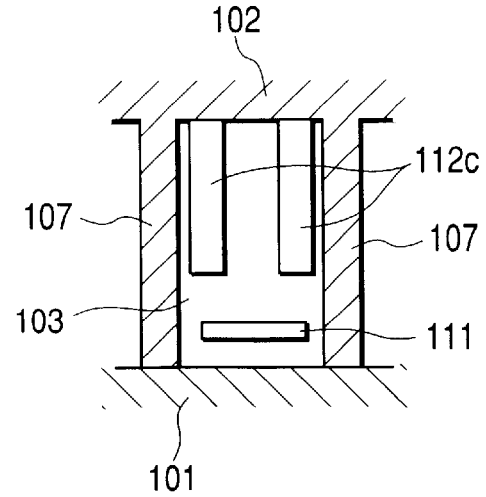
FIG. 17C is a sectional view showing an alteration of the flexure regulating portion, taken along the direction perpendicular to the flow path.

FIG. 17C shows an alteration of the flexure regulating portion. In this case, a flexure regulating portion 112*c* is formed to protrude into the flow path from vicinity of the left and right side walls 107 so that the width-wise central zone of the movable member 111 is not regulated, but the flexure regulating portion abuts both lateral edges of the movable member to regulate the deformation thereof. With this arrangement, deformation of the movable member 111 in a twist direction can also be regulated simultaneously, thereby providing more stable regulation.

(Movable member)

Next, the movable member 111 used in the liquid discharge head according to the embodiments will be fully explained.

As material of the movable member 111, as well as silicon nitride, metal having high endurance such as silver, nickel, gold, iron, titanium, aluminum, platinum, tantalum, stainless steel or bronze phosphide and alloys thereof, or resin having nitrile group such as acrylonitrile, butadiene or styrene, or resin having amide group such as polyamide, or resin having carboxyl group such as polycarbonate, resin having aldehyde group such as polyacetal, or resin having sulfone group such as polysulfone, or resin such as liquid crystal polymer and compounds thereof, or metal having high ink resistance such as gold, tungsten, tantalum, nickel, stainless steel or titanium and alloys thereof, or such metals surface coated to enhance ink resistance, or resin having amide group such as polyamide, or resin having aldehyde group such as polyacetal, or resin having ketone group such as polyether ether ketone, or resin having imide group such as polyimide, or resin having hydroxide group such as phenol resin, or resin having ethyl group such as polyethylene, or resin having alkyl group such as polypropylene, or resin having epoxy group such as epoxy resin, or resin having amino group such as meramine resin, or resin having methylol group such as xylene resin and compounds thereof, or ceramic such as silicon dioxide or silicon nitride may be desirably used.

Next, an arrangement relationship between the heat generating member 110 and the movable member 111 will be explained. By the optimum arrangement of the heat generating member 110 and the movable member 111, the flow liquid during the bubbling by means of the heat generating member 110 can be properly to utilize it effectively.

Figure 18:
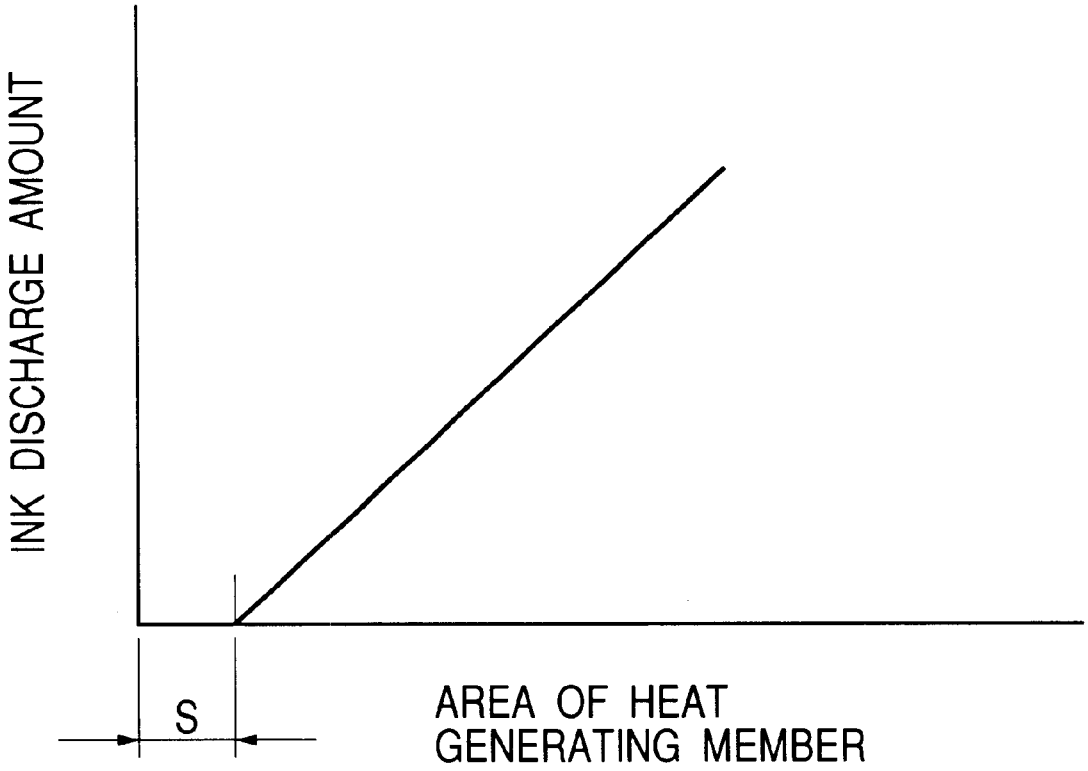
FIG. 18 is a graph showing a relationship between an area of a heat generating member and an ink discharge amount.

In a conventional ink jet recording method, i.e., so-called bubble jet recording method in which a state change including abrupt volume change (generation of bubble) is caused in ink by applying energy such as heat to the ink, the ink is discharged from the discharge port 104 by an acting force based on such state change, and an image is formed by adhering the discharged ink onto a recording medium, as shown in FIG. 18, although an area of the heat generating member has a proportional relationship with respect to an ink discharge amount, it can be seen that there is a non-bubbling effective area S not contributing to the ink discharging. Further, from a condition of the scorched ink on the heat generating member 110, it can be seen that the non-bubbling effective area S exists around the heat generating member 110. From these results, a zone of about 4 $\mu$m around the heat generating member does not relate to the bubbling.

Accordingly, in order to effectively utilize the bubbling pressure, although a zone immediately above a bubbling effective area within about 4 $\mu$m around the heat generating member 110 acts against the movable member 111 effectively, in case of the present invention, by dividing into a stage independently acting on the liquid flows in the flow path 103 at the upstream side and the downstream side of a substantially central zone (in actual, range of about 10 $\mu$m from the center in the liquid flowing direction) of the bubble generating area, and a stage totally acting them, it is very important that the movable member 111 is positioned so that only the upstream side portion from the central zone is opposed to the movable member 111. In the illustrated embodiment, while an example that the bubbling effective area is positioned within about 4 $\mu$m around the heat generating member 110 was explained, depending upon the type of the heat generating member 110 and/or heat generating member forming method, the present invention is not limited to such an example.

(Element substrate)

Next, a construction of the element substrate 101 used in the liquid discharge head according to the above-mentioned embodiments and having the heat generating members 110 for applying the heat to the liquid will be fully explained.

Figure 19A:
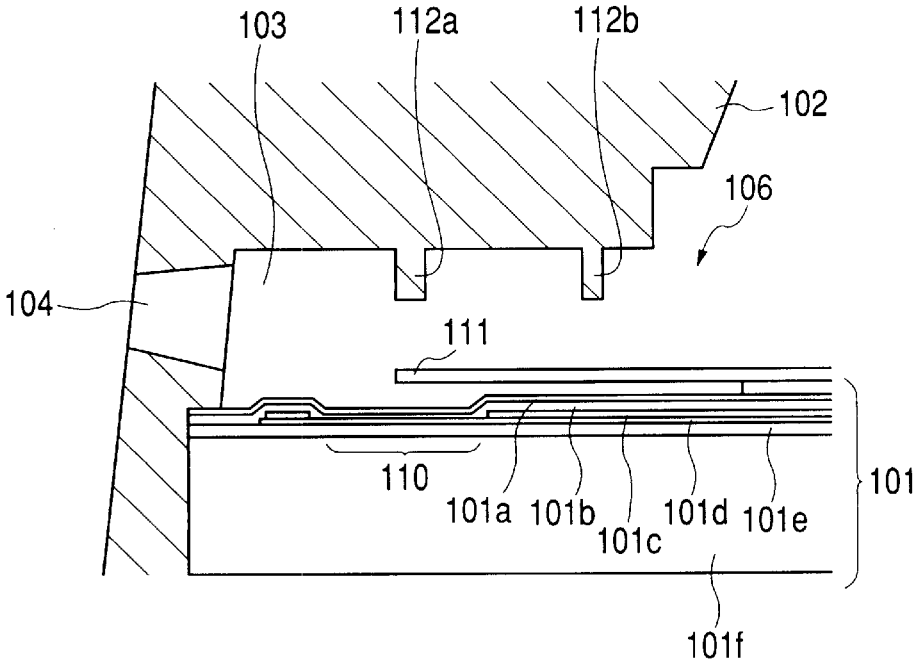
FIGS. 19A and 19B are schematic sectional views for explaining a construction of an element substrate of the liquid discharge head of the present invention.
Figure 19B:
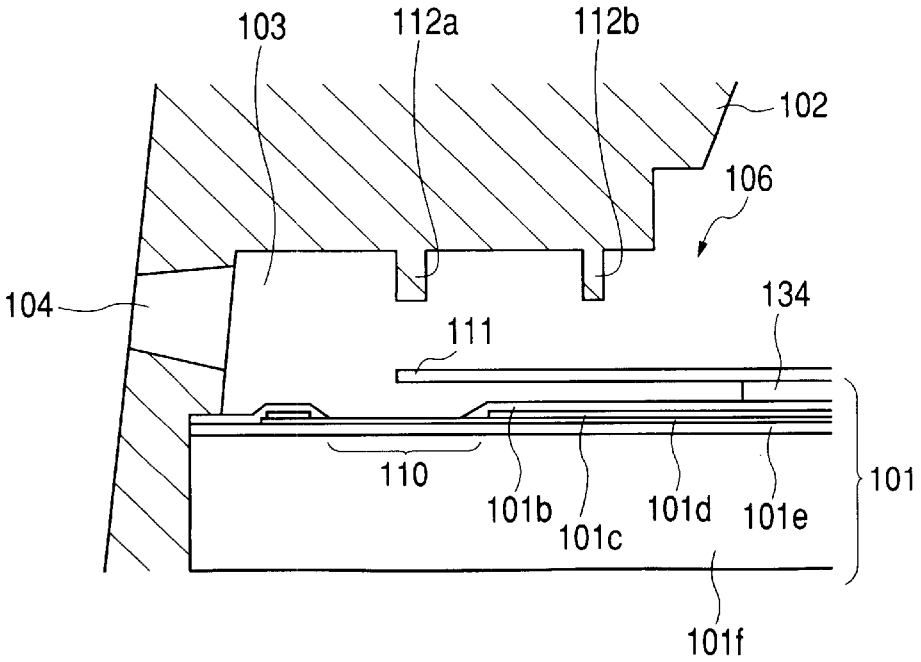

FIGS. 19A and 19B are schematic side sectional views showing main parts of a liquid discharge head as an example of the present invention, for explaining the construction of the element substrate 101, where FIG. 19A shows a liquid discharge head having a protection film which will be described later, and FIG. 19B shows a liquid discharge head having no protection film.

The grooved top plate 102 having the grooves constituting the flow paths 107 is provided on the element substrate 101.

In the element substrate 101, a silicon oxide film or a silicon nitride film 101*e* having the purpose of insulation and heat accumulation is formed on a silicon substrate 101*f*, and an electrical resistance layer 101*d* (having a thickness of 0.01 to 0.2 $\mu$m) made of hafnium boride ($HfB_2$), tantalum nitride (TaN) or tantalum aluminum (TaAl) and forming the heat generating members 110 and wiring electrodes 101*c* (having a thickness of 0.2 to 1.0 $\mu$m) made of aluminum are patterned on the film, as shown in FIG. 19A. By applying voltage from the wiring electrode 101*c* to the resistance layer 101*d*, current is flown in the resistance layer 101*d* to generate heat. A protection film 101*b* made of silicon oxide or silicon nitride and having a thickness of 0.1 to 2.0 $\mu$m is formed on the resistance layer 101*d* between the wiring electrodes 101*c*, and an anti-cavitation layer 110*a* (having a thickness of 0.1 to 0.6 $\mu$m) made of tantalum is formed on the protection film, thereby protecting the resistance layer 101*d* from various liquids such as ink.

Particularly, since the pressure and shock wave generated in generation and disappearance of the bubble are very strong to reduce the endurance of the hard and fragile oxide film considerably, the metallic material such as tantalum (Ta) is used for forming the anti-cavitation layer 110*a*.

Further, by the combination of liquid, flow path structure and resistance material, the protection film 101*b* for the resistance layer 101*d* may be omitted, and, such an example is shown in FIG. 19B. As material of the resistance layer 110*d* not requiring the protection film 101*b*, iridium/tantalum/aluminum alloy can be used.

As such, as the construction of the heat generating member 110 in the above-mentioned embodiments, only the resistance layer 101*d* (heat generating portion) between the electrodes 101*c* may be provided, or the protection layer for protecting the resistance layer 101*d* may be included.

In the embodiments, while an example that the heat generating member 110 has the heat generating portion constituted by the resistance layer 101*d* for generating heat in response to an electrical signal was explained, the present invention is not limited to such an example, but, it is sufficient that the bubble 140 sufficient to discharge the discharge liquid is generated in the bubbling liquid. For example, a photo-thermal converter capable of generating heat by receiving light such as laser or a heat generating member having a heat generating portion capable of generating heat by receiving high frequency.

Incidentally, on the element substrate 101, as well as the heat generating members 110 constituted by the resistance layer 101*d* forming the heat generating portion and the wiring electrodes 101*c* for supplying the electrical signal to the resistance layer 101*d*, functional elements such as transistors, diodes, latches and shift resistors for selectively driving the heat generating member (electrical/thermal converting element) may integrally be formed by a semiconductor manufacturing process.

Figure 20:
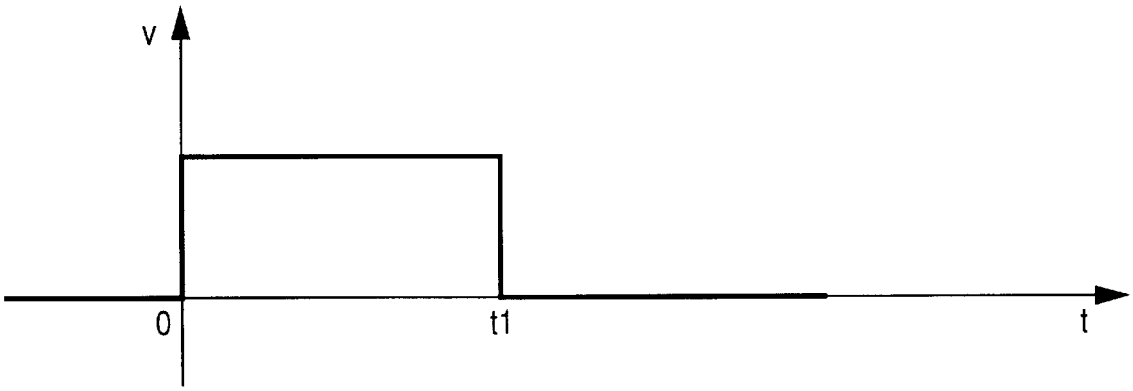
FIG. 20 is a graph showing a pulse wave form applied to the heat generating member.

Further, in order to drive the heat generating portion of the heat generating member 110 provided on the element substrate 101 to discharge the liquid, a rectangular pulse as shown in FIG. 20 is applied to the resistance layer 101*d* via the wiring electrode 101*c*, thereby heating the resistance layer 101*d* between the wiring electrodes 101*c* quickly. In the head according to the above-mentioned embodiments, by applying the electrical signal having voltage of 24 (V), pulse width of 7 ($\mu$m), current of 150 (mA) and frequency of 6 (kHz), the heat generating member is driven to discharge the ink as liquid from the discharge port 104 by the above operation. However, the condition of the driving signal is not limited to this, but any driving signal capable of bubbling the bubbling liquid properly may be used.

<Third Embodiment>

Next, a third embodiment of the present invention will be explained. Elements similar to those in the first and second embodiments are designated by the same reference numerals, and explanation thereof will be omitted.

Figure 21:
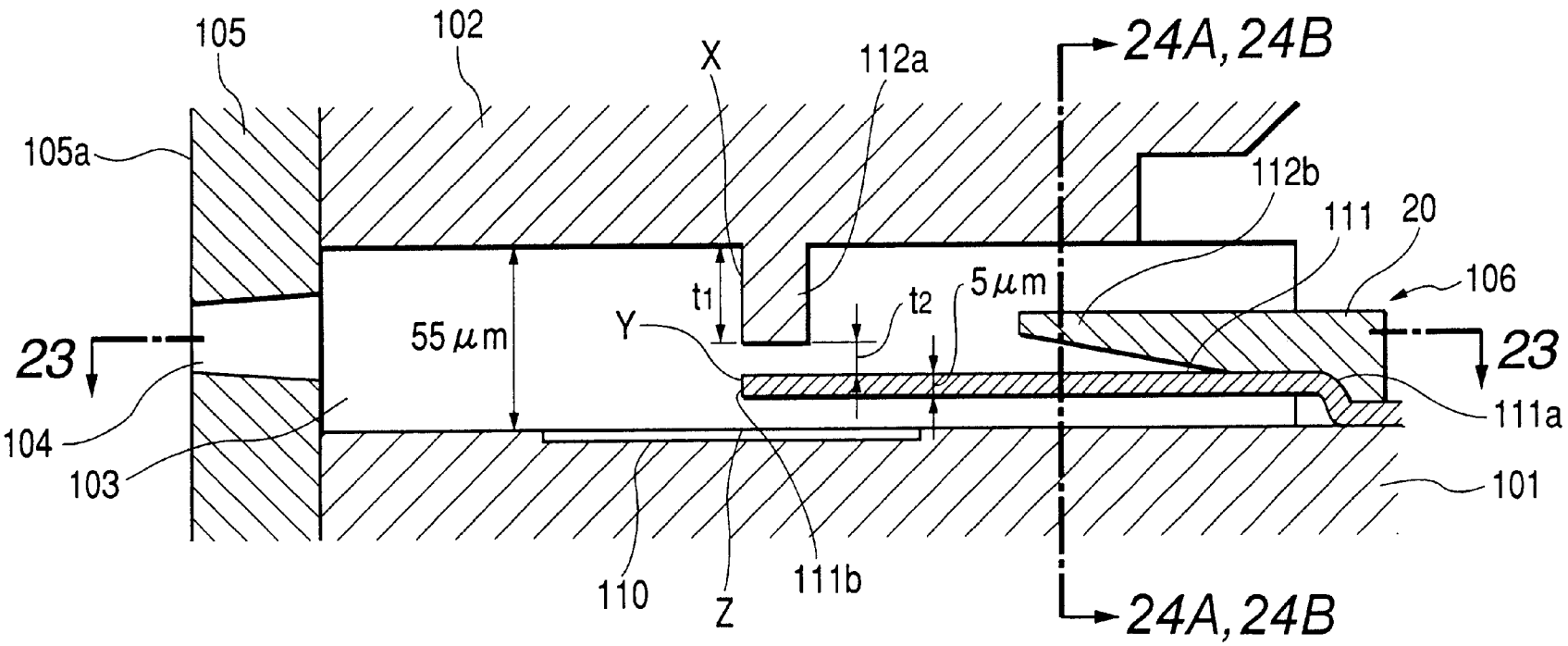
FIG. 21 is a schematic side sectional view of a liquid discharge head according to a third embodiment of the present invention.

In a liquid discharge head according to the third embodiment, an auxiliary member (pressing member 20) similar to the first embodiment has also a function similar to the flexure regulating portion 112*b* in the second embodiment. That is to say, as shown in FIG. 21, a part of a pressing member 20 is tapered and extends at a downstream side (toward the discharge port 104) to be spaced apart from the movable member 111, thereby forming a flexure regulating portion 112*b* opposed to and spaced apart from the intermediate portion of the movable member 111. A displacement regulating portion according to this embodiment comprises the pressing member 20 and the flexure regulating portion 112*b*.

FIG. 21 shows a condition before energy such as electrical energy is applied to the heat generating member 110, i.e., a condition before the heat generating member 110 generates heat. As will be described later, the movable member 111 is positioned at an area opposed to the upstream half of the bubble 140 generated by the heat of the heat generating member 110.

Figure 22A:
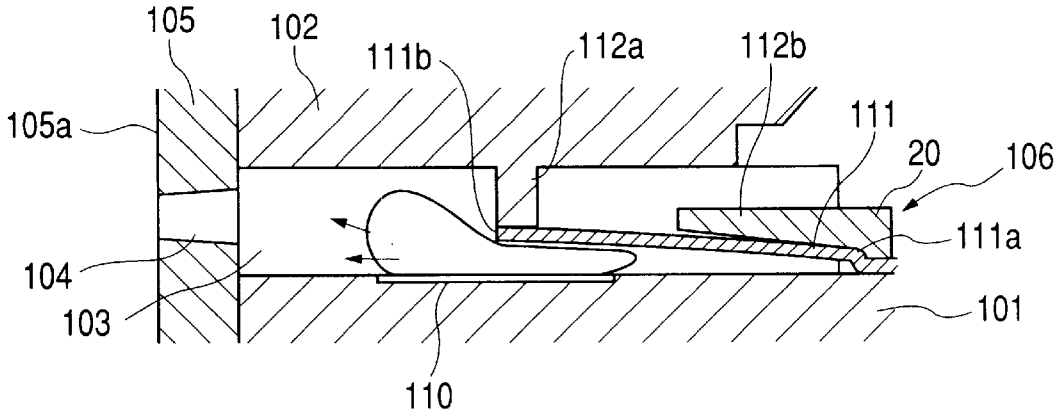
FIGS. 22A and 22B are schematic side sectional views for explaining liquid discharging processes of the liquid discharge head shown in FIG. 21.

In the liquid discharging operation, when the heat generating member 110 is driven to generate heat and the bubble 140 is generated and is being grown, as shown in FIG. 22A, the displaced movable member 111 is approached to and contacted with the distal end regulating portion 112*a*. The contact between the movable member 111 and the distal end regulating portion 112*a* is positively realized since the height $t_1$ of the distal end regulating portion 112*a* and the clearance $t_2$ between the upper surface of the movable member 111 and the tip end of the distal end regulating portion 112*a* are dimensioned as is in the second embodiment. When the movable member 111 contacts with the distal end regulating portion 112*a*, since the further upward displacement of the movable member is regulated, the shifting of the liquid toward the upstream direction is greatly regulated. In accordance with this, the growth of the bubble 140 toward the upstream direction is also limited by the movable member 111.

In the normal bubbling condition, since the upward displacement of the movable member 111 is regulated and the movable member 111 does not contact with the flexure regulating portion 112*b*, no influence affects upon the movable member 111.

Figure 22B:
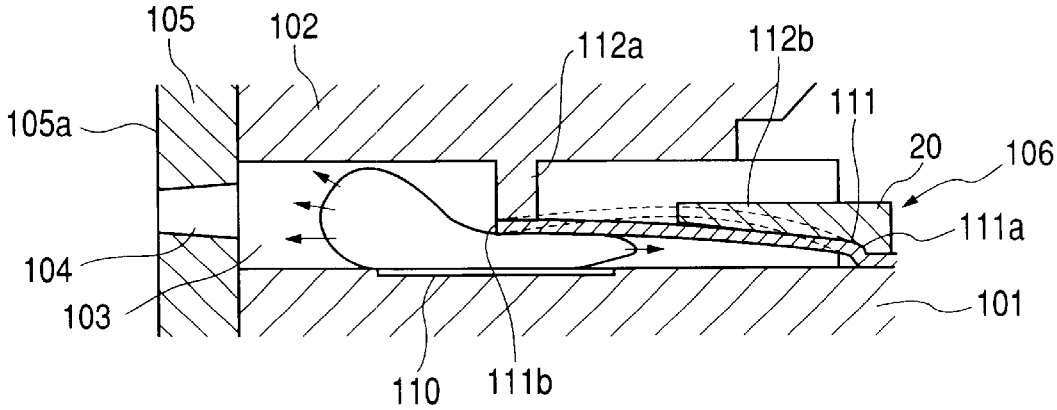

However, if the heating and bubbling occur in a condition that there is a zone (particularly, above the movable member 111) which is not filled with ink due to lack of ink amount in the flow path, an excessive or greater bubble is generated to act an excessive force on the ink. In such a case, the movable member 111 is subjected to greater stress to be further pulled toward the upstream direction, with the result that, as shown by the broken line in FIG. 22B, the movable member tries to be flexure-deformed (excessive displacement) in a convex form upwardly (toward the top plate). If such excessive displacement (flexure deformation) occurs, excessive stress acts on the movable member 111 thereby to cause crack or defect, and, if the deformation becomes greater, the movable member may be broken. To the contrary, in the illustrated embodiment, since the flexure regulating member 112*b* integrally formed with the pressing member 20 is provided at the upstream side of the upstream end of the heat generating member 110, after the free end of the movable member 111 abuts against the distal end regulating portion 112*a*, the convex flexure deformation (excessive displacement) of the movable member 111 toward the top plate is prevented.

After the movable member 111 abuts against the distal end regulating portion 112*a* and the flexure regulating portion 112*b* in this way, the bubble 140 continues to be grown. Since the upstream growth of the bubble is regulated by the distal end regulating portion 112*a* and the movable member 111, the bubble 140 is further grown in the downstream side, with the result that the growing height of the bubble 140 at the downstream side of the heat generating member 110 is increased in comparison with a case where the movable member 111 is not provided.

On the other hand, as mentioned above, since the displacement of the movable member 111 is regulated by the distal end regulating portion 112*a* and the flexure regulating portion 112*b*, the upstream side portion of the bubble 140 has the small size. The upstream side portion of the bubble 140 is regulated by the distal end regulating portion 112*a*, flow path side walls, movable member 111 and fulcrum 111*a* so that an advancing amount toward the upstream area becomes almost zero. In this way, the flow of the liquid toward the upstream side is greatly reduced, thereby preventing cross-talk of liquid to the adjacent flow paths, back flow (obstructing high speed re-fill) of liquid in the liquid supplying system and pressure vibration.

Figure 23:
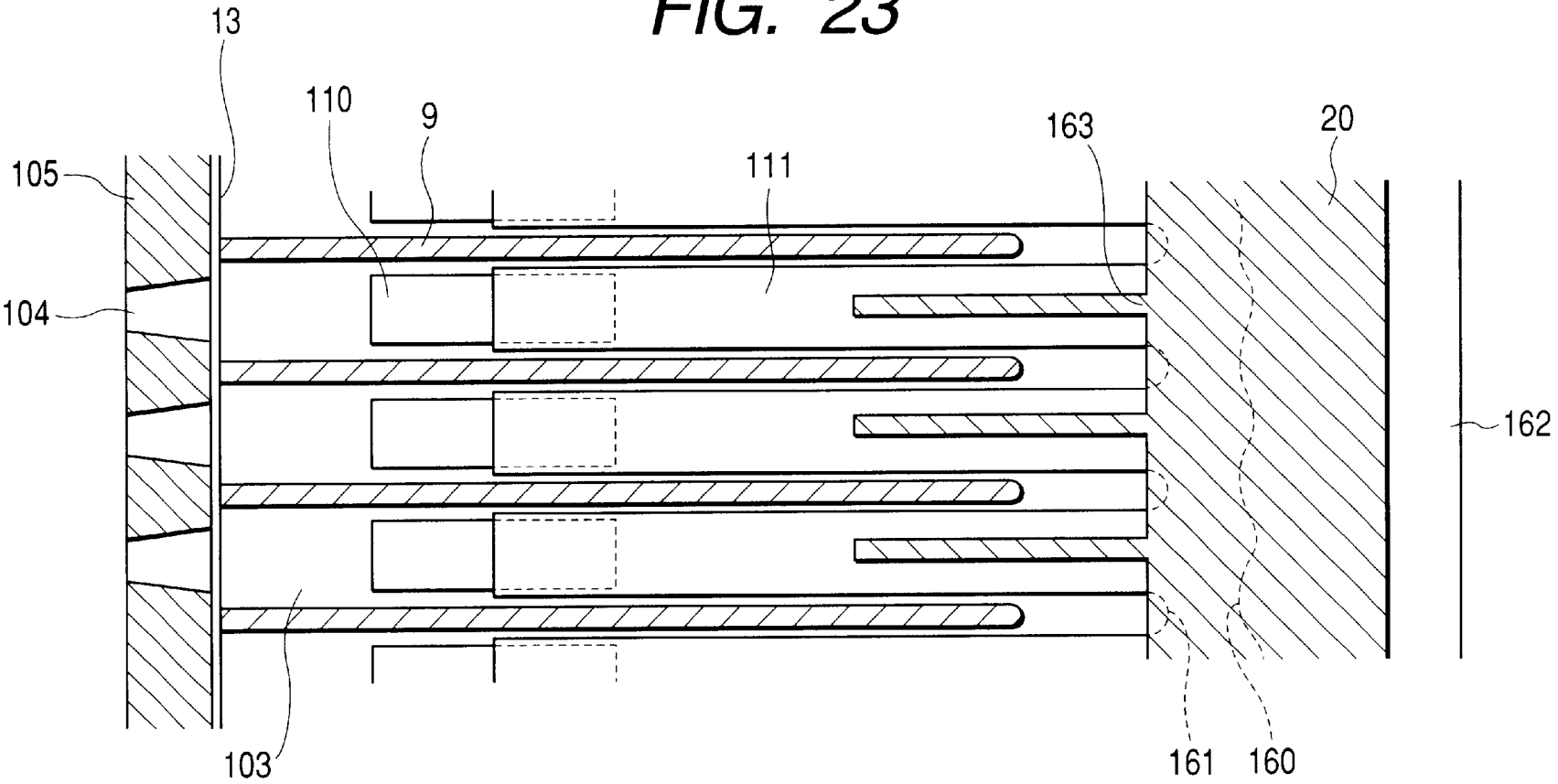
FIG. 23 is a sectional view taken along the line 23—23 in FIG. 21.

Further, as shown in FIG. 23 which is a sectional view taken along the line 23—23 in FIG. 21, since the pressing member 20 covers the stepped portions 160 of the movable member 111 and the root portions 161 of the branched movable member 111, stress acting on the stepped portions 160 of the movable member 111 and the root portions 161 of the branched movable member (which are portions apt to be subjected to stress concentration during the displacement of the movable member 111 if such pressing member 20 does not exist) can be dispersed into the pressing member 20 abutting against these portions, thereby relaxing the stress. Further, even if the plural movable parts of the movable member 111 are displaced simultaneously, stress affecting a great influence upon the endurance of the movable member 111 does not occur. Incidentally, the reference numeral 152 denotes a base. Reference numeral 163 denotes a connecting part.

Figure 24A:
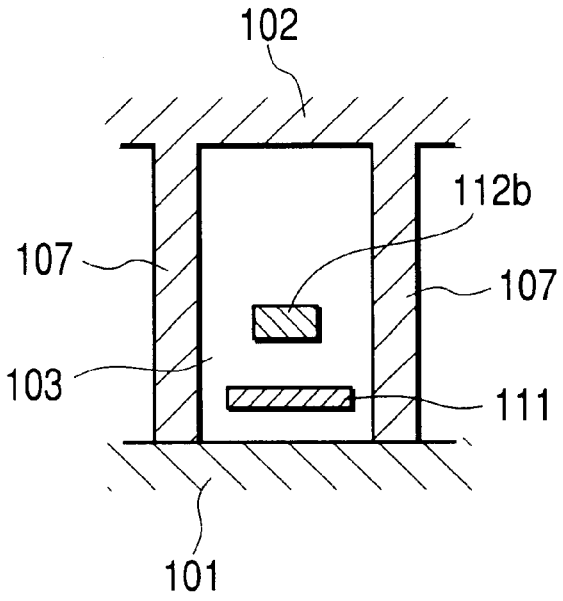
FIGS. 24A and 24B are sectional views taken along the line 24A, 24B-24A, 24B in FIG. 21.
Figure 24B:
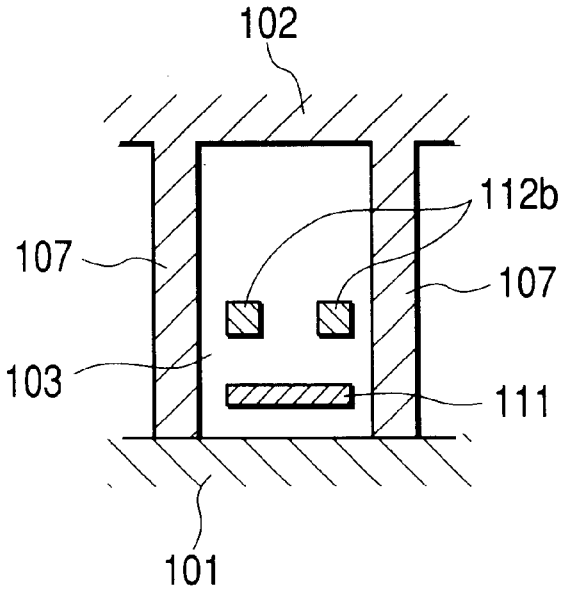

Incidentally, since the displacement regulating portion according to the illustrated embodiment comprising the pressing member 20 and the flexure regulating portion 112*b* has the purpose for regulating the upward excessive displacement (flexure deformation) of the movable member 111 and for relaxing the stress acting on the stepped portions of the movable member 111 and the root portions of the branched movable member 111, the clearance between the movable member 111 and the flexure regulating portion 112*b* is desirably selected so that, in the maximum displacement of the movable member 111 under the normal bubbling condition, the flexure regulating portion does not contact with the movable member 111 (flexure deformation does not occur). Further, unlike to the distal end regulating portion 112*a*, since the flexure regulating portion 112*b* does not require to block the flow path, for example, as shown in FIGS. 24A and 24B which a sectional views taken along the line 24A, 24B-24A, 24B in FIG. 21, it is desirable that the flexure regulating portion 112*b* is configured to reduce the flow resistance as less as possible (not to obstruct the re-fill).

<Other Constructions>

Figure 25:
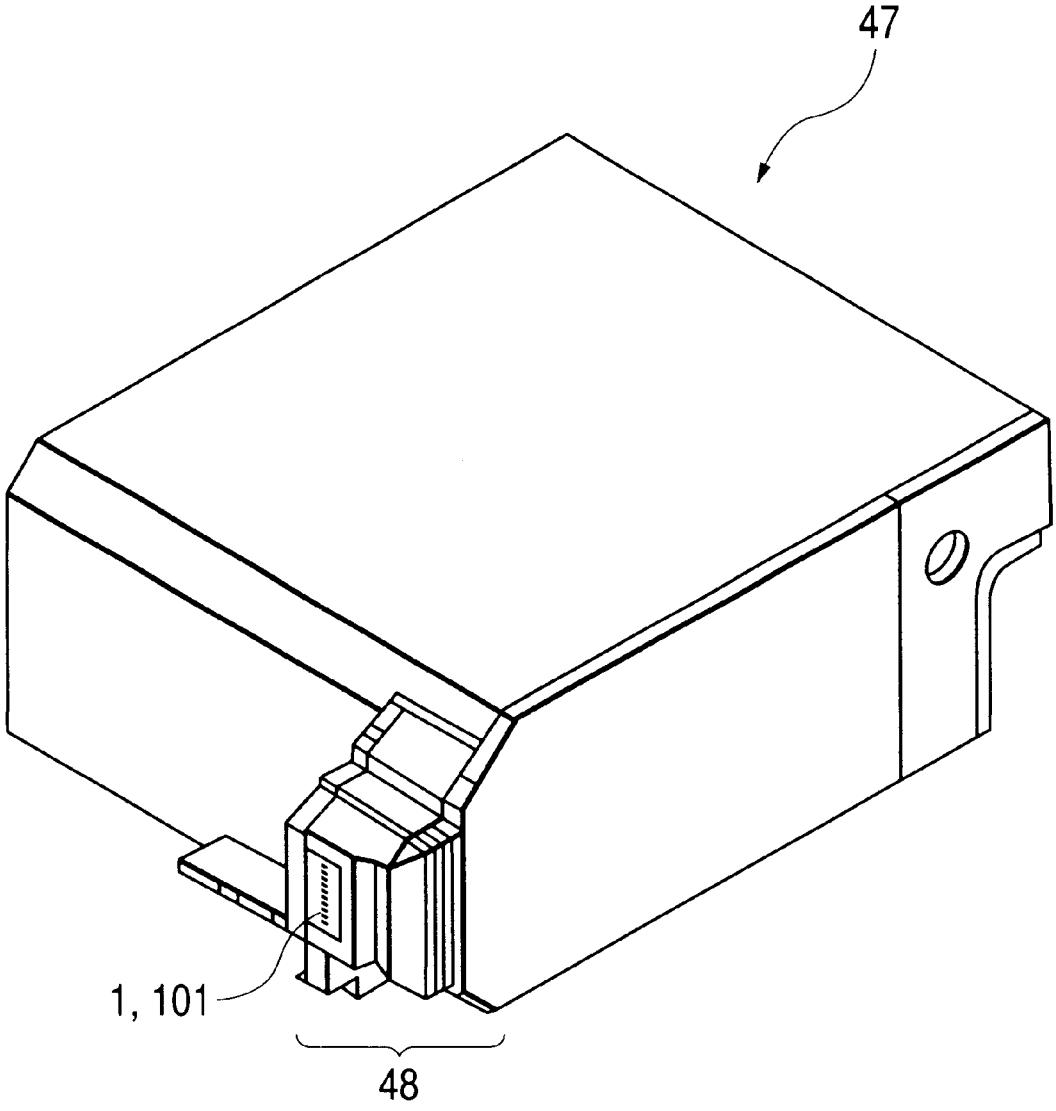
FIG. 25 is a perspective view showing a head cartridge according to an embodiment of the present invention.

FIG. 25 is a perspective view showing a head cartridge 47 having the above-mentioned liquid discharge head 48 and a liquid container storing the liquid to be supplied to the head. Incidentally, the liquid container can be re-used by re-filling the liquid after liquid consumption.

Figure 26:
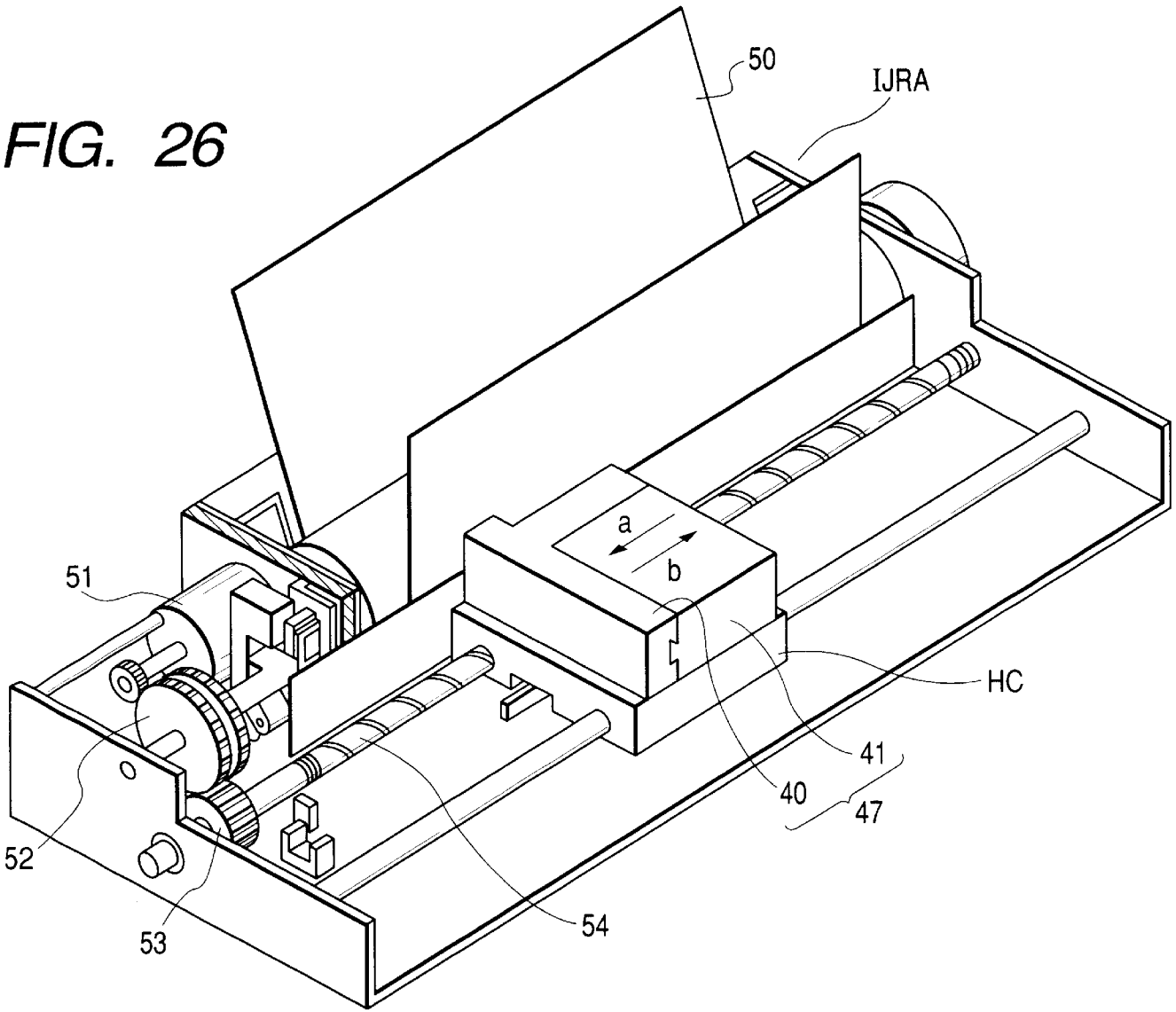
FIG. 26 is a perspective view showing a liquid discharge apparatus according to an embodiment of the present invention.

FIG. 26 is a perspective view showing a schematic construction of a liquid discharge apparatus to which the head cartridge 47 is mounted. Here, an ink discharging apparatus IJRA in which ink is used as the discharge liquid is shown. The ink discharging apparatus IJRA is connected to a motor 51 via a gear 52 and has a conveying roller rotatingly driven in response to a driving signal from driving signal supplying means (not shown) to convey a recording medium 50 such as a recording paper. The head cartridge 47 is mounted on a carriage HC, and FIG. 25 shows an example that a liquid discharge head portion 40 to which the liquid discharge head 48 is mounted and a liquid container portion 41 are detachably mounted. The carriage HC is supported for reciprocal movement along a carriage guide and a carriage shaft 54 in a width-wise direction (shown by the arrows a and b) of the recording medium 50. The carriage shaft 54 is connected to the motor 51 via gears 52, 53 to be rotatingly driven in response to the driving signal. The carriage HC is engaged by a spiral or helical groove formed in the carriage shaft 54 so that the carriage can be reciprocally shifted in response to rotation of the carriage shaft 54.

A recording operation of the ink discharging apparatus IJRA is performed in such a manner that, after the recording medium 50 is conveyed to a predetermined position by the conveying roller and the carriage HC is shifted to a predetermined position, the ink is discharged from the liquid discharge head 48 mounted to the carriage HC toward the recording medium 50, thereby forming a good image.

Figure 27:
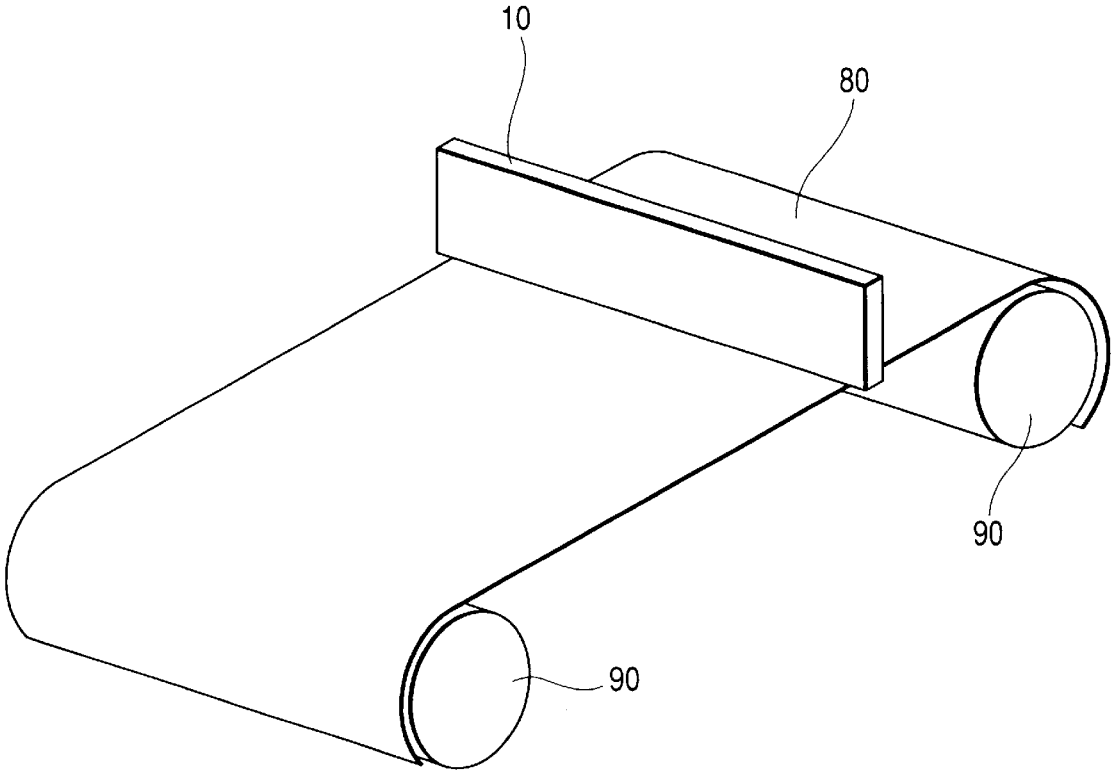
FIG. 27 is a perspective view showing a liquid discharge apparatus according to another embodiment of the present invention.

FIG. 27 is a schematic perspective view showing another example of a liquid discharge apparatus. This liquid discharge apparatus has a so-called full-line head 70 in which a plurality of discharge ports are arranged along the whole width of a recordable area of a recording medium 80. The full-line head 70 is positioned above and transverse to a conveying path for the recording medium 80 conveyed by a conveying drum 90, so that the recording can collectively be effected on the whole width of the recordable area of the recording medium 80.

Figure 28:
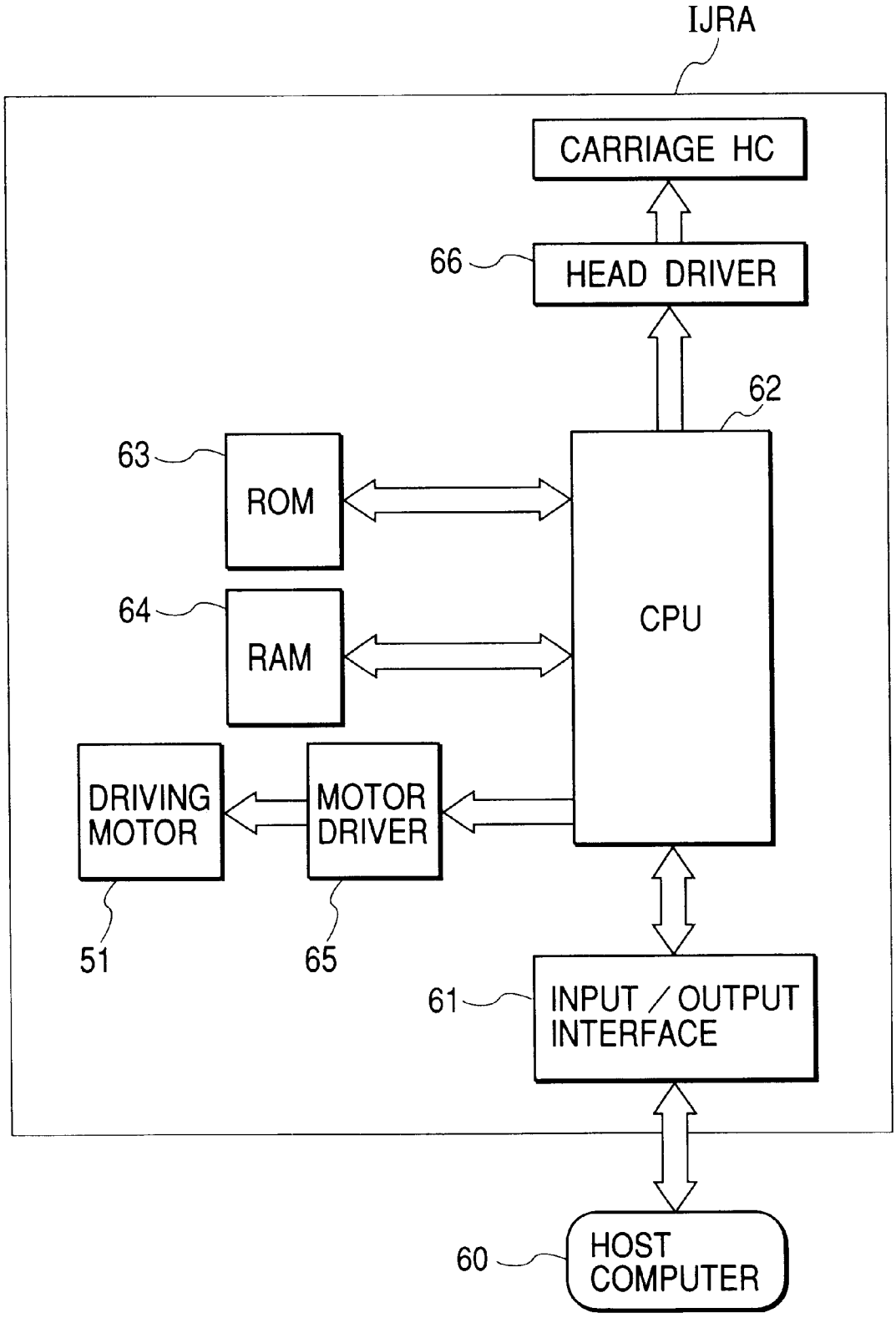
FIG. 28 is a schematic block diagram of a control portion of the liquid discharge apparatus according to the embodiment of the present invention.
Figure 29A:
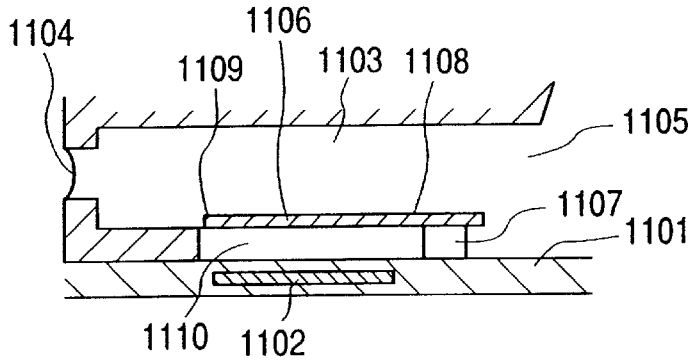
FIG. 29A PRIOR ART
FIGS. 29A, 29B, 29C and 29D are sectional views for explaining a discharging operation of a conventional liquid discharge head.
Figure 29B:
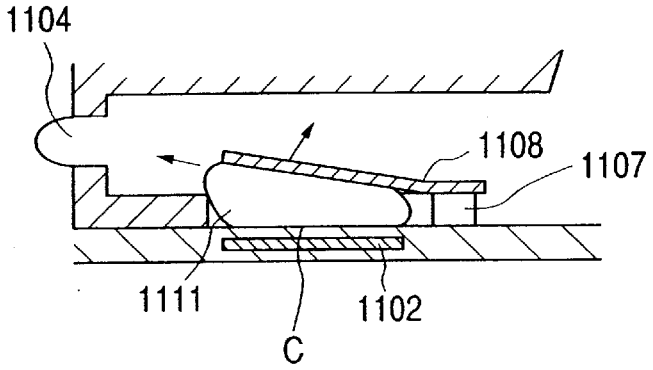
FIG. 29B PRIOR ART
Figure 29C:
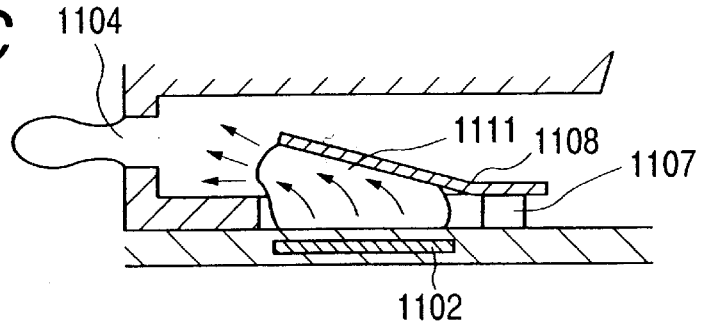
FIG. 29C PRIOR ART
Figure 29D:
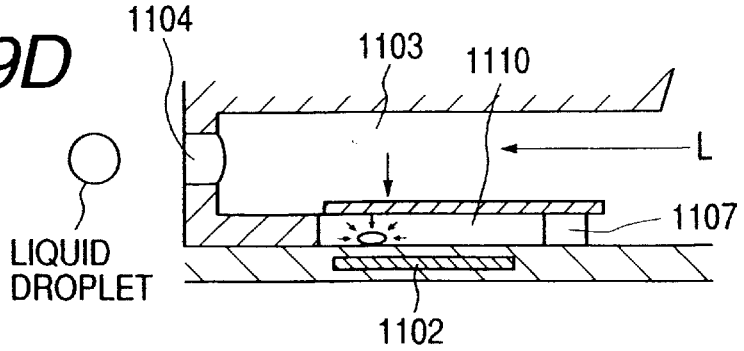
FIG. 29D PRIOR ART
Figure 30:
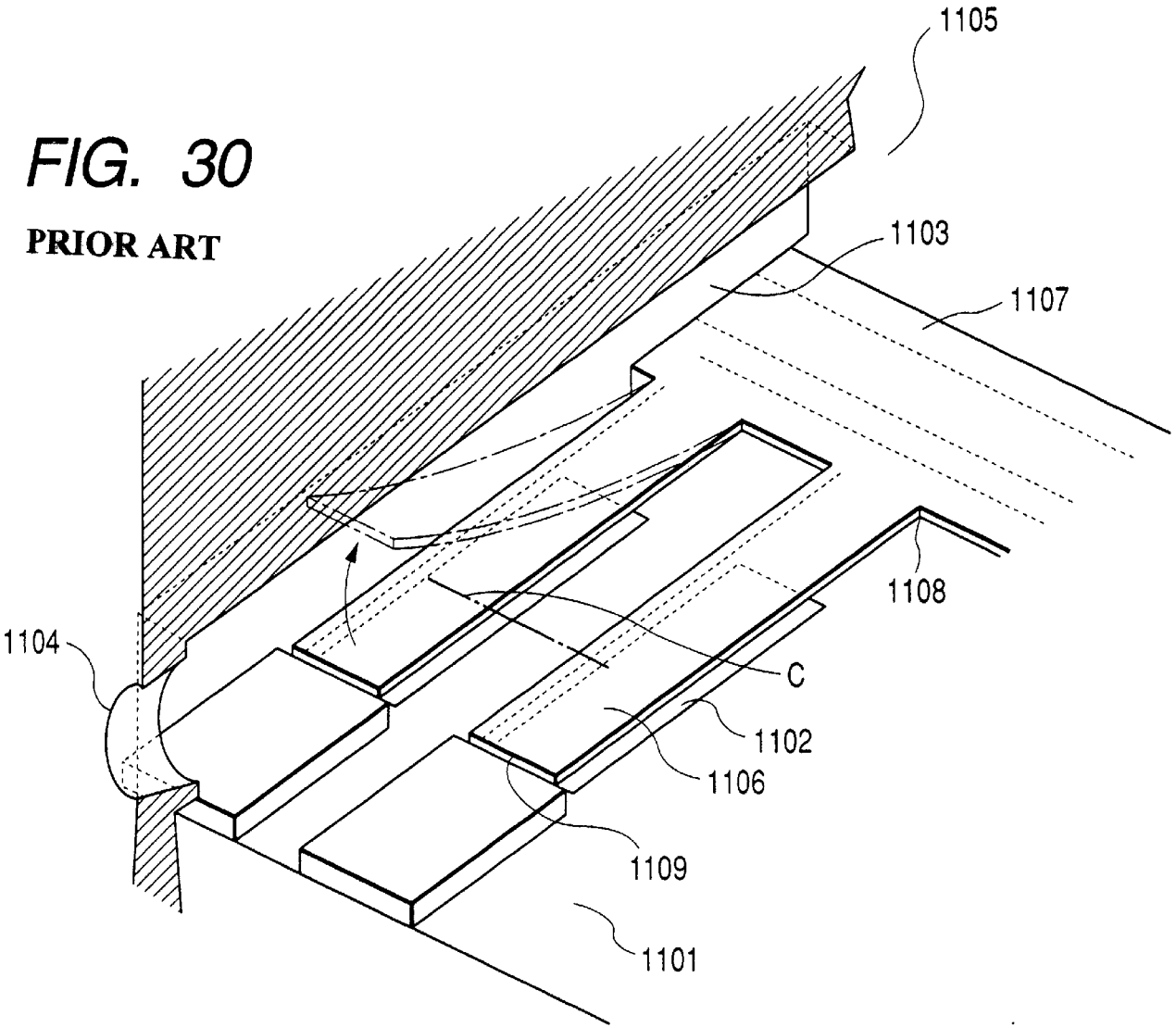
FIG. 30 PRIOR ART
FIG. 30 is a perspective view, in partial section, of the liquid discharge head shown in FIGS. 29A, 29B, 29C and 29D.

FIG. 28 is a schematic block diagram of a control portion for controlling a recording operation of the above-mentioned liquid discharge apparatus (ink discharge recording apparatus). The ink discharge recording apparatus (IJRA) receives image information as a control signal from a host computer 60. The image information in converted into processable data in an input/output interface 61 of the ink discharge recording apparatus and is temporarily stored.

A CPU 62 serves to process the data temporarily stored in the input/output interface 61 on the basis of a control program stored in a ROM 63 while utilizing a peripheral unit such as a RAM 64, thereby converting the data into data (image data) to be recorded. Further, the CPU 62 forms drive data for driving the driving motor 51 on the basis of the image data at an appropriate timing synchronous with the liquid discharging operation of the liquid discharge head 48 in order to record an image corresponding to the image data at an appropriate position on the recording medium. The image data formed in this way is transmitted to the carriage HC via a head driver 66, and the drive data is transmitted to the driving motor 51 via a motor driver 65, with the result that the carriage HC (liquid discharge head 48) and the driving motor 51 are driven at controlled timings, thereby forming the image.

As the recording medium which can be used in the liquid discharge apparatus and to which the liquid such as ink is applied, various papers, OHP sheet, plastic materials used in a compact disk and a mounting plate, cloth, metallic material such as aluminum and copper, leather material such as cow leather, pig leather and synthetic leather, wood material such as wood and plywood, bamboo material, ceramic material such as tile, and a three-dimensional structure such as sponge can be used.

Further, the liquid discharge apparatus can be designed to be used as a printer apparatus for effecting recording on various OHP sheets, a plastic recording apparatus for effecting recording on plastic material such as a compact disk, a metal recording apparatus for effecting recording on a metal plate, a leather recording apparatus for effecting recording on leather material, a wood recording apparatus for effecting recording on wood material, a ceramic recording apparatus for effecting recording on ceramic material, a recording apparatus for effecting recording on a three-dimensional structure such as sponge and a print apparatus for effecting recording on cloth. The liquid used in these various liquid discharge apparatuses is preferably suitable for respective recording media and/or recording conditions.

As mentioned above, according to the present invention, in the liquid discharge head including the regulating portion comprised of the distal end regulating portion and the displacement regulating portion and having the movable member, by providing the pressing portion abutting against the stepped portion of the connection portion between the base of the movable member and the root portions of the branched movable parts as the displacement regulating portion, the stress acting on these portions can be relaxed. Thus, the endurance of the movable member can be enhanced, and reliability of liquid discharging can be enhanced.

Further, by providing the flexure regulating portion as the displacement regulating portion and by regulating the displacement of the free end of the movable member by means of the distal end regulating portion and regulating the flexure deformation of the intermediate portion of the movable member by means of the flexure regulating portion, crack, defect or breaking of the movable member due to excessive deformation can be prevented, thereby enhancing the endurance.

When the area (through which the liquid can pass) of the portion of the flow path in which the distal end regulating portion is provided is smaller than the area (through which the liquid can pass) of the portion of the flow path in which the flexure regulating portion is provided, for example, by widening the distal end regulating portion more than the flexure regulating portion, the re-fill property is not reduced and high frequency liquid discharging is permitted.

What is claimed is:

1. A liquid discharge head comprising:

a discharge port for discharging liquid;

a liquid flow path communicated with said discharge port and adapted to supply the liquid to said discharge port;

an element substrate including a heat generating member for generating a bubble in the liquid filled in said liquid flow path;

a movable member having a fixed portion supported by and secured to said element substrate, a free end positioned toward said discharge port and movable parts disposed at a position opposed to said heat generating member on said element substrate and spaced apart from said element substrate by a gap therebetween, and a regulating portion for regulating a displacement amount of said movable member; and wherein the liquid is discharged from said discharge port by pressure created by generation of a bubble meanwhile said movable part of said movable member is displaced; and further wherein said regulating portion comprises a distal end regulating portion abutting against the free end of said movable member and at least one displacement regulating portion spaced apart from said distal end regulating part.

2. A liquid discharge head according to claim 1, wherein said movable member is constituted by integrally forming said fixed portion, a plurality of said movable parts and a common support portion spaced apart from said element substrate and adapted to branch and support said movable parts so that, when the liquid is discharged, said movable part is displaced around a connection portion between said movable part and said common support portion as a fulcrum, and said displacement regulating portion is an auxiliary member which is provided in an opposed relationship to at least said common support portion of said movable member to suppress excessive displacement of said common support portion.

3. A liquid discharge head according to claim 2, wherein said auxiliary member abuts against an upper surface of said movable member.

4. A liquid discharge head according to claim 3, wherein said auxiliary member extends onto said element substrate between the branched plural movable parts and abuts against said element substrate.

5. A liquid discharge head according to claim 4, wherein said auxiliary member is also formed in a gap between said movable parts of said movable member and said element substrate.

6. A liquid discharge head according to any one of claims 2 to 5, wherein said auxiliary member is formed through root portions of said plural movable parts along a direction along which the branched movable parts are arranged side by side.

7. A liquid discharge head according to claim 2, wherein said auxiliary member is formed integrally with flow path walls defining side walls of said liquid flow path.

8. A liquid discharge head according to claim 2, wherein said auxiliary member is formed from photosensitive resin.

9. A liquid discharge head according to claim 8, wherein the photosensitive resin is epoxy resin.

10. A method for manufacturing a liquid discharge head according to claim 2, comprising:

a step for simultaneously forming the flow path walls defining side walls of said liquid flow path and said auxiliary member with same material.

11. A method according to claim 10, comprising the steps of:

forming said movable member on said element substrate;

filling liquid-form photo-curable resin into a gap between said movable member and said element substrate and coating the resin on said element substrate until said movable member is covered;

curing the photo-curable resin by exposure at least in areas where the flow path walls defining the side walls of said liquid flow path and said auxiliary member are to be formed; and removing uncured portion of the photo-curable resin.

12. A method for manufacturing a liquid discharge head according to claim 2, comprising the steps of:

forming said movable member and flow path walls defining side walls of said liquid flow path on said element substrate;

filling liquid-form photo-curable resin into a gap between said movable member and said element substrate and coating the resin on said element substrate until said movable member is covered;

curing the photo-curable resin by exposure at least in areas where said auxiliary member are to be formed; and removing uncured portion of the photo-curable resin.

13. A method according to claim 11 or 12, wherein said movable member is formed from transparent material.

14. A liquid discharge head according to claim 1, wherein said displacement regulating portion includes at least one flexure regulating portion spaced apart from said distal end regulating portion and disposed at an upstream side of said heat generating member and capable of abutting against an intermediate portion of said movable member.

15. A liquid discharge head according to claim 14, wherein said flexure regulating portion abuts against the intermediate portion of said movable member only when said movable member is displaced excessively.

16. A liquid discharge head according to claim 14 or 15, wherein said distal end regulating portion and said flexure regulating portion are independently formed on a top plate joined to said element substrate.

17. A liquid discharge head according to claim 14, wherein a sectional area of said distal end regulating portion in a direction perpendicular to a flowing direction of the liquid in said liquid flow path is greater than a sectional area of said flexure regulating portion in the direction perpendicular to the flowing direction of the liquid in said liquid flow path.

18. A liquid discharge head according to claim 17, wherein said distal end regulating portion is wider than said flexure regulating portion.

19. A liquid discharge head according to claim 14, wherein a plurality of said flexure regulating portions are provided.

20. A head cartridge comprising:

a liquid discharge head according to claim 1; and a liquid container for storing the liquid to be supplied to said liquid discharge head.

21. A liquid discharge apparatus comprising:

a liquid discharge head according to claim 1; and driving signal supplying means for supplying a driving signal for discharging the liquid from said liquid discharge head.

22. A liquid discharge apparatus according to claim 21, further comprising conveying means for conveying a recording medium for receiving the liquid discharged from said liquid discharge head.

* * * * *

UNITED STATES PATENT AND TRADEMARK OFFICE

CERTIFICATE OF CORRECTION

PATENT NO. : 6,474,792 B2
DATED : November 5, 2002
INVENTOR(S) : Hiroyuki Sugiyama et al.

It is certified that error appears in the above-identified patent and that said Letters Patent is hereby corrected as shown below:

Column 1,
Line 20, “(“recording”” should read -- “recording” --;
Line 23, “are” should read -- is --; and
Line 26, “propose” should read -- use --.

Column 2,
Line 27, “accumulates” should read -- accumulate --.

Column 3,
Line 25, “portion” should read -- portions --; and
Line 37, “are” should read -- is --.

Column 4,
Line 26, “are” should be deleted.

Column 5,
Line 52, “crack may” should read -- a crack may be --.

Column 12,
Line 27, “include” should read -- to include --.

Column 13,
Line 2, “characterized” should read -- characterized by --.

Column 16,
Line 4, “FIGS.” should read -- FIG. --.

Column 20,
Line 67, “are” should read -- is --.

Column 22,
Line 39, “observes” should read -- observed --.

Column 26,
Line 48, “becomes” should read -- becomes a --.

UNITED STATES PATENT AND TRADEMARK OFFICE

CERTIFICATE OF CORRECTION

PATENT NO. : 6,474,792 B2
DATED : November 5, 2002
INVENTOR(S) : Hiroyuki Sugiyama et al.

It is certified that error appears in the above-identified patent and that said Letters Patent is hereby corrected as shown below:

Column 29,
Line 30, “to utilize it effectively” should read -- utilized --.

Column 33,
Line 10, “a” should read -- are --; and
Line 65, “in” should read -- is --.

Column 35,
Line 16, “therebetween,” should read -- therebetween; --;
Line 18, “and wherein” should read -- wherein --;
Line 20, “meanwhile” should read -- while --; and
Line 65, “with” should read -- with the --.

Column 36,
Line 22, “are” should read -- is --.

Signed and Sealed this

Twenty-sixth Day of August, 2003

JAMES E. ROGAN
*Director of the United States Patent and Trademark Office*